US007610668B2

(12) United States Patent
Sprague et al.

(10) Patent No.: US 7,610,668 B2
(45) Date of Patent: Nov. 3, 2009

(54) AUTOMATED SIDEWALL ASSEMBLY MACHINE

(75) Inventors: Steven A. Sprague, Savannah, GA (US); P. Alan Whiten, Savannah, GA (US); R. Wayne Achtziger, Clyo, GA (US)

(73) Assignee: Great Dane Limited Partnership, Chicago, IL (US)

( * ) Notice: Subject to any disclaimer, the term of this patent is extended or adjusted under 35 U.S.C. 154(b) by 239 days.

(21) Appl. No.: 11/397,826

(22) Filed: Apr. 4, 2006

(65) Prior Publication Data

US 2007/0226978 A1 Oct. 4, 2007

(51) Int. Cl.
*B23P 19/00* (2006.01)

(52) U.S. Cl. ..... 29/525.06; 29/897.2; 29/34 B; 29/281.1; 29/407.1; 29/407.05; 29/712; 29/564.1; 29/563; 700/113; 700/108

(58) Field of Classification Search ..... 29/34 B, 29/33 K, 281.1, 407.01, 407.09, 524.1, 525.01, 29/525.05, 525.06, 525.11, 525.13, 525.14, 29/564.1, 564.2, 897.2, 407.05, 709, 711, 29/712, 714, 715, 716, 720, 721; 227/5, 227/6, 7, 26, 27, 51, 69, 110, 111; 700/116, 700/112, 113, 108, 95
See application file for complete search history.

(56) References Cited

U.S. PATENT DOCUMENTS 4,098,556 A 7/1978 Sugimoto
4,310,964 A 1/1982 Murphy
4,662,556 A 5/1987 Gidlund
4,885,836 A 12/1989 Bonomi et al.
5,181,808 A 1/1993 Griggs et al.
5,248,074 A 9/1993 Speller et al.
5,537,927 A 7/1996 Rogovein et al.

(Continued)

FOREIGN PATENT DOCUMENTS

JP 2001079637 A 3/2001

OTHER PUBLICATIONS

GT Automation Group Brochure.

(Continued)

*Primary Examiner*—Erica E Cadugan
(74) *Attorney, Agent, or Firm*—Baker & Daniels LLP

(57) ABSTRACT

An automated sidewall assembly machine is provided for attaching a sidewall panel to a top and bottom rail of a wheeled trailer. The machine comprises a frame, a carriage for longitudinal movement relative to the frame, an automated punch mounted proximate the frame and an automated riveting press mounted proximate the frame so that the sidewall assembly is movable by the carriage with respect to the frame, the automated punching machine and the automated riveting machine so that holes can be punched through one or more of the sidewall, the bottom rail and the top rail and rivets can be inserted into the punched holes to be mashed. A sensor is operably mounted to the sidewall assembly machine so that information obtained by the sensor can be used to drive the carriage, the automated punching machine and the automated riveting press. A drive motor in communication with the carriage moves the carriage longitudinally with respect to the frame, and a control system having a processor is in operative communication with the carriage, the automated puncher, the automated riveting press, the sensor, and the drive motor.

34 Claims, 37 Drawing Sheets

U.S. PATENT DOCUMENTS

| | | | | |
|---|---|---|---|---|
| 5,577,315 | A | 11/1996 | Givler | |
| 5,653,005 | A * | 8/1997 | Speller et al. | 29/701 |
| 5,664,311 | A | 9/1997 | Banks et al. | |
| 5,910,894 | A | 6/1999 | Pryor | |
| 6,003,812 | A | 12/1999 | Micale et al. | |
| 6,088,897 | A | 7/2000 | Banks et al. | |
| 6,172,374 | B1 | 1/2001 | Banks et al. | |
| 6,324,353 | B1 * | 11/2001 | Laussermair et al. | 399/16 |
| 6,523,245 | B2 | 2/2003 | Whiten et al. | |
| 6,691,392 | B2 * | 2/2004 | Savoy et al. | 29/407.09 |
| 2002/0099524 | A1 * | 7/2002 | Sell et al. | 703/1 |
| 2003/0009867 | A1 * | 1/2003 | Whiten et al. | 29/34 B |
| 2004/0101966 | A1 * | 5/2004 | Davis et al. | 436/43 |
| 2004/0158965 | A1 * | 8/2004 | Savoy | 29/407.1 |
| 2006/0032554 | A1 | 2/2006 | Sprague et al. | |
| 2007/0039155 | A1 * | 2/2007 | Savoy | 29/407.1 |

OTHER PUBLICATIONS

DEPRAG Complete Product Line Catalog, Oct. 2004.

* cited by examiner

AUTOMATED SIDEWALL ASSEMBLY MACHINE

BACKGROUND OF THE INVENTION

The present invention relates to automatic fastening machines and methods thereof and, more specifically to an apparatus and method for automatic assembly of major subassemblies.

Large transportation vehicles, such as highway trailers, aircraft, and railroad cars typically comprise multiple subassemblies that are fastened together. For example, a highway trailer includes a chassis, a roof, a floor, and a pair of sidewalls. Generally, a trailer's sidewalls are attached to both the floor and roof of the trailer. In the case of a sixty-foot long highway trailer, the load demands and sheer size of the sidewalls, roof, and floor require that the sidewalls be attached to both the roof and floor by rails that provide sufficient structural support to withstand such loads.

To increase a trailer's structural integrity, it is preferable to attach a sidewall to a top and a bottom rail using multiple points of attachment for rivets or screws. In the case of sidewalls that have vertical support posts, extra support and points of connection must be provided to both securely fasten the sidewall, post, and rail together and to ensure that the increased localized weight and stress due to the vertical posts is adequately supported. For example, a sidewall may be connected to a rail by a single line of rivets parallel to the longitudinal axis of the sidewall and appropriately spaced to securely fasten the sidewall and rail together. However, multiple rivets may be required to securely fasten the sidewall, sidewall rails and sidewall post. Additionally, manufacturing tolerances and human error may result in slight variations in the spacing between sidewall posts on each individual trailer.

SUMMARY OF THE INVENTION

The present invention recognizes and addresses considerations of prior art constructions and methods. In an embodiment of the present invention an automated punch and rivet machine for riveting a work piece at sequential work sites on the work piece, the machine comprising a frame for supporting the workpiece, the frame having a longitudinal axis, a carriage disposed proximate to the frame for movement relative thereto along the longitudinal axis, the carriage for transporting the work piece relative to the frame, at least one automated puncher fixed relative to said carriage proximate the frame and at least one automated masher fixed relative to the carriage proximate the frame. A first sensor is fixed relative to the frame so that when the carriage is proximate to the first sensor, the first sensor detects the workpiece. A drive is in communication with the carriage for moving the carriage with respect to the frame along the longitudinal axis. A control system in operative communication with the carriage, the at least one automated puncher, the at least one automated masher, the drive, and the first sensor has a processor operable in a first mode to move the carriage relative to the at least one automated puncher so that the at least one automated puncher can punch one or more holes in the work piece at a work site and the at least one automated masher can mash rivets located in one or more holes punched at another work site, and second mode following operation of the at least one automated puncher and the at least one automated masher, to move the carriage to a new work site of the sequential work sites responsively to the sensor so that the at least one puncher can punch one or more holes in the workpiece at the new work site.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
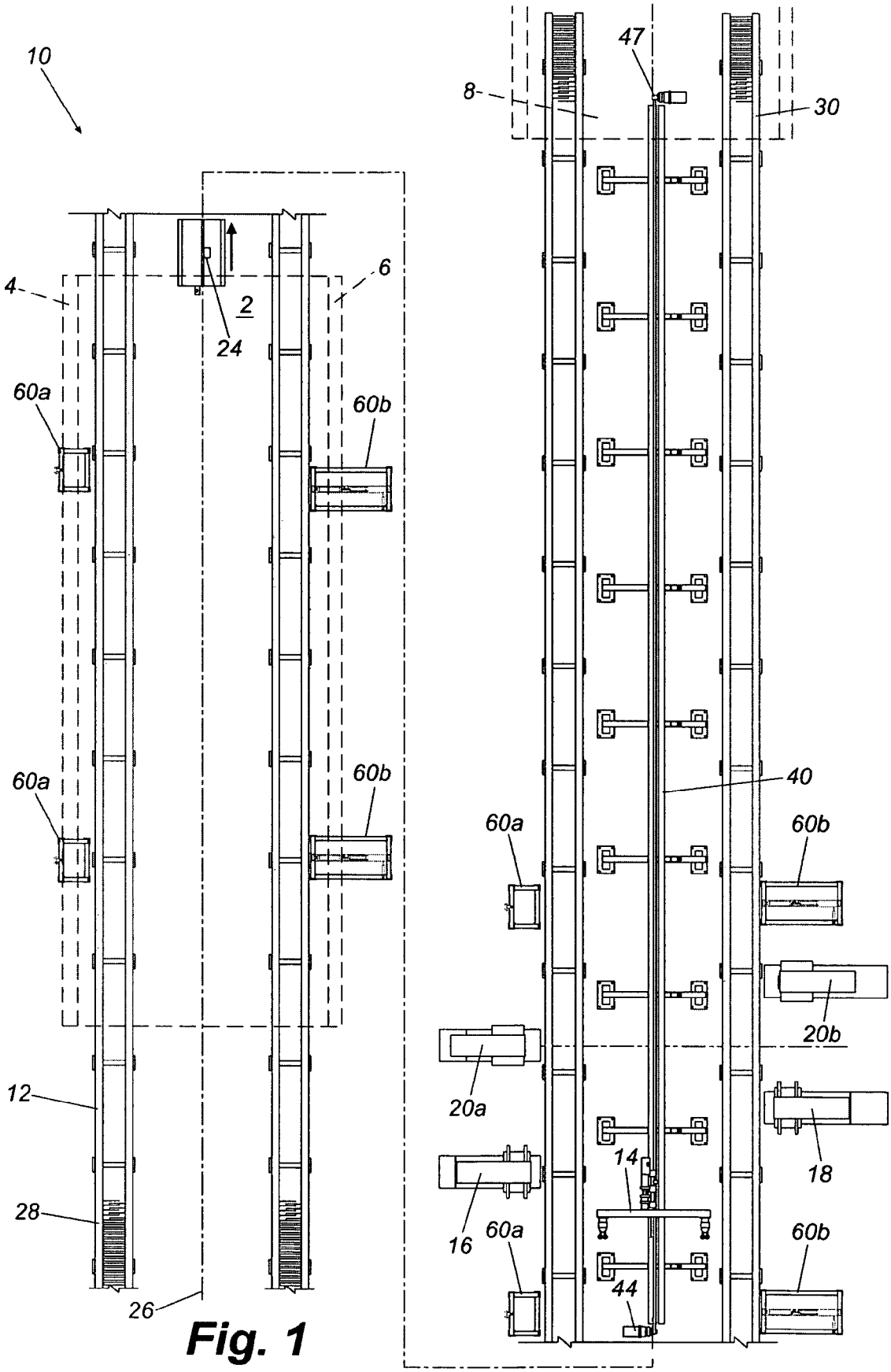
FIG. 1 is a plan view of an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
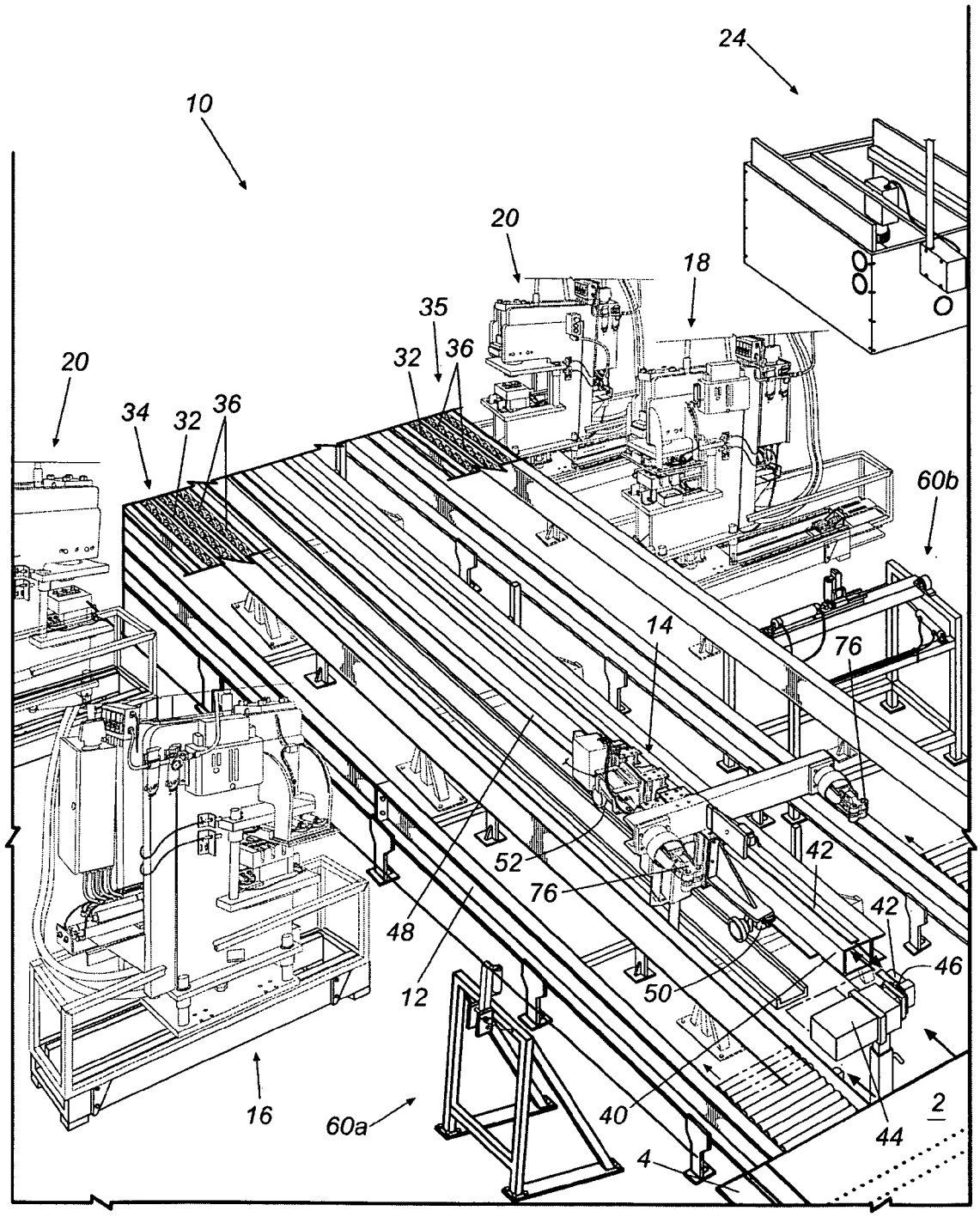
FIG. 2 is a partial perspective view of the automated assembly machine of FIG. 1.

FIGS. 1 and 2 illustrate an automated sidewall assembly machine 10 that receives a sidewall panel 2, a bottom rail 4, and a top rail 6, all shown in phantom on FIG. 1, and automatically fastens all three components together. Assembly machine 10 includes a machine frame 12, a center cart mechanism 14, a bottom rail punching press 16, a top rail punching press 18, a bottom rail riveting press 20*a*, a top rail riveting press 20*b* and an overhead vision system 24.

Frame 12 defines a central longitudinal axis 26 (FIG. 1), a first end 28 where a sidewall panel 2, a bottom rail 4 and a top rail 6 are loaded and a second end 30 where the completed sidewall assembly 8 is removed once the bottom rail and top rail have been securely attached to the sidewall panel. Bottom rail punching press 16 is located on the side of frame 12 that receives the sidewall bottom rail 4, and top rail punching press 18 is located on the side of frame 12 that receives sidewall top rail 6. In one embodiment, top rail punching press 18 is offset from bottom rail punching press 16 by four feet along machine central longitudinal axis 26. Additionally, riveting presses 20*a* and 20*b* are each spaced eight feet apart from a respective punching press 16 and 18 along machine central longitudinal axis 26. As a result, the punching presses are offset from one another on axis by four feet. However, it should be appreciated that the top and bottom rail punching presses may be offset by more or less than four feet, or may not be offset at all, and that the spacing between riveting presses 20*a* and 20*b* and their respective punching presses may be varied as well.

Referring to FIG. 2, a plurality of skates 32 extend along the entire length of frame 12 and are arranged into a first set 34 and a second set 35. Frame 12 supports both skate first set 34, positioned adjacent to the bottom rail receiving side machine of 10, and skate second set 35, positioned adjacent to the top rail receiving side of machine 10. Each skate set comprises three skates 32 arranged in parallel columns. In one embodiment, each skate 32 is approximately 10 feet long and is equipped with rollers 36, which are staggered along the length of skates 32. In this way, the skates provide rolling support for the sidewall assembly as it progresses along the length of automated sidewall assembly machine 10. As shown in FIG. 4B, machine frame 12 supports a plurality of skate lifters 29, comprising a skate cylinder 31 and two skate posts 33. Skate lifters 29 support skates 32 and allows for the lifting or lowering of skate 32, as described more fully below.

Referring again to FIGS. 2 and 3, frame 12 supports a center rail 40, which guides center cart mechanism 14 as it is indexed along the length of rail 40 by a drive belt 42. A belt motor 44, located at the end of center rail 40, rotates an output shaft (not shown) outfitted with a drive pulley 46 that drives belt 42. A follower pulley 47 (FIG. 1) located at the end of center rail 40 proximate to frame second end 30 (FIG. 1) works in conjunction with drive pulley 46 to tension belt 42. Belt 42 may be fixed to center cart mechanism 14 by one or more bolts, rivets, clamps or other suitable hardware. In one embodiment, drive motor 44 is a servo motor, but it should be understood that any suitable type of motor may be used. Also, instead of a belt system, center cart mechanism 14 may be indexed by other means such as a ball screw mechanism, a gear and chain system, a cable and pulley system, or a rack and pinion system. Rail 40 is equipped with an angle iron guide 48 that spans the length of center rail 40 and allows carriage mechanism brake calipers 50 and 52 (FIG. 5) to securely lock carriage mechanism 14 in place when not in motion.

Figure 22A:
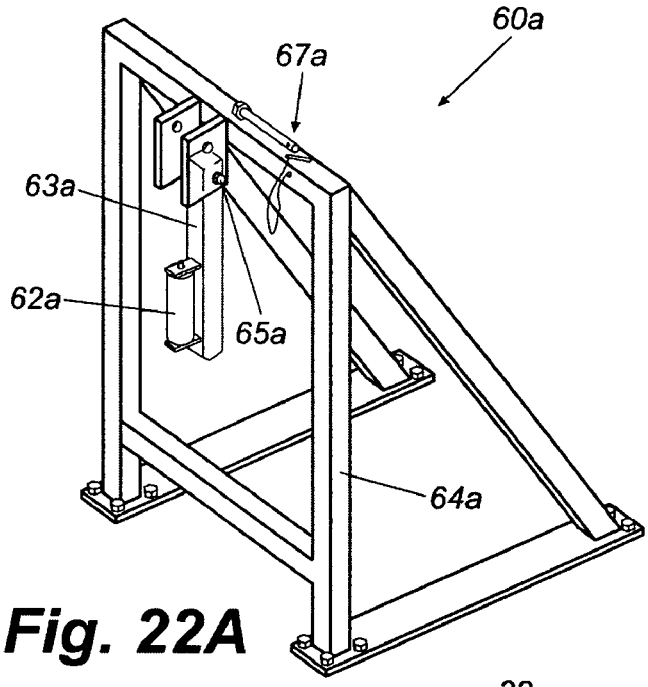
FIGS. 22A and 22B are perspective views of a manual rail guide for use in the automated assembly machine of FIG. 1.
Figure 22B:
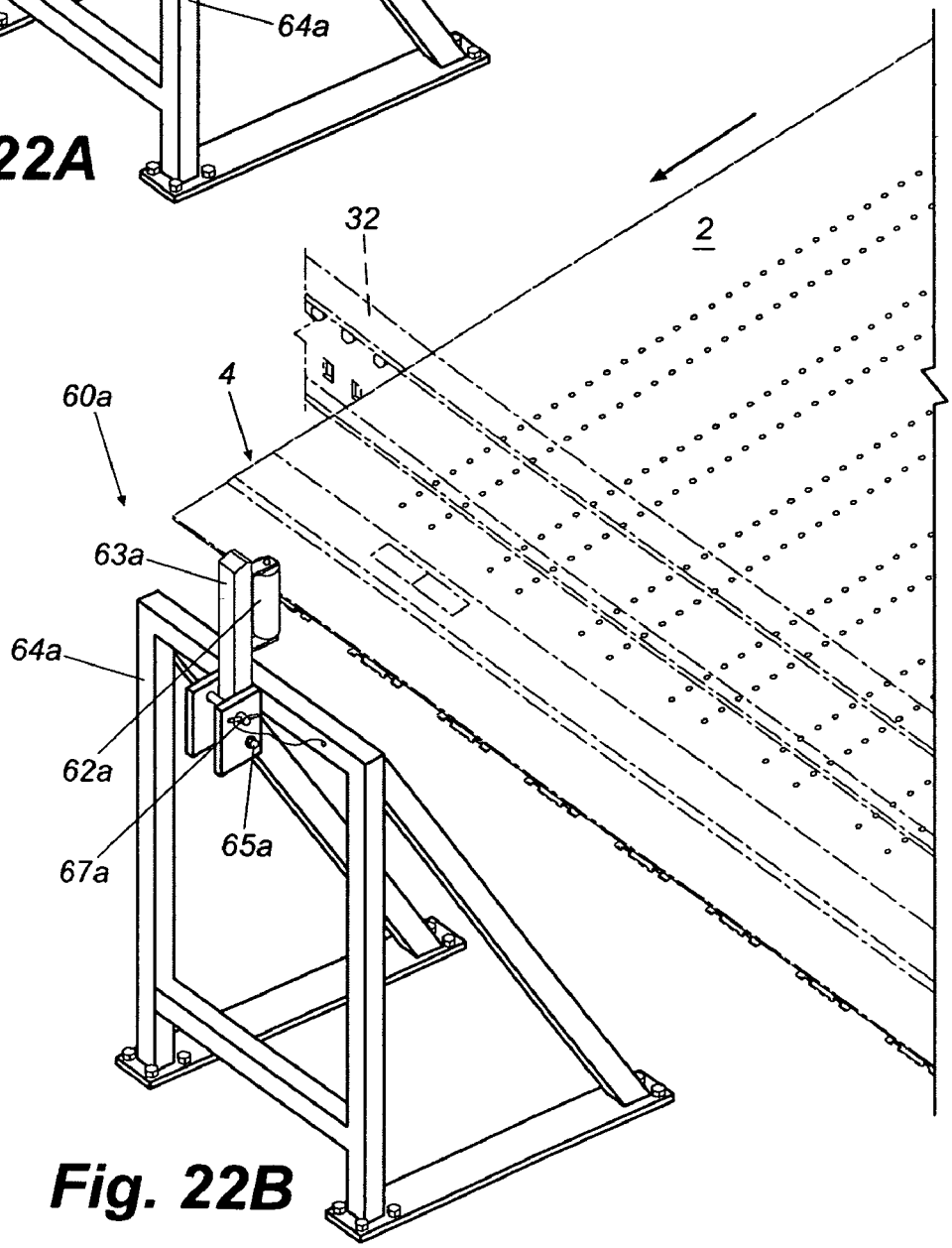

Referring again to FIG. 1, sidewall rail alignment roller assemblies are provided along the sides of machine frame 12 to properly align the sidewall assembly with the punching and riveting presses. In one embodiment, four manually operated alignment rollers assemblies 60*a* are spaced along the bottom rail side of frame 12, and four automatic alignment roller assemblies 60*b* are spaced along top rail side of frame 12. Referring to FIGS. 22A and 22B, each manual roller assembly 60*a* has an alignment roller 62*a*, a roller arm 63*a*, and a support frame 64*a*, which rotatably supports roller arm 63*a* by a pivot pin 65*a*. When not in use, roller 62*a* and roller arm 63*a* hang from pivot pin 65*a* so that roller arm 63*a* does not impede the loading of a sidewall assembly onto assembly machine skate 32. When a sidewall assembly has been loaded, an operator swings roller arm 63*a* up into alignment about pivot pin 65*a* and inserts a locking pin 67*a* into aligned receiving holes (not shown) in roller arm 63*a* and frame 64*a*, as shown in FIG. 22B.

Figure 23A:
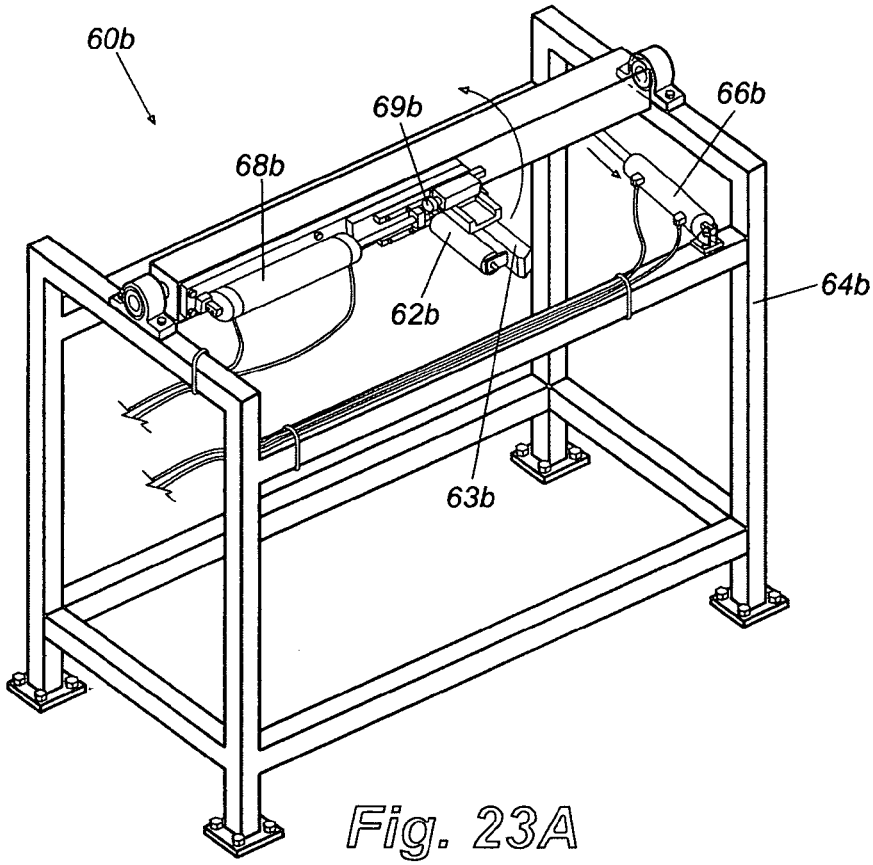
FIGS. 23A-23C are perspective views of an automatic rail guide for use in the automated assembly machine of FIG. 1.
Figure 23B:
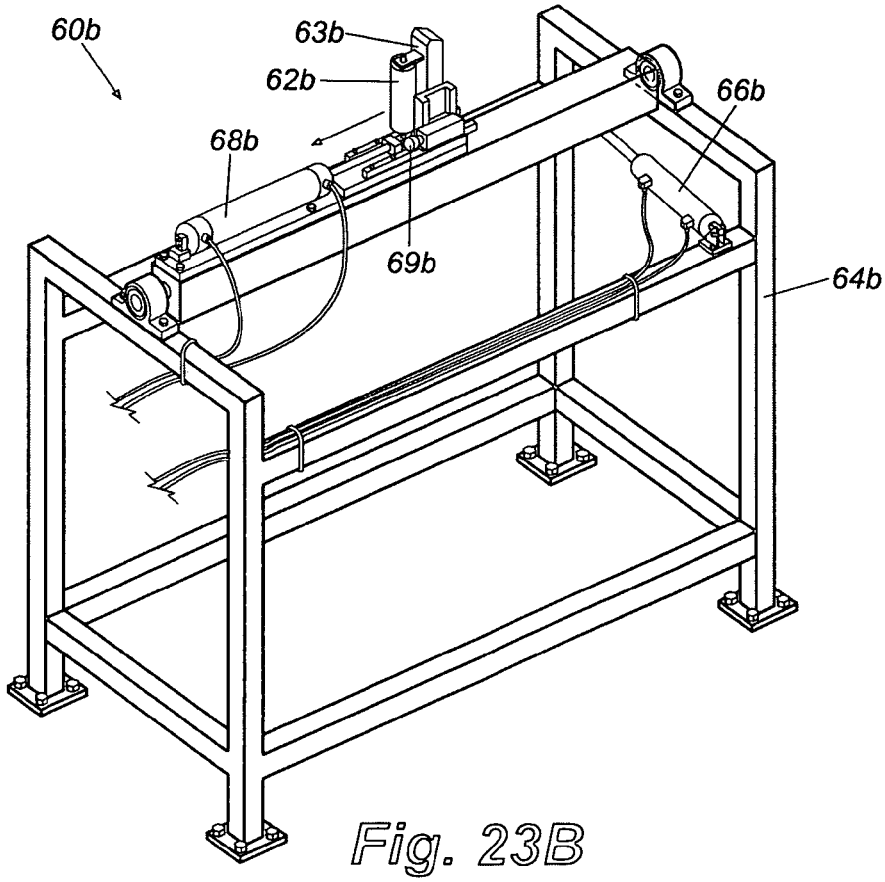
Figure 23C:
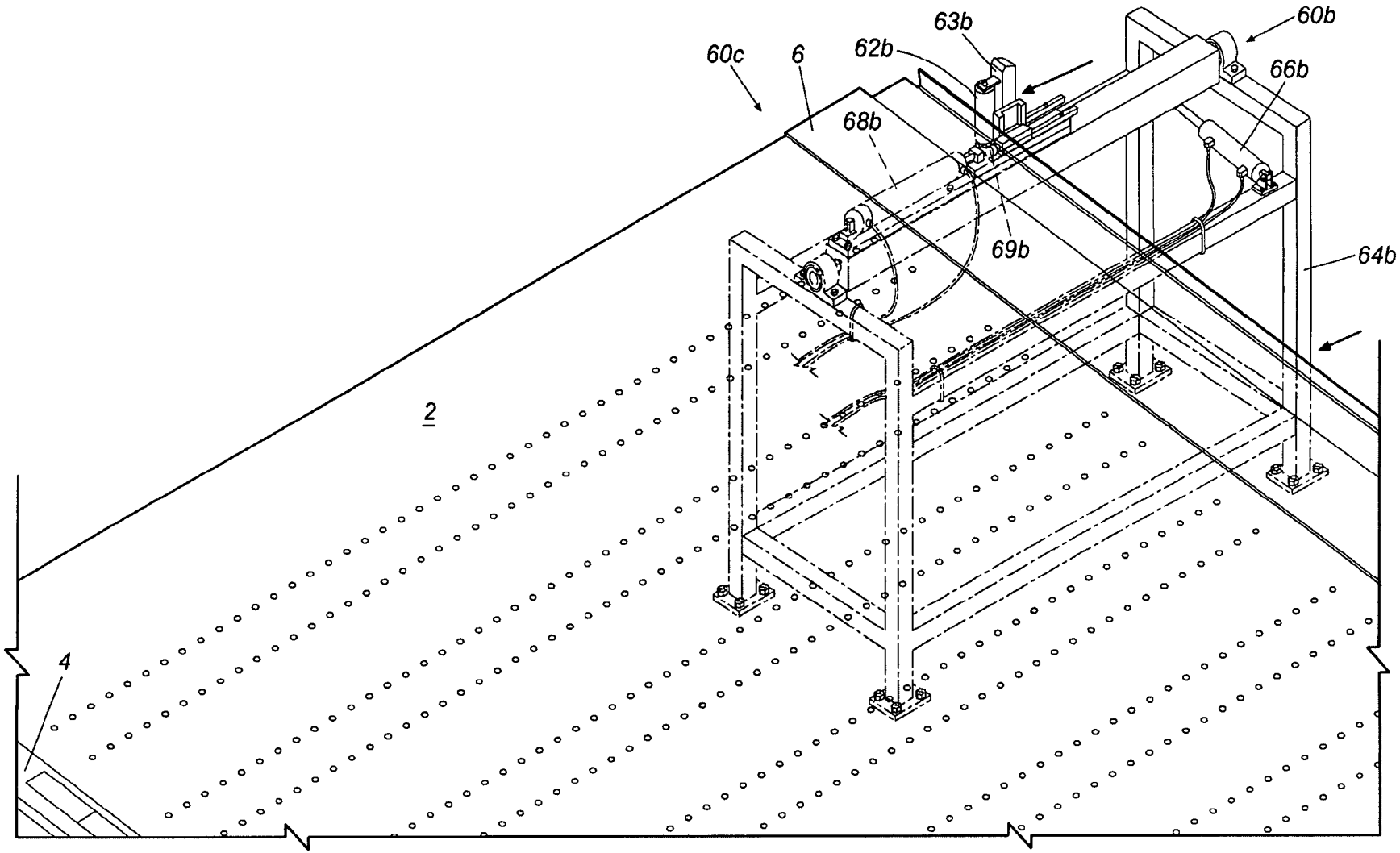

Referring to FIGS. 23A-23C, each automatic roller assembly 60*b* has a roller 62*b*, a roller arm 63*b*, a frame 64*b*, a pneumatic rotating cylinder 66*b*, a pneumatic linear cylinder 68*b* and a rail sensor 69*b*. As previously mentioned, in a preferred embodiment, the automated assembly machine has four manual roller assemblies and four automatic roller assemblies. However, it should be appreciated that any appropriate number of alignment rollers may be employed to keep the wall assembly square with the punching and riveting presses during the assembly process.

Figure 3:
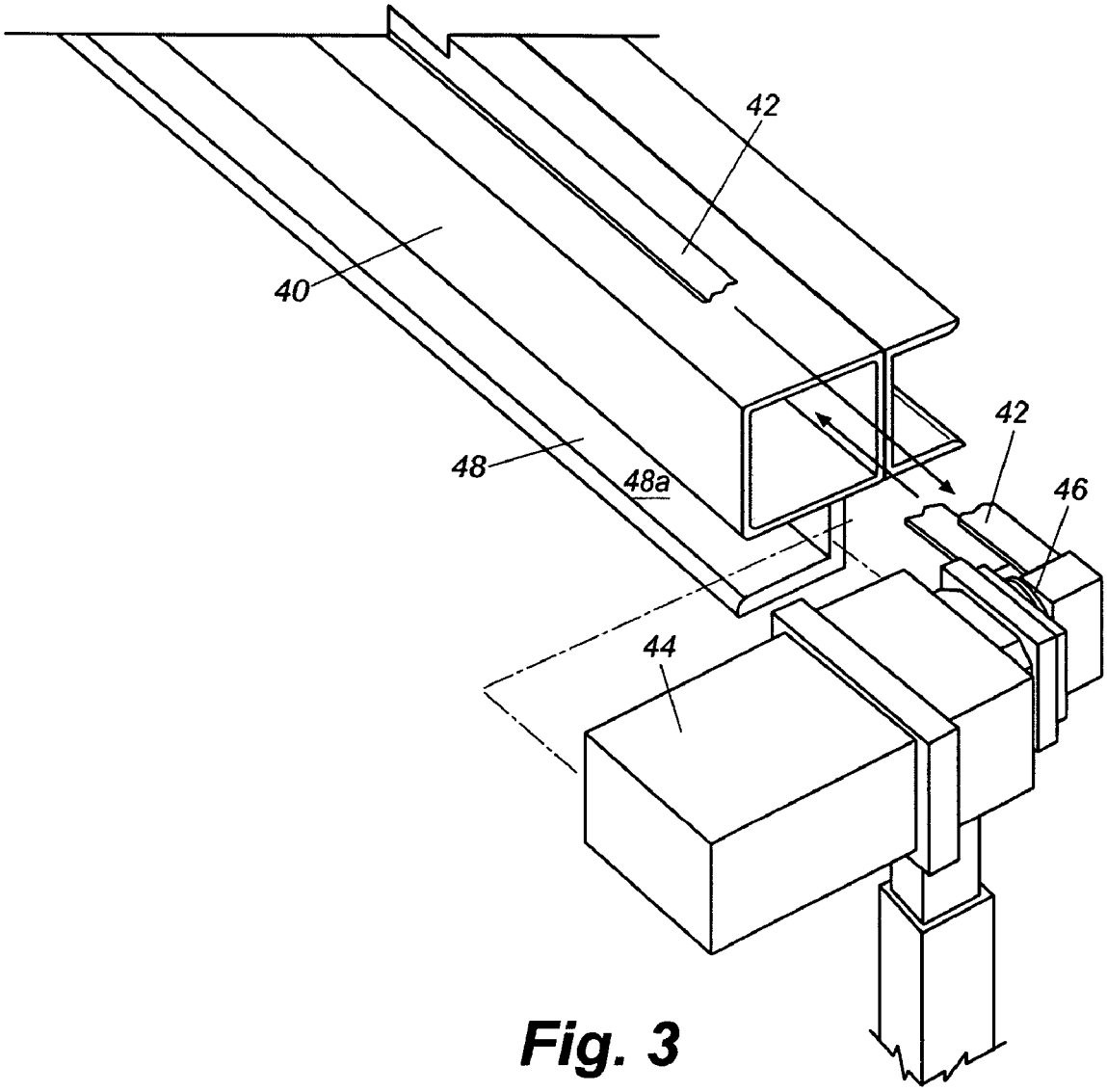
FIG. 3 is a partial perspective view of a rail for use in the automated assembly machine of FIG. 1.
Figure 4A:
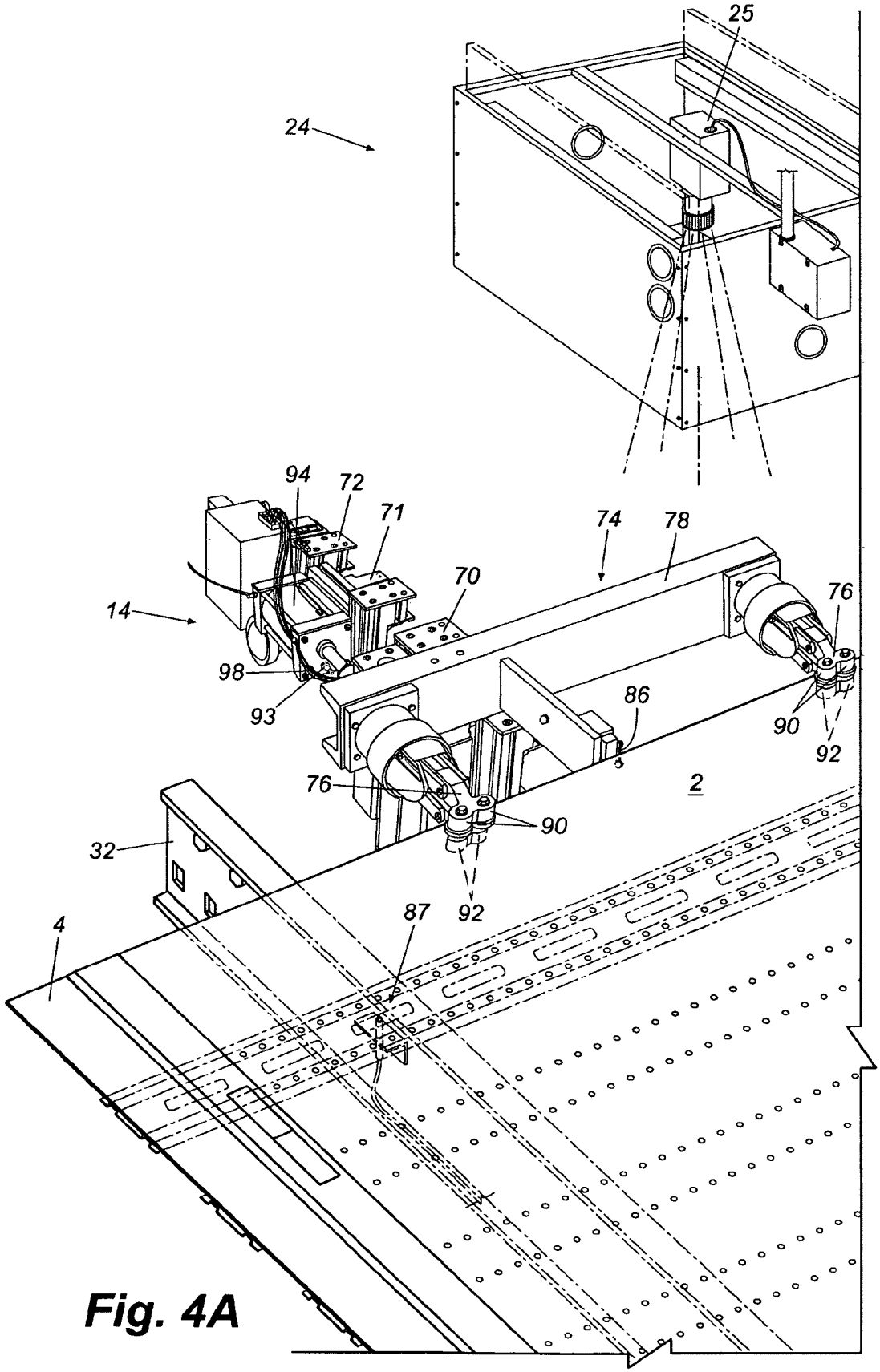
FIG. 4A is a perspective view of a cart assembly and vision system for use in the automated assembly machine of FIG. 1.
Figure 4B:
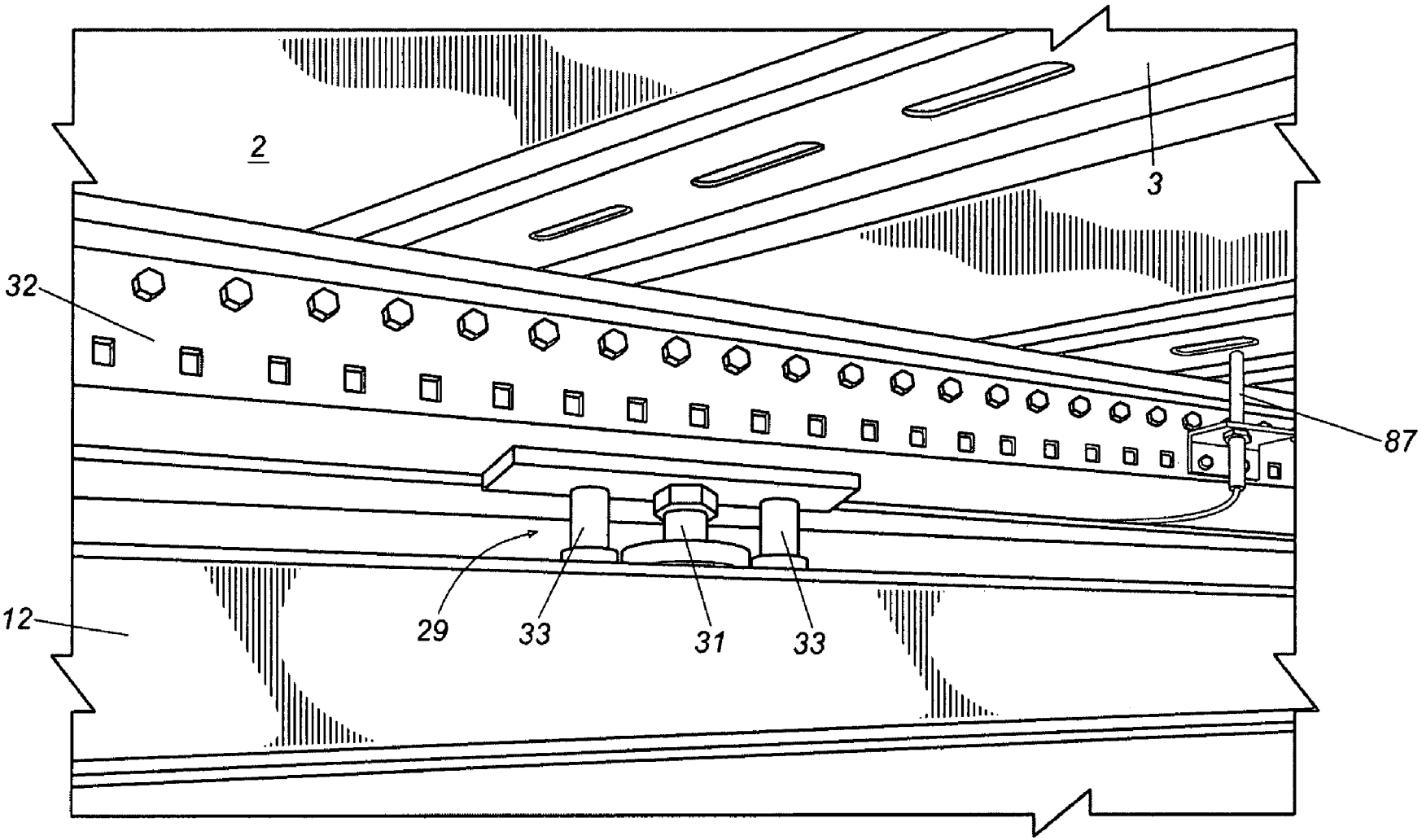
FIG. 4B is a partial perspective view of a frame assembly for use in the automated assembly machine of FIG. 1.
Figure 5:
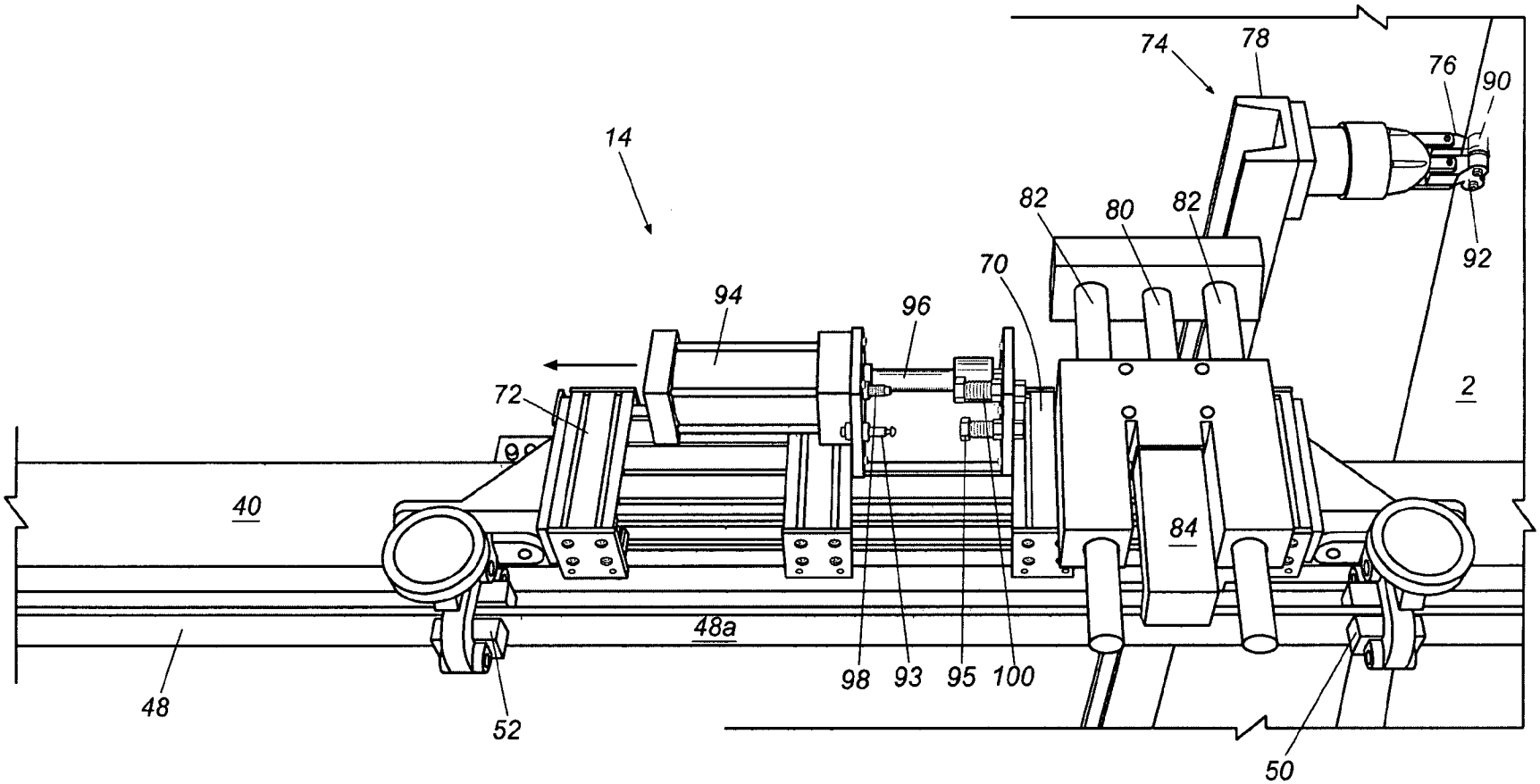
FIG. 5 is a perspective view of the cart assembly and rail of FIGS. 3 and 4A.

Turning to FIGS. 4A and 5, center carriage mechanism 14 is illustrated in a sidewall gripping position. Carriage mechanism 14 includes two carts: a first cart 70 for attaching to and pulling the sidewall assembly, and a second cart 72 attached to drive belt 42 (FIG. 3) that indexes the entire mechanism 14 along center rail 40. Second cart 72 has a belt bracket 71 (FIG. 4A) that supports a belt clamp (not shown) for fixing drive belt 42 to second cart 72. Thus, as drive motor 44 (FIG. 3) indexes the drive belt, the second cart moves. It should, however, be understood that any alternative method of fixing the drive belt to the second cart is contemplated within the scope of the invention.

First cart 70 supports a jaw assembly 74 equipped with a pair of gripper jaws 76 that releasably engage sidewall panel 2. Gripper jaws 76 are supported by jaw assembly support member 78, which is connected to first cart 70 by a cylinder piston rod 80 and two guiding posts 82 (FIG. 5). Thus, when a pneumatic cylinder 84 actuates, piston rod 80 retracts pulling jaw assembly 74 down proximate to center rail 40. In this way, jaw assembly 74 may be lowered beneath the sidewall assembly to facilitate removal of the sidewall at the completion of the riveting process.

Referring in particular to FIG. 4A, gripper jaws 76 are depicted in a closed position that allows center cart mechanism 14 to pull the sidewall assembly as it indexes along the length of rail 40 (FIG. 2). Jaws 76 are normally in an open position to allow sidewall panel 2 to be inserted into the jaws. A toggle switch 86 is mounted onto jaw assembly support member 78 and senses when the sidewall panel has been inserted into the jaws. That is, the position of toggle switch 86 corresponds to whether sidewall panel 2 is in position for gripping by the jaws 76, and therefore the switch sends a signal to a programmable logic control (PLC, not shown). The PLC controls the pneumatic cylinders (not shown) that actuate jaws 76 between a normally open position and a closed gripping position. Jaws 76 are equipped with rubber upper grippers 90 and serrated metal lower grippers 92 to securely hold the sidewall panel during operation. It should be appreciated that the upper and lower grippers may be formed from any other material suitable for securely gripping the sidewall, such as urethane, silicone, alloy, etc.

Referring to FIG. 5, first cart 70 is equipped with a brake caliper 50 that locks onto the horizontal flange 48*a* of angle iron guide 48. When first cart caliper 50 is locked onto guide flange 48*a*, it holds first cart 70 securely in place and resists motion along machine longitudinal axis 26 (FIG. 1). Second cart 72 supports a horizontally-mounted pneumatic cylinder 94 that is connected to a first cart 70 by a piston rod 96. Cylinder piston rod 96 pulls first cart 70 towards second cart 72 after each indexing move performed by second cart 72. Second cart 72 is also equipped with a brake caliper 52 that locks onto horizontal flange 48*a*. As a result, when second cart caliper 52 locks onto guide 48, caliper 52 holds second cart 72 securely in place while cylinder 94 actuates to retract piston rod 96 and pulls first cart 70 towards second cart 72, as described in detail below.

Second cart 72 is equipped with a shock absorber 93 that engages with a corresponding bolt 95 mounted on the first cart. When cylinder 94 retracts piston rod 96 far enough for bolt 95 to contact shock absorber 93, the shock absorber retards further motion of first cart 70 towards second cart 72 and prevents the carts from crashing into each other. A proximity switch 98 on the end of second cart 72 senses a proximity switch flag 100 attached to first cart 70. In a preferred embodiment, flag 100 is a bolt, but it should be understood that a cap screw, bracket or any similar hardware made of a ferrous material may be used. Thus, when proximity switch 98 senses flag 100, a signal is relayed to a PLC (not shown) to discontinue the actuation of pneumatic cylinder 94 and first cart 70 comes to a stop. In this manner, shock absorber 93 slows the progress of first cart 70 until proximity switch 98 senses flag 100, at which time a signal is sent to the PLC to stop the actuation of cylinder 94.

Figure 6:
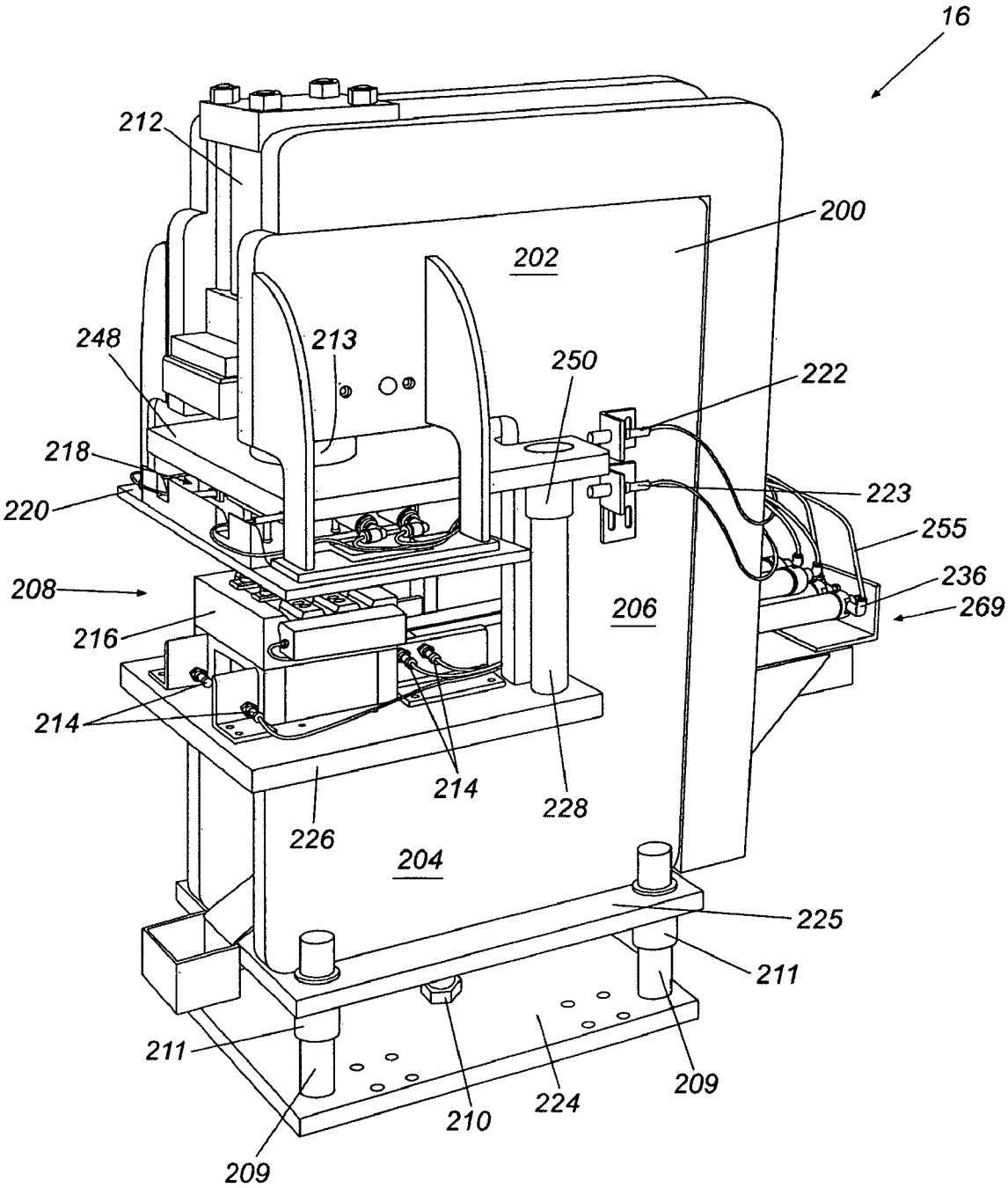
FIG. 6 is a perspective view of a bottom rail punching press for use in the automated assembly machine of FIG. 1.
Figure 7:
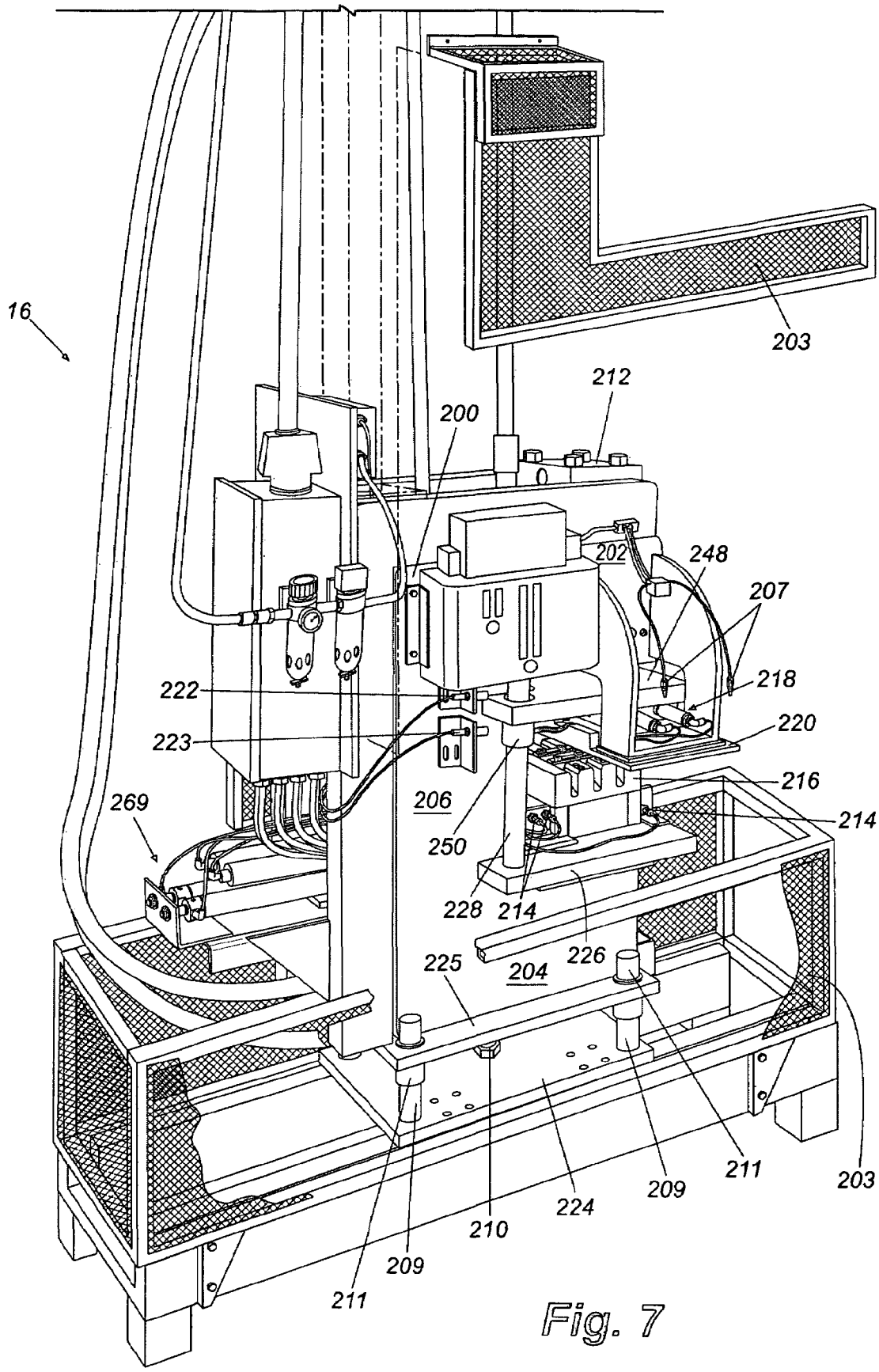
FIG. 7 is a reverse perspective view of the bottom rail punching press of FIG. 6.

Referring to FIGS. 6 and 7, bottom rail punching press 16 is shown having a C-shaped body 200 with an upper portion 202, a lower portion 204, a vertical portion 206, and a punching area generally denoted by 208 (FIG. 6). Bottom rail punching press 16 is also equipped with a lift cylinder 210, a punch cylinder 212, bottom gag proximity switches generally denoted by 214, a bottom die 216, a top die assembly 218, a separating mat 220, a top die upper proximity switch 223, a top die lower proximity switch 222, and safety guarding 203 (FIG. 7). Lift cylinder 210 is positioned between a lift cylinder anchor bracket 224 and a lift cylinder body bracket 225. Four lift guide posts 209, mounted to anchor bracket 224, are received by four respective bushings 211, coupled to body bracket 225, to provide alignment and support between the anchor bracket and the body bracket. Bushings 211 slide along posts 209 as lift cylinder 210 actuates to raise and lower C-shaped body 200 relative to machine frame 12 (FIG. 2).

Figure 8:
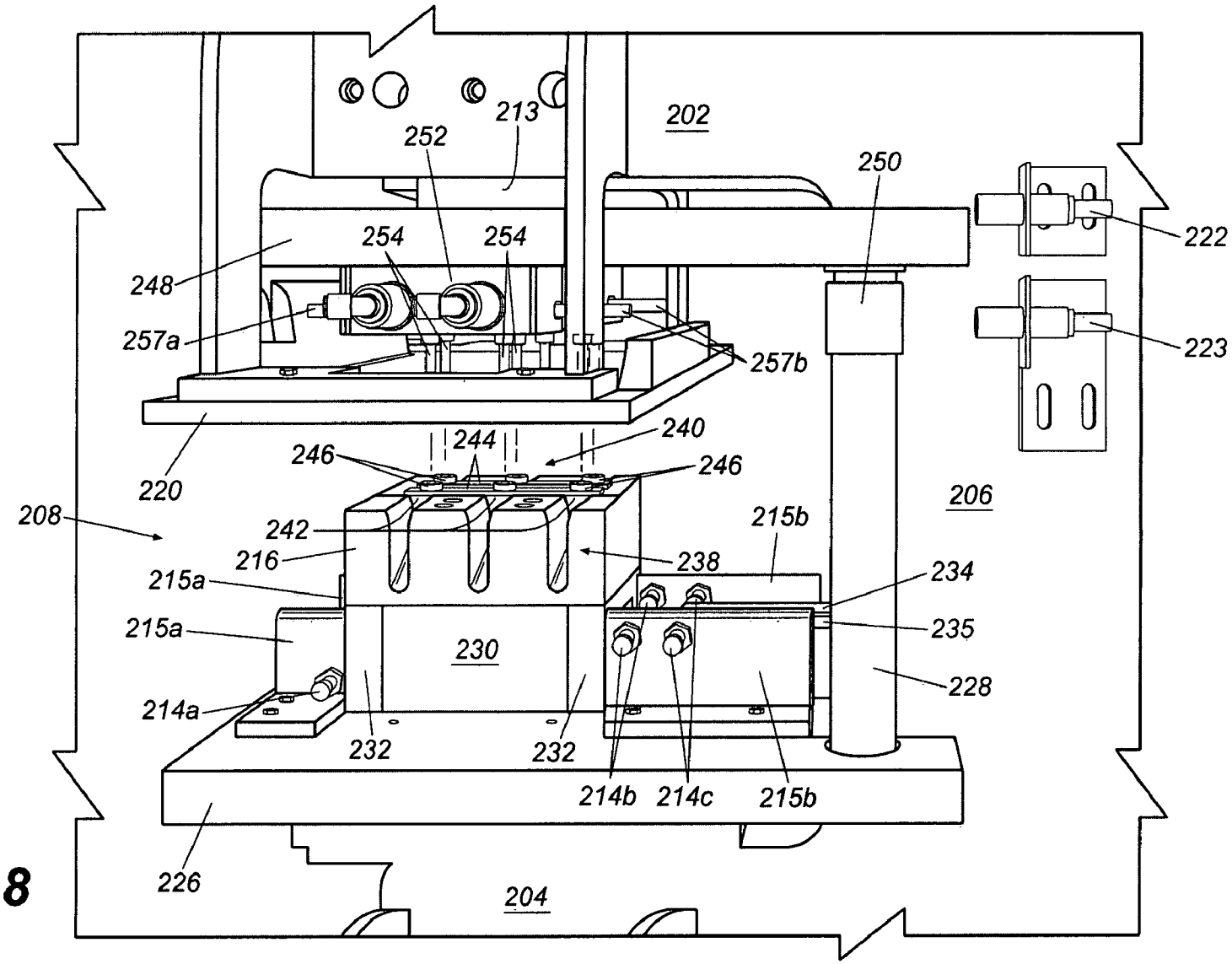
FIG. 8 is a perspective view of the punching area of the bottom rail punching press of FIG. 6.
Figure 9:
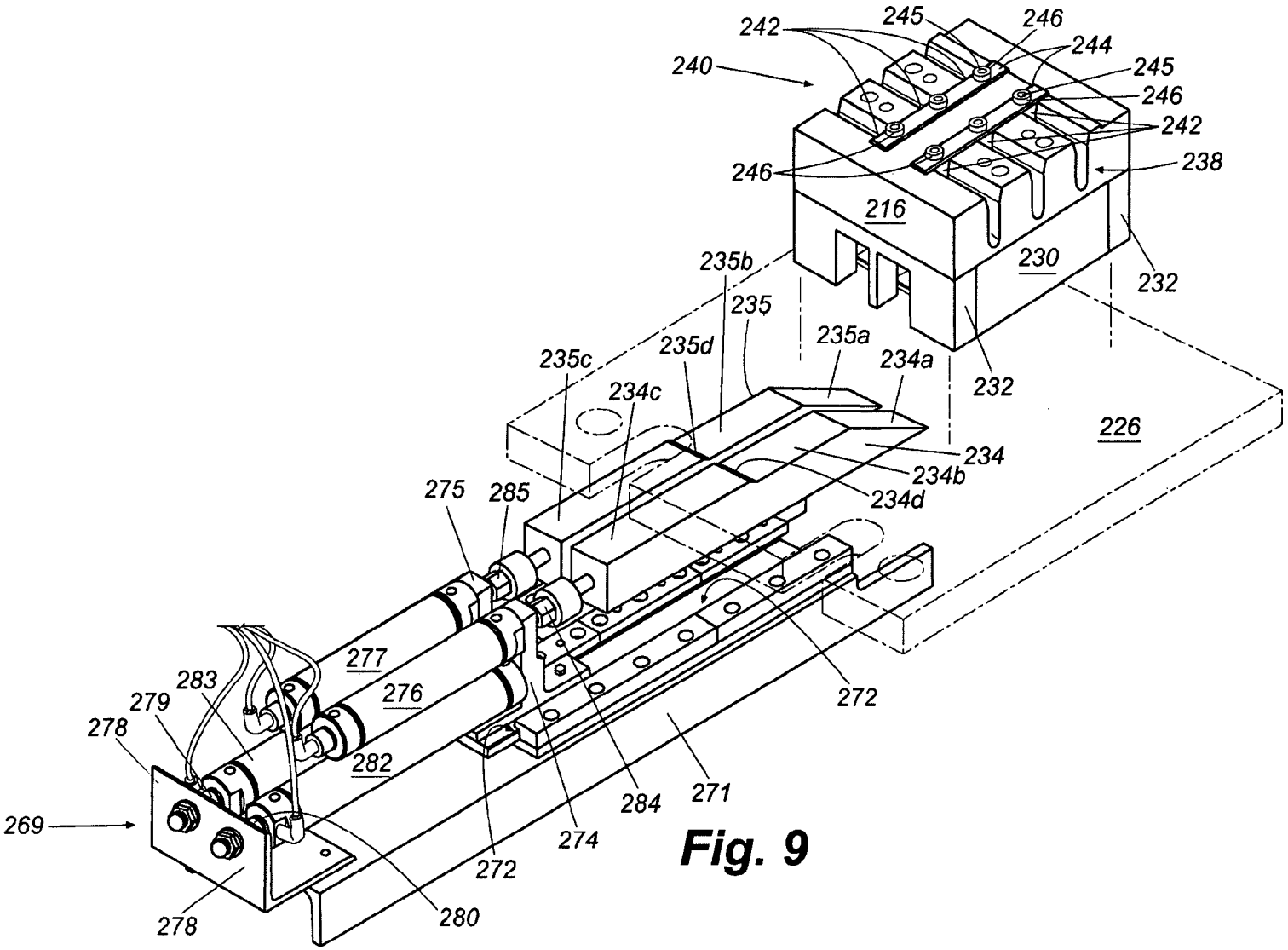
FIG. 9 is a perspective view of a gag assembly for use in the bottom rail press of FIG. 6.

Referring to FIGS. 8 and 9, bottom die 216 connects to punch body lower portion 204 (FIG. 8) by a bottom die shoe 226 that rigidly supports two die posts 228 (FIGS. 6 and 7), a lower rail punch spacer 230, a pair of gag guides 232 and a pair of gags 234 and 235. Referring to FIG. 8, bottom die shoe 226 also supports two front proximity switch brackets 215*a* and two rear proximity switch brackets 215*b*. Each front proximity switch bracket 215*a* supports a front proximity switch 214*a*, while each rear proximity switch bracket 215*b* supports both an intermediate proximity switch 214*b* and a rear proximity switch 214*c*. The operation of the proximity switches 214*a*, 214*b*, and 214*c* will be described in detail below.

Referring to FIG. 9, gags 234 and 235 are positioned parallel to each other and are slidably received by gag guides 232. Each gag 234 and 235 defines a respective (1) sloped leading edge 234*a* and 235*a*, (2) first stage surface 234*b* and 235*b*, (3) second stage surface 234*c* and 235*c*, and (4) sloped transition surface 234*d* and 235*d* intermediate the first and second stage surfaces. Gag 234 slides into gag guides 232 when cylinders 276 and/or 282 actuate, while gag 235 slides into gag guides 232 when cylinders 277 and/or 283 actuate. Gag cylinders 276, 277, 282, and 283 are situated in a gag cylinder bank 269 in a stacked arrangement that is rigidly supported by a gag cylinder bank bracket 271. Gag cylinder bank bracket 271 attaches to both C-shaped body vertical portion 206 (FIGS. 6 and 7) and to bottom die shoe 226 (shown in phantom in FIG. 9). Bracket 271 defines two guideways 272 that slidably receive two cylinder sliders 274 and 275. Lower gag cylinders 282 and 283 connect to a rear cylinder support 278 and to sliders 274 and 275, respectively. Thus, gag cylinders 276 and 277 can actuate to move gags 234 and 235, respectively, into gag guides 232 a predefined distance, after which lower gag cylinders 282 and 283 can actuate to extend piston rods 279 and 280 forward. This additional movement in turns extends gags 234 and 235, respectively, into gag guides 232 an additional predetermined distance for punching field holes.

Punch spacers 230 and gag guides 232 support bottom die 216, which defines six slots arranged into a first set 238 of three slots and a second set 240 of three slots. All slots in a single set are parallel to each other, and the slots are arranged so that each slot in one set is aligned with and parallel to a respective slot of the second set. Each slot extends inwardly from one of two opposite outer sides of bottom die 216 toward the bottom die's center, and each slot slopes downwardly from the die's center to a slot open end. First slots 238 do not communicate with second slots 240, but rather terminate to define inner ends 242.

Figure 26A:
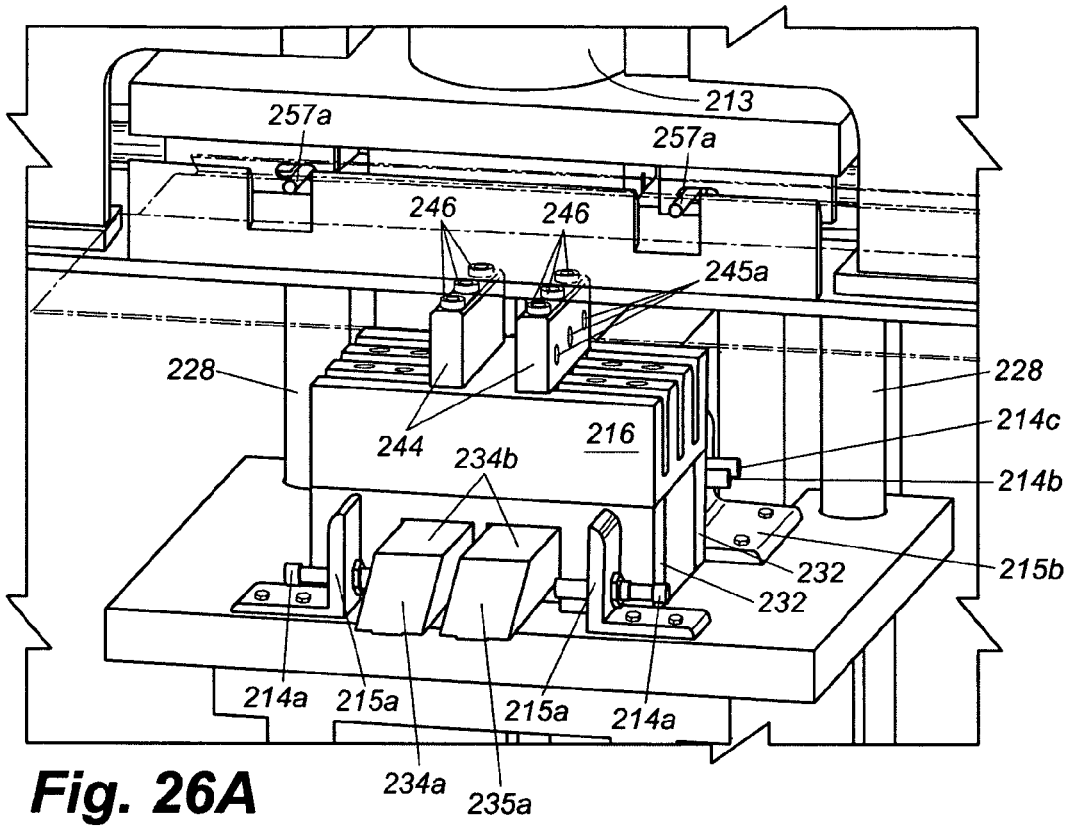
FIG. 26A is a perspective view of the top rail punch assembly of FIG. 11.
Figure 26B:
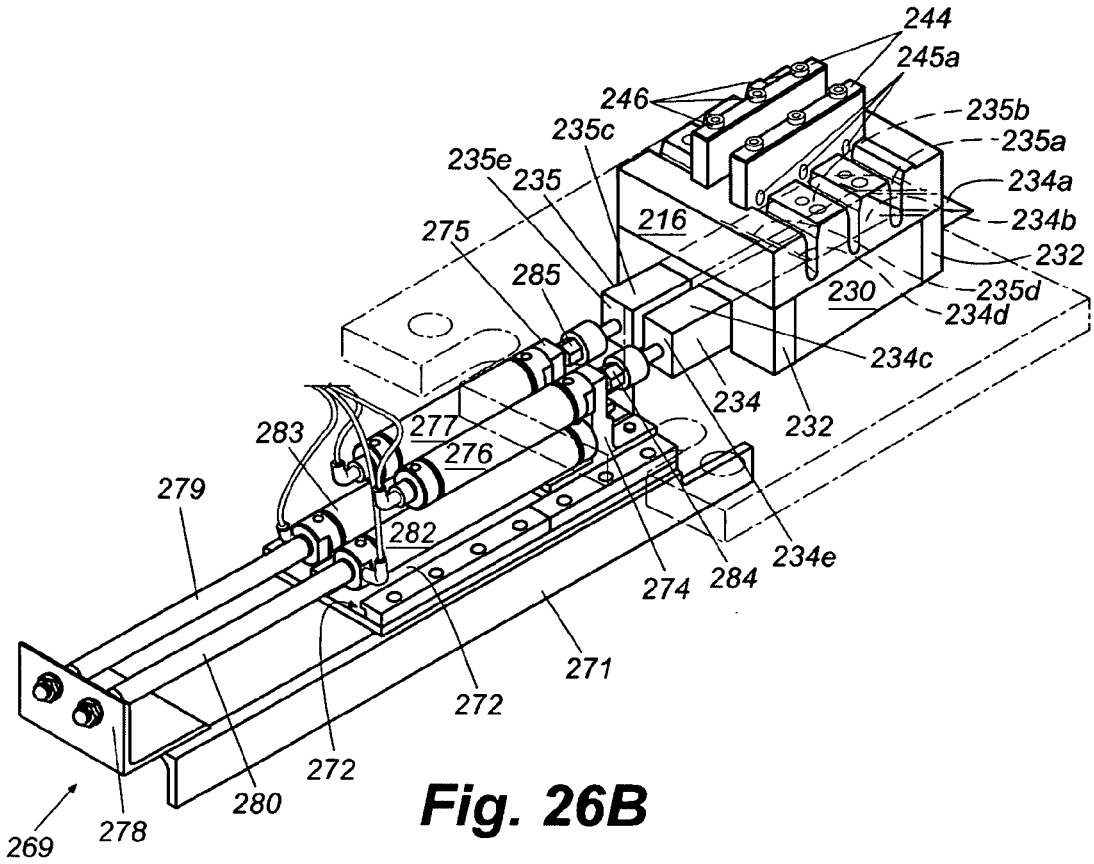
FIG. 26B is a perspective view of the gag assembly of FIG. 14 shown in a position corresponding to the top rail punch assembly of FIG. 26A.

Bottom die 216 also slidably receives two rail punches 244, which are positioned perpendicular to the longitudinal axes of the slots and proximate to slot inner ends 242. Each rail punch 244 supports three die buttons 246 having a central bore 245 in communication with a respective exit portal 245*a* (FIGS. 26A and 26B). Thus, the material punched out of the sidewall panel assembly during the punching process exits the punch through die button central bore 245 out of exit portal 245*a* and out one of the two slot sets 238 and 240. In this way, the refuse material slides out of the bottom of die press 216, which prevents the machine from becoming jammed.

Figure 10:
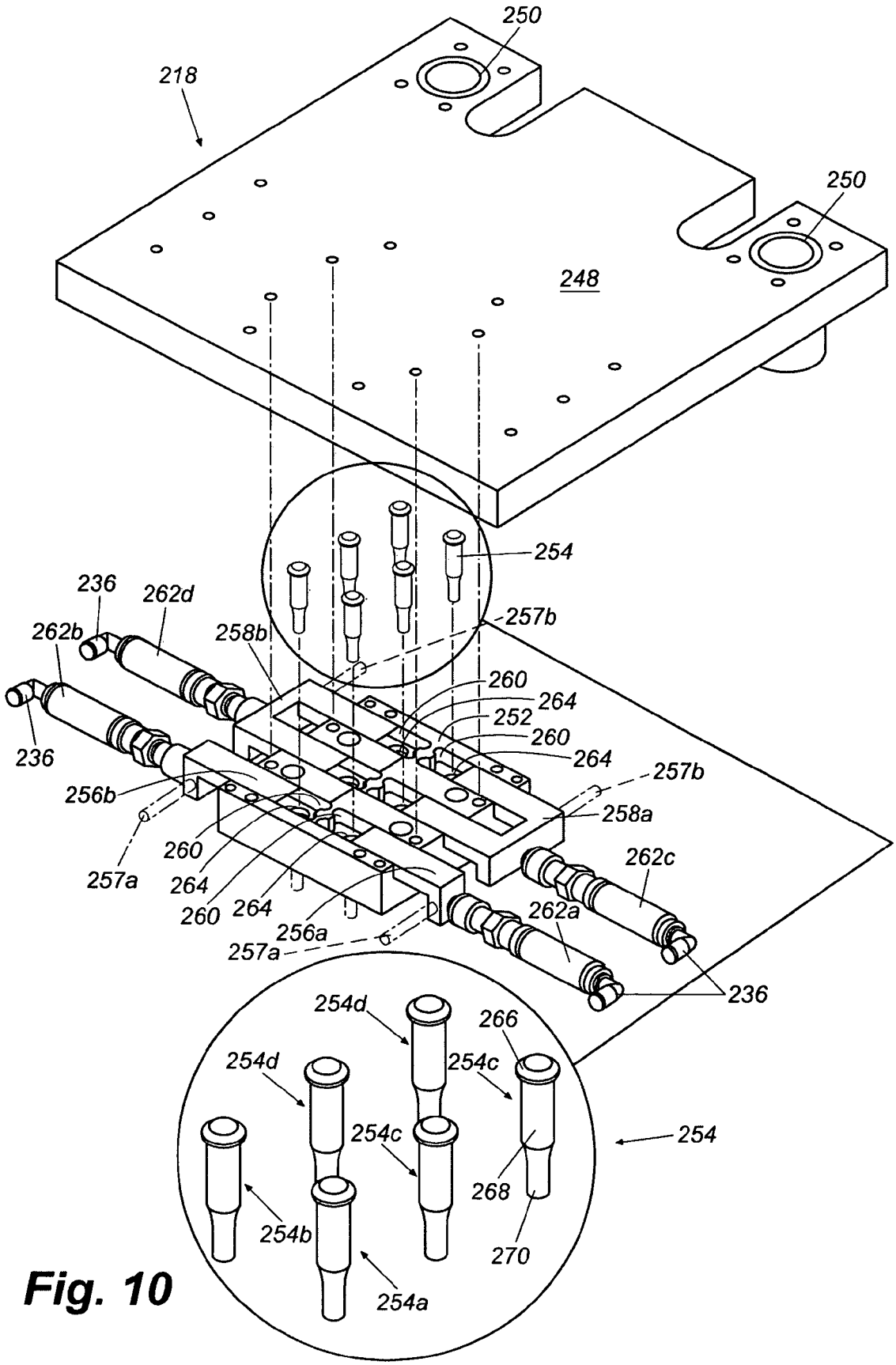
FIG. 10 is a perspective view of a punch assembly for use in the bottom rail press of FIG. 6.

Referring to FIG. 10, top die assembly 218 comprises a bottom rail punch retainer 252, six punches 254, two field gags 256*a* and 256*b* and two post gags 258*a* and 258*b*. Bottom rail punch retainer 252 may be secured to top die shoe 248 by screws, bolts, or any other suitable fastener and defines six gag slots 260, each of which slidably receives a field or post gag. Gag cylinders 262*a* and 262*b* drive field gags 256*a* and 256*b* into their respective slots while cylinders 262*c* and 262*d* drive post gags 258*a* and 258*b* into their respective slots. In one embodiment, the gag cylinders may be pneumatic cylinders powered by air hoses 255 (FIG. 6) connected to air valves 236.

Gag slots 260 are arranged in two sets of three parallel slots, and an inner end of each gag slot defines a vertical, counterbored through-hole 264 that slidably receives a respective punch 254. Punches 254 each have a flange 266, a shank 268, and a tip 270. Each through-hole 264 slidably receives a punch shank 268 so that punch flange 266 rests in the counterbore (not shown) of through-hole 264. Field gags 256*a* and 265*b* and post gags 258*a* and 258*b* are slidably positioned in the gag slots so that when gag cylinders 262*a*-262*d* actuate, the gags are biased into the gag slots and restrain punch flanges 266 to prevent the punches from sliding upward in through-holes 264 when punch tips 270 contact the sidewall assembly.

Four proximity switches 257*a* and 257*b* (shown in phantom) are attached by respective brackets (not shown) to top die shoe 248 and sense the rear portion of gags 256*a*, 256*b*, 258*a* and 258*b*, respectively, when the gags are retracted from their respective slots. Once gag cylinders 262*a*-262*d* bias the gags into their corresponding gag slots 260, proximity switches 257*a* and/or 257*b* no longer sense the rear portion of the gags, and the proximity switches send a signal to a PLC (not shown) indicating that the gags are in a punching position. Punch cylinder 212 (FIG. 8) may actuate causing top die assembly 218 to slide downward, into a hole-punching stroke.

Field gags 256*a* and 256*b* are single gags that restrain only one punch each, but post gags 258*a* and 258*b* are U-shaped and, therefore, simultaneously restrain two punches each. In this configuration, post gag 258*a* restrains post punches 254*c*, while post gag 258*b* restrains post punches 254*d*. This arrangement provides an added advantage of requiring only two post gag cylinders 262 for four punches. It should be understood though that any number of alternative arrangements, including six gags with corresponding cylinders, may be used to restrain the punches in accordance with the present invention.

Referring again to FIGS. 6 and 7, bottom rail top die assembly 218 attaches to punching press upper portion 202 by punch cylinder 212. Top die assembly 218 is rigidly attached to a piston rod 213 (FIG. 6) of cylinder 212 by top die shoe 248. Top die shoe 248 is equipped with two bushings 250 that ride about die posts 228. Consequently, as piston rod 213 extends, top die assembly 218 lowers towards bottom die 216 along die posts 228.

Punch cylinder 212 is a hydraulic cylinder that actuates to either push piston rod 213 vertically downward or pull piston rod 213 vertically upward. During punching, hydraulic oil is forced into an upper chamber (not shown) of punch cylinder 212, and the pressure exerted upon piston rod 213 by the hydraulic oil forces the piston rod downward until the piston rod is fully extended. When the piston rod fully extends, top die assembly 218 lowers toward bottom die assembly 216, and punches 254 (FIG. 10) restrained by their respective gags punch holes in the sidewall assembly. Once the holes are punched in the sidewall assembly, hydraulic oil is forced out of the upper chamber (not shown) and into a lower chamber (not shown) of cylinder 212. The pressure exerted upon the piston rod by the hydraulic oil forces piston rod 213 to retract and raise top die shoe 248 vertically upward towards punching press upper portion 202.

Figure 11:
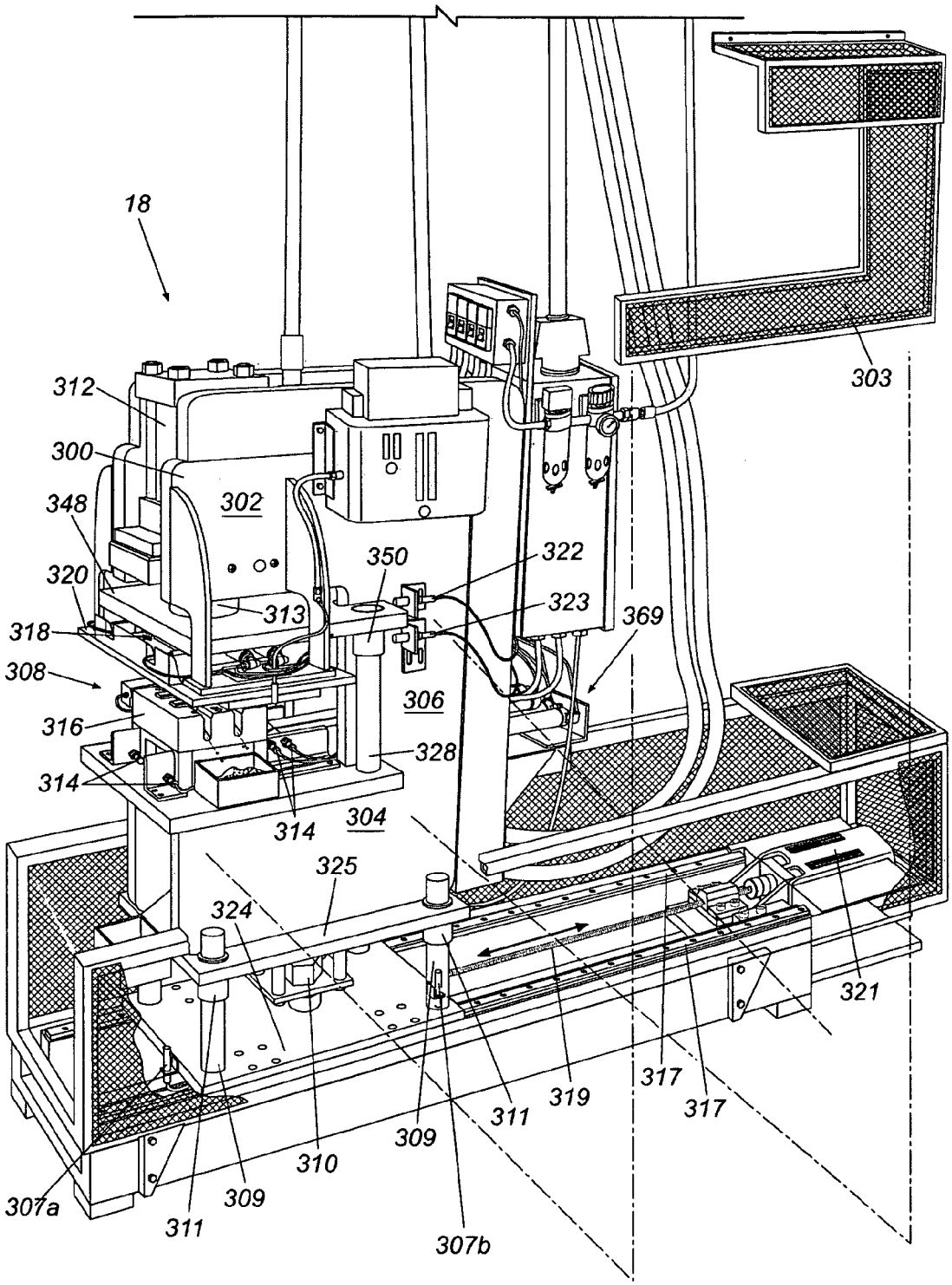
FIG. 11 is a perspective view of a top rail punching press for use in the automated assembly machine of FIG. 1.
Figure 12:
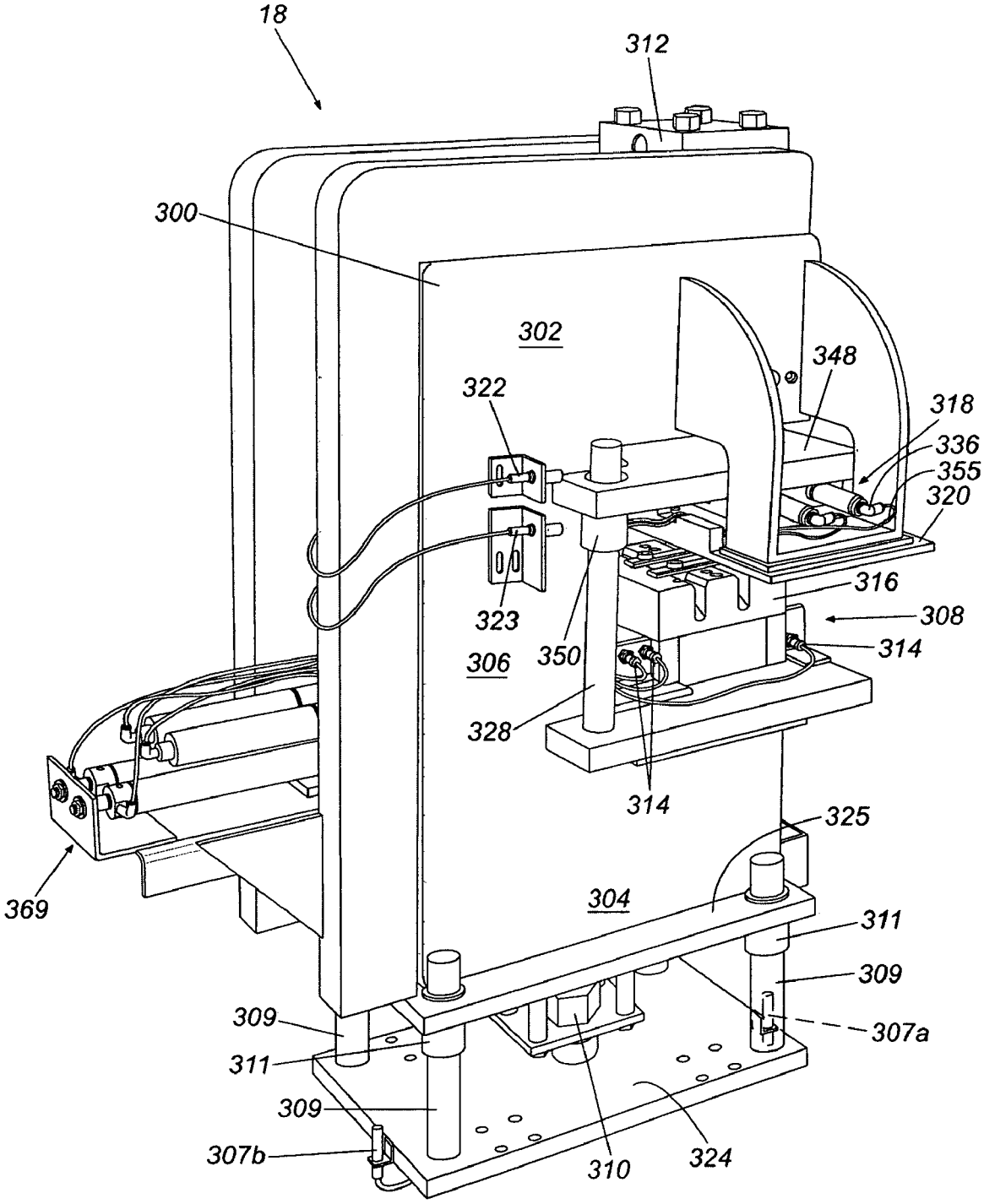
FIG. 12 is a reverse perspective view of the top rail punching press of FIG. 11.

Referring to FIGS. 11-12, a top rail punching press 18 utilizes many identical or similar components as bottom rail punching press 16 and function in a nearly identical manner. However, a complete description of a preferred embodiment of the top rail punching press is provided herein. Top rail punching press 18 has a C-shaped body 300 with an upper portion 302, a lower portion 304, a vertical portion 306, and a punching area 308. The top rail punching press is also equipped with a lift cylinder 310, a punch cylinder 312, gag proximity switches generally denoted by 314, a bottom die 316, a top die assembly 318, a separating mat 320, a top die upper proximity switch 322, a top die lower proximity switch 323, and safety guarding 303 (FIG. 11). Lift cylinder 310 is positioned between a lift cylinder anchor bracket 324 and a lift cylinder body bracket 325. Four lift guide posts 309, mounted to anchor bracket 324, are received by four respective bushings 311, coupled to body bracket 325, to provide alignment and support between the anchor bracket and the body bracket. Bushings 311 slide along posts 309 as lift cylinder 310 actuates to raise and lower C-shaped body 300 relative to machine frame 12 (FIG. 2).

Referring particularly to FIG. 11, lift cylinder bracket 324 is slidably attached to two rails 317 and is moveable along the rails by a ball nut (not shown) driven by a drive screw 319 that is rotatably attached to a drive motor 321. When motor 321 rotates drive screw 319, the ball nut (not shown) advances along the drive screw thereby moving top rail punch press 18 linearly transverse to machine longitudinal axis 26 (FIG. 1). This allows for the adjustment of the position of punching press 18 with respect to machine central longitudinal axis 26 (FIG. 1). A front proximity switch 307*a* and a rear proximity switch 307*b* are affixed to lift cylinder bracket 324 to accurately position punch press 18. When drive screw 319 has advanced punch press 18 to a punching position proximate to the machine longitudinal axis, front proximity switch 307*a* senses a flag (not shown) and drive screw drive motor 321 stops rotating drive shaft 319. In this way, punch press 18 is properly positioned for punching. Once the last holes have been punched in the sidewall assembly, drive motor 321 rotates drive shaft 319 in an opposite direction, and punch press 18 is advanced to a home position distal from the machine longitudinal axis. When punch press 18 reaches its home position, rear proximity sensor 307*b* senses a flag (not shown) and the drive screw motor stops rotating the drive shaft.

Figure 13:
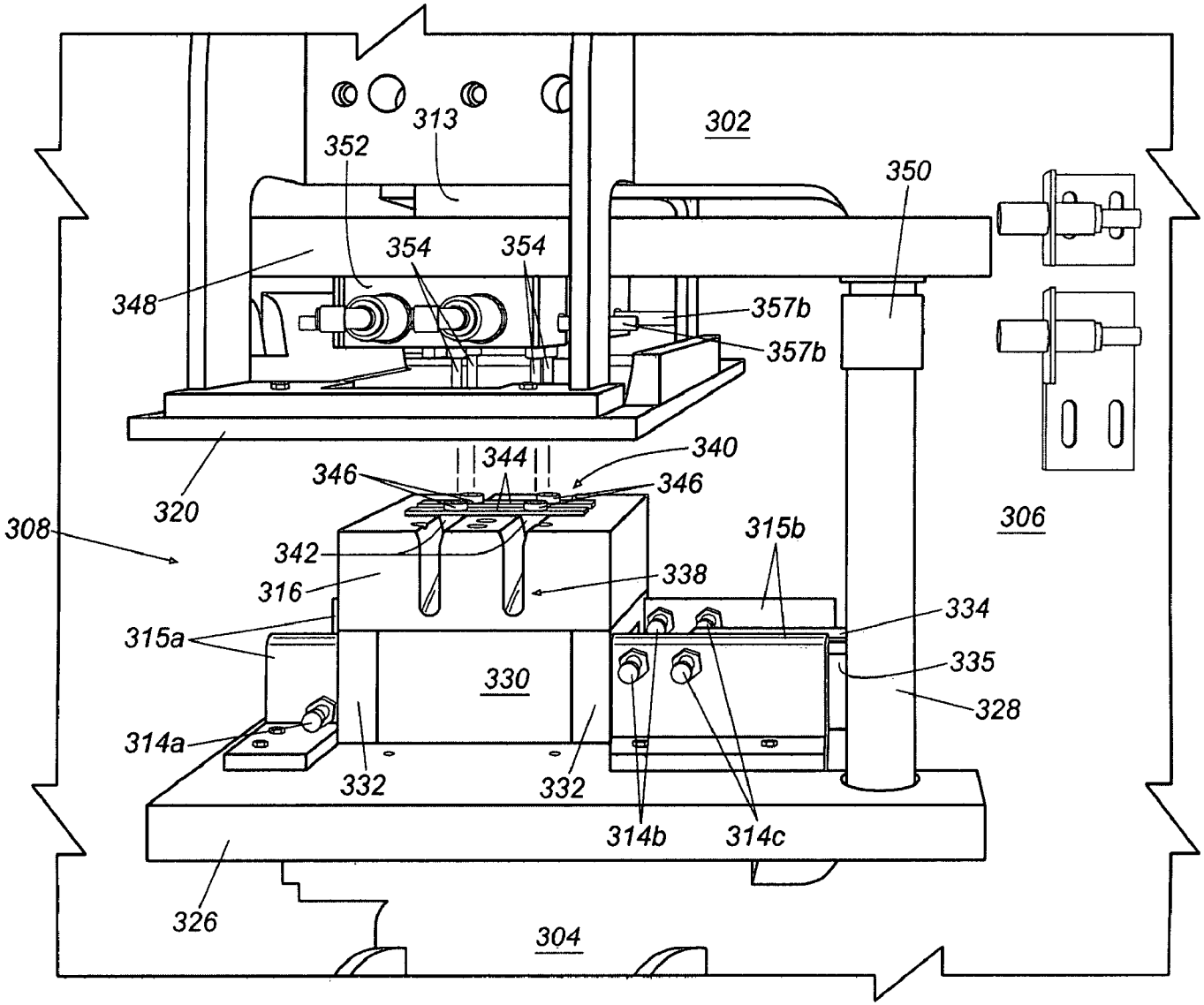
FIG. 13 is a perspective view of the punching area of the top rail punching press of FIG. 11.
Figure 14:
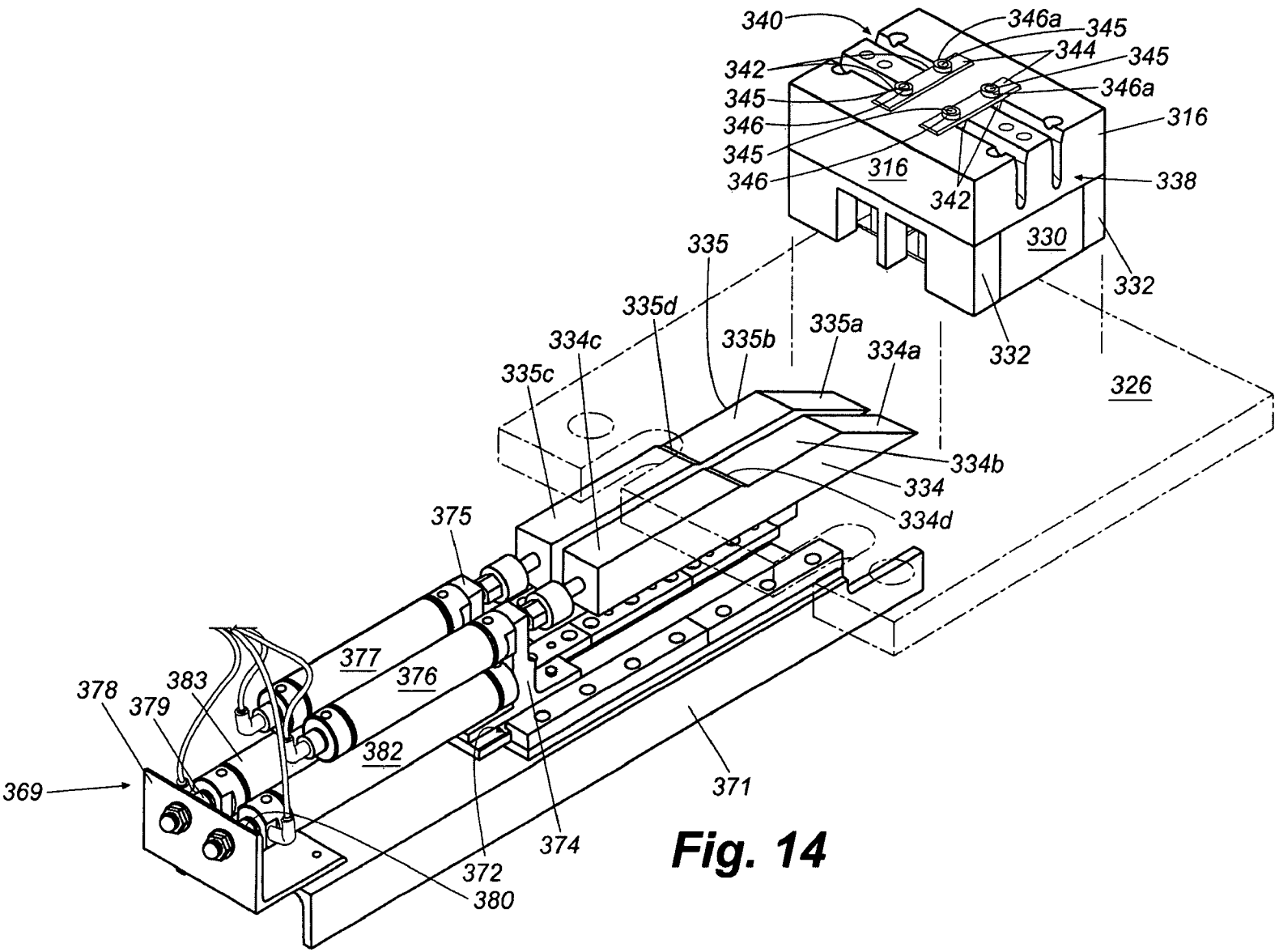
FIG. 14 is a perspective view of a gag assembly for use in the top rail punching press of FIG. 11.

Referring to FIGS. 13 and 14, bottom die 316 is connected to punch body lower portion 304 by a bottom die shoe 326 that also rigidly supports two die posts 328 (FIG. 13), a lower rail punch spacer 330, a pair of gag guides 332 and a pair of gags 334 and 335. As with bottom rail punch press 16, top rail punch press gags 334 and 335 are positioned parallel to each other and are slidably received by gag guides 332 (FIG. 14). Bottom die shoe 326 also supports two front proximity switch brackets 315*a* and two rear proximity switch brackets 315*b* (FIG. 13). Each front proximity switch bracket 315*a* supports a front proximity switch 314*a*, while each rear proximity switch bracket 315*b* supports both an intermediate proximity switch 314*b* and a rear proximity switch 314*c*. The operation of the proximity switches 314*a*, 314*b*, and 314*c* will be described in detail below.

Referring to FIG. 14, each gag 334 and 335 defines a respective (1) sloped leading edge 334*a* and 335*a*, (2) first stage surface 334*b* and 335*b*, (3) second stage surface 334*c* and 335*c* and (4) sloped transition surface 334*d* and 335*d* intermediate the first and second stage surfaces. Gag 334 slides into gag guides 332 when cylinders 376 and/or 382 actuate, and gag 335 slides into gag guides 332 when cylinders 377 and/or 383 actuate. Gag cylinders 376, 377, 382, and 383 are situated in a gag cylinder bank 369 in a stacked arrangement that is rigidly supported by gag bank bracket 371. Gag cylinder bank bracket 371 attaches to C-shaped body vertical portion 306 (FIGS. 11 and 12) and bottom die shoe 326 (shown in phantom in FIG. 14).

Bottom die 316 defines four slots arranged into a first set 338 of two slots and a second set 340 of two slots. All slots in a single set are parallel to each other, and the slots of first set 338 are arranged so that each slot is aligned with and parallel to a respective slot of second set 340. Each slot extends inwardly from one of two opposite outer sides of bottom die 316 toward the bottom die's center. The slots of first set 338 do not communicate with the slots of second set 340, but rather terminate to define inner ends 342 and each slot slopes downwardly from the die's center to a slot open end.

Bottom die 316 slidably receives two rail punches 344, which are positioned perpendicular to the axis of the slots and proximate to slot inner ends 342. Each rail punch 344 supports two die buttons 346 having a central bore 345 in communication with a respective exit portal (not shown). Thus, the material punched out of the sidewall panel assembly during the punching process exits through die button central bore 345 out of the exit portals (not shown) and out one of the two slot sets 338 and 340. In this way, the refuse material slides out of the bottom of die press 316, which prevents the machine from becoming jammed.

Figure 15:
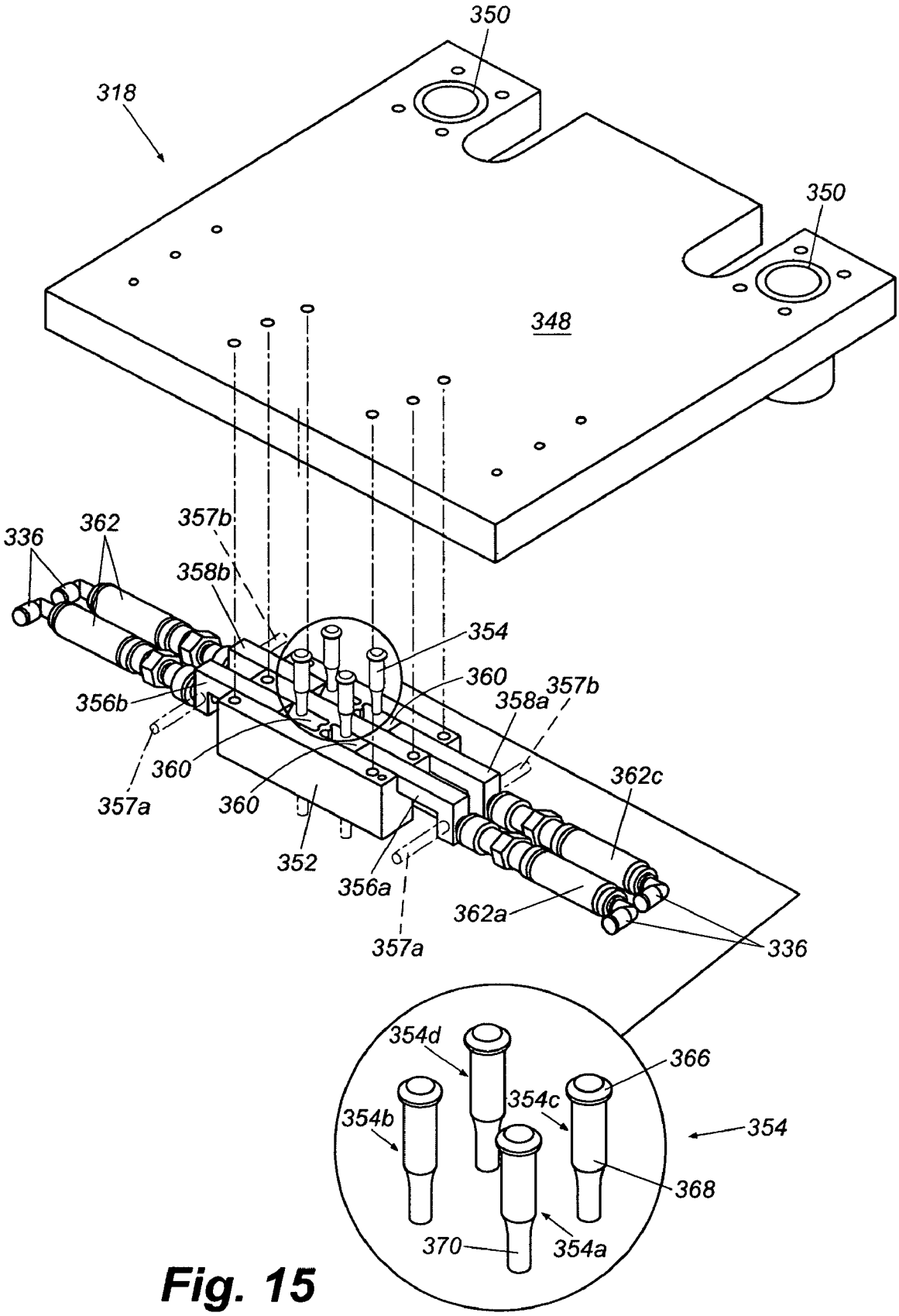
FIG. 15 is a perspective view of a punch assembly for use in the top rail punching, press of FIG. 11.

Referring to FIG. 15, top die assembly 318 comprises a bottom rail punch retainer 352, four punches 354, two field gags 356*a* and 356*b*, and two post gags 358*a* and 358*b*. Top rail punch retainer 352 may be secured to top die shoe 348 by screws, bolts, or any other suitable fasteners and defines four gag slots 360, each of which slidably receives a respective field or post gag. Gag cylinders 362*a* and 363*b* drive field gags 356*a* and 356*b*, respectively, while gag cylinders 362*c* and 362*d* drive post gags post gags 358*a* and 358*b*, respectively. The field gags and post gags are identical single gags that restrain only one punch each. The gag cylinders may be pneumatic cylinders powered by air hoses 355 (FIG. 12) connected to air valves 336. Once the gag cylinders bias the gags into their corresponding gag slots 360, the proximity switches no longer sense the rear portion of the gags, and the switches send a signal to a PLC (not shown) indicating that the appropriate gags are in a punching position. Punch cylinder 312 (FIG. 11) may actuate causing top die assembly 318 to slide downward, into a hole-punching stroke.

Gag slots 360 are arranged in two sets of two parallel slots, and an inner end of each slot defines a vertical, counterbored through-hole (not shown) that slidably receives a punch 354. Each punch 354 has a flange 366, a shank 368, and a tip 370. Punch shank 368 slides through the through-hole (not shown), and the punch flange 366 rests in a counterbore (not shown) of the through-hole. Field gags 356*a* and 356*b* and post gags 358*a* and 358*b* are slidably positioned in the gag slots so that when their respective gag cylinders are actuated, the gags restrain punch flanges 366 to prevent the punches from sliding upward in their through-holes when punch tips 370 contact the sidewall assembly. Field gags 356*a* and 356*b* restrain field punches 354*a* and 354*b*, respectively, while post gags 358*a* and 358*b* restrain field punches 354*c* and 354*d*, respectively. Four proximity switches 357*a* and 357*b* (shown in phantom) are attached by respective brackets (FIG. 13) to top die shoe 348 and sense the rear portion of gags 356 and 358, respectively, when the gags are retracted from their respective slots 360.

Top rail top die assembly 318 is attached to punching press upper portion 302 by punch cylinder 312, as shown in FIGS. 11 and 12. When activated, punch cylinder 312 lowers top die assembly 318 into a punching position, as described in detail below. Top die assembly 318 is rigidly attached to a piston rod 313 (FIG. 13) of punch cylinder 312 by top die shoe 348, which is equipped with two bushings 350 that ride along die posts 328 as cylinder 312 lowers the top die assembly.

Punch cylinder 312 is a hydraulic cylinder that actuates to either push piston rod 313 vertically downward or pull piston rod 313 vertically upward. During punching, hydraulic oil is forced into an upper chamber (not shown) of punch cylinder 312, and the pressure exerted upon piston rod 313 by the hydraulic oil forces the piston rod downward until the piston rod is fully extended. When the piston rod fully extends, top die assembly 318 lowers toward bottom die assembly 316, and the punches 354*a*-354*d* (FIG. 15) restrained by their respective gags punch holes in the sidewall assembly. Once the holes are punched in the sidewall assembly, hydraulic oil is forced out of the upper chamber (not shown) and into a lower chamber (not shown) of cylinder 312*f* forcing piston rod 313 to retract and raise top die shoe 348 vertically upward towards punching press upper portion 302.

Figure 16:
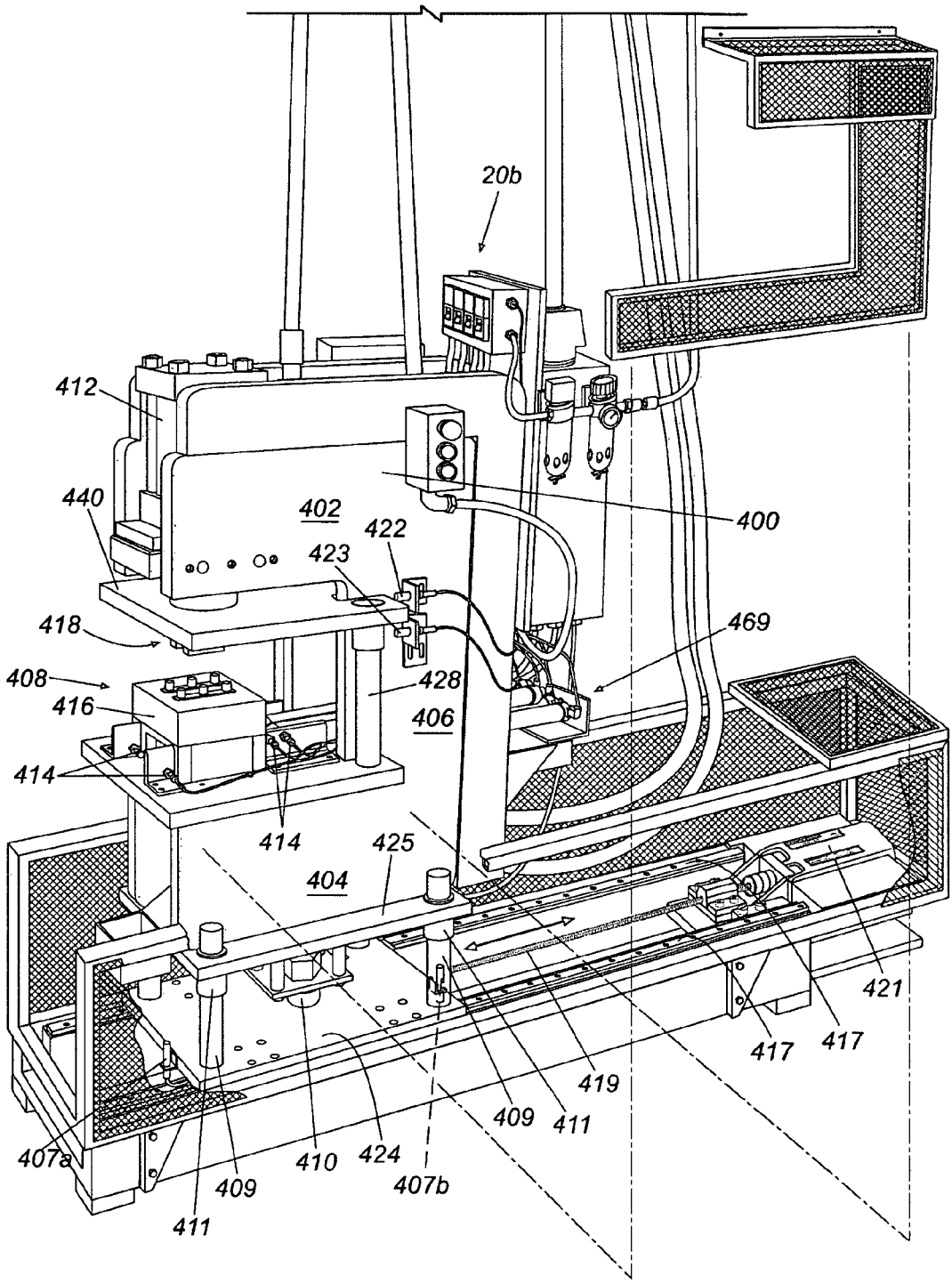
FIG. 16 is a perspective view of a rivet crushing press for use in the automated assembly machine of FIG. 1.
Figure 17:
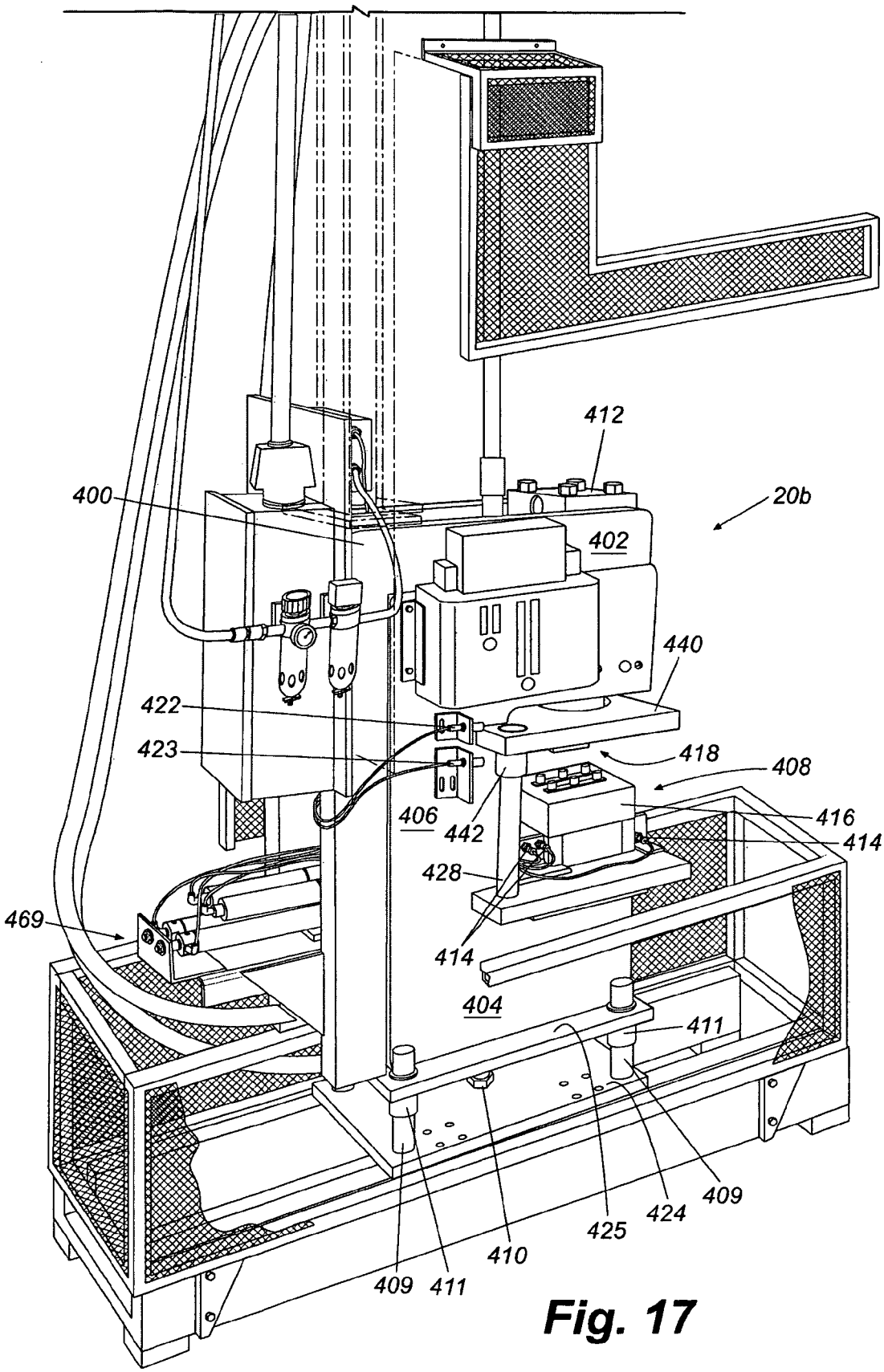
FIG. 17 is a reverse perspective view of the rivet crushing press of FIG. 16.

Referring now to FIGS. 16 and 17, a top rail riveting press 20*b* has a C-shaped body 400, with an upper portion 402, a lower portion 404, a vertical portion 406 and a riveting area generally denoted 408. Top rail riveting press 20*b* is also equipped with a lift cylinder 410, a riveting cylinder 412, bottom gag proximity switches generally denoted by 414, a bottom riveting die 416, a top riveting die assembly 418, a top riveting die upper proximity switch 422, and a top riveting die lower proximity switch 423.

Riveting press lift cylinder 410 is positioned between a lift cylinder anchor bracket 424 and a lift cylinder body bracket 425. Four lift guide posts 409 are slidably received in respective bushings 411 that are coupled to body bracket 425. The sliding connection between the guide posts and the bushings provides alignment and support between anchor bracket 424 and body bracket 425 as lift cylinder 410 actuates to raise and lower C-shaped body 400 relative to frame 12 (FIG. 1).

Referring particularly to FIG. 16, riveting press 20*b*, located on the top rail side of assembly machine 10 (FIGS. 1 and 2), has two rails 417 that are slidably attached to lift cylinder bracket 424. A ball nut (not shown), attached to the bottom of bracket 424, is driven by a drive screw 419 that is rotatably attached to drive motor 421. When motor 421 rotates drive screw 419, the ball nut (not shown) advances along the drive screw thereby moving riveting press 20*b* linearly transverse to machine longitudinal axis 26 (FIG. 1). A front proximity switch 407*a* and a rear proximity switch 407*b* are affixed to lift cylinder bracket 424 to accurately position riveting press 20*b*. When drive screw 419 has advanced riveting press 20 to a riveting position proximate to the machine longitudinal axis, front proximity switch 407*a* senses a flag (not shown) and drive screw drive motor 421 stops rotating drive shaft 419. In this way, riveting press 20*b* is properly positioned for compressing rivets (not shown). Once the last rivets have been compressed, drive motor 421 rotates drive shaft 419 in an opposite direction, and riveting press 20*b* is returned to a home position distal from the machine longitudinal axis. When riveting press 20*b* reaches its home position, rear proximity sensor 407*b* senses a flag (not shown) and the drive screw motor stops rotating the drive shaft. This allows for the adjustment of the position of press 20*b* facilitating easy loading and unloading of a sidewall assembly from the assembly machine. However, rail riveting press 20*a*, located on the bottom rail side of machine 10 (FIG. 1), is not equipped with a ball screw mechanism and, accordingly, can not be adjusted linearly transverse to machine longitudinal axis 26. It should be understood, however, that the bottom rail rivet press 20*a* may be formed similar to the top rail rivet press so that it too can be adjusted relative machine centerline 26.

Figure 18A:
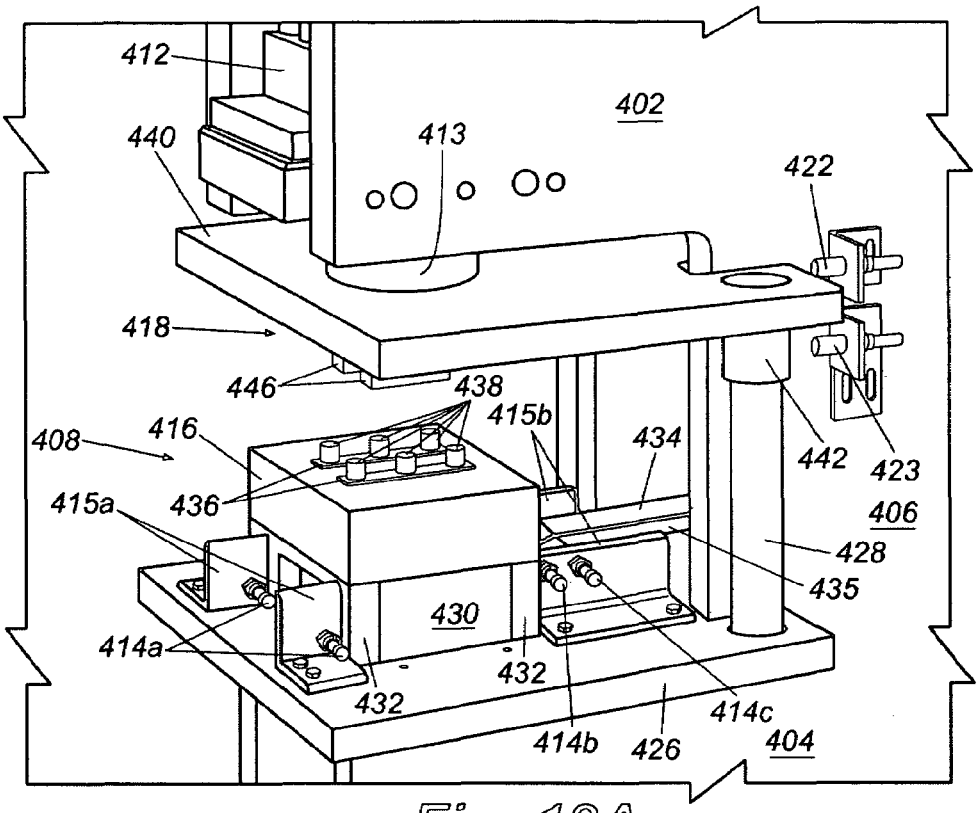
FIGS. 18A and 18B are perspective views of the rivet crushing area of the rivet crushing press of FIG. 16.
Figure 18B:
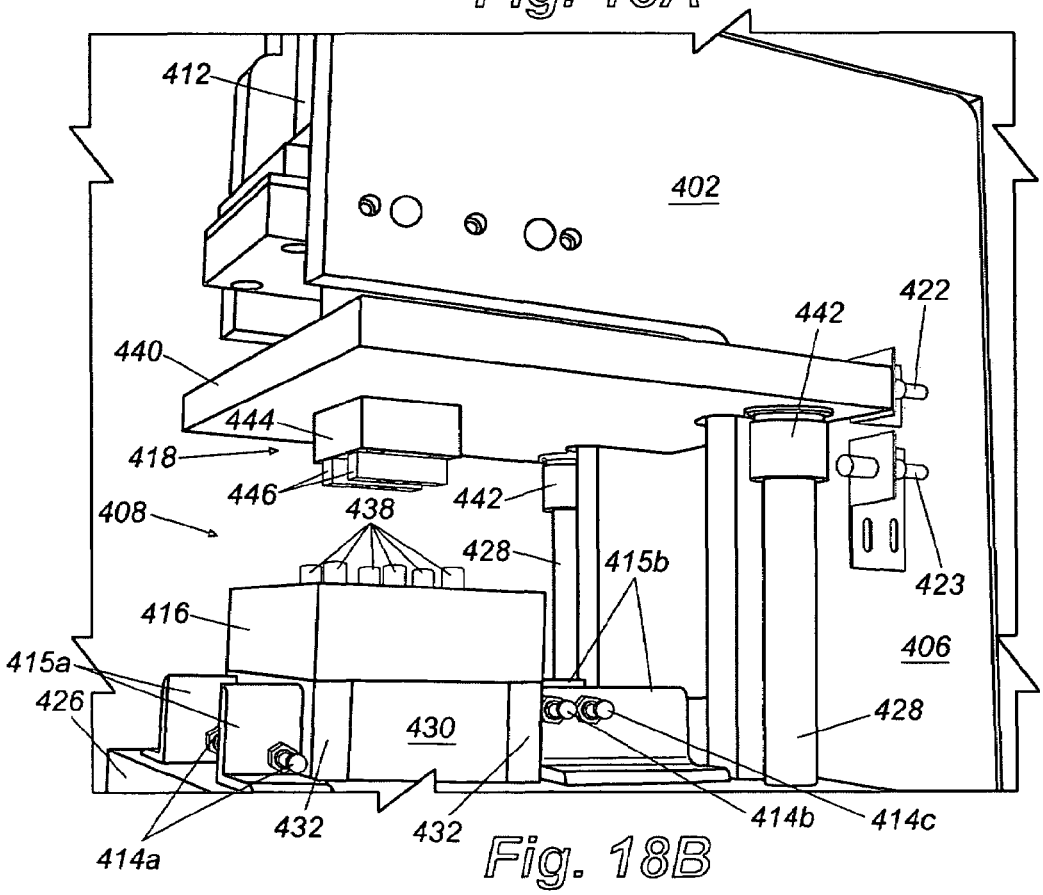
Figure 19:
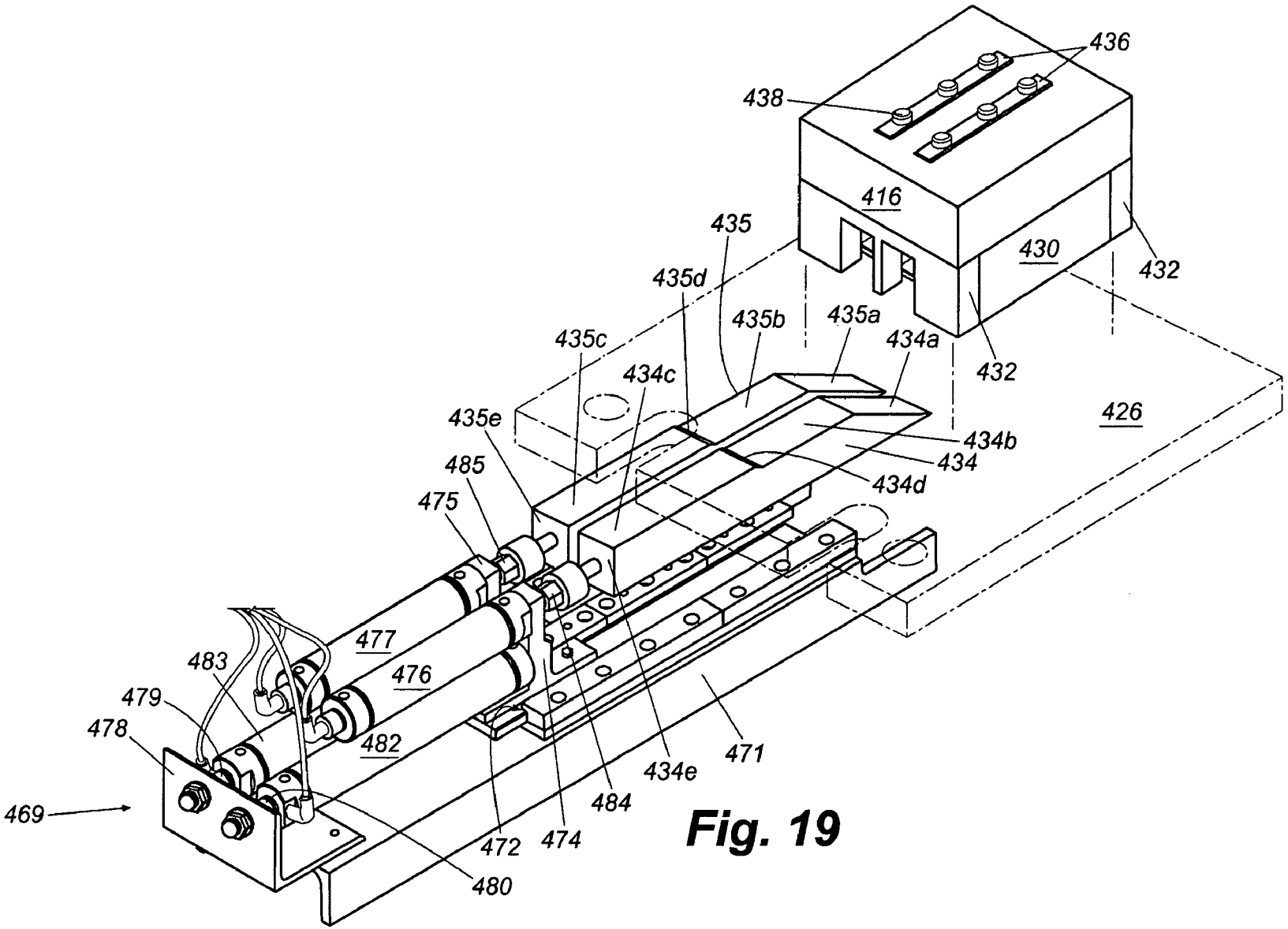
FIG. 19 is a perspective view of a gag assembly for use in the rivet crushing press of FIG. 16.

The following paragraphs address features of presses 20*a* and 20*b* that are identical; therefore any reference to features specific to press 20*a* or 20*b* will be particularly pointed out. Referring to FIGS. 18A, 18B and 19, bottom die 416 is rigidly connected to riveting press body lower portion 404 (FIG. 18A) by a bottom die shoe 426. Bottom die shoe 426 supports two die posts 428 (FIGS. 18A and 18B), a lower die spacer 430, a pair of gag guides 432 and a pair of gags 434 and 435 (FIGS. 18A and 19). Bottom die shoe 426 also supports two front proximity switch brackets 415*a* and two rear proximity switch brackets 415*b* (FIGS. 18A and 18B). Each front proximity switch bracket 415*a* supports a front proximity switch 414*a*, while each rear proximity switch bracket 415*b* supports both an intermediate proximity switch 414*b* and a rear proximity switch 414*c*.

Referring in particular to FIG. 19, each gag 434 and 435 defines a respective (1) sloped leading edge 434*a* and 435*a*, (2) first stage surface 434*b* and 435*b*, (3) second stage surface 434*c* and 434*c* and (4) sloped transition surface 434*d* and 435*d* intermediate the first and second stage surfaces. Gags 434 and 435 are positioned parallel to each other and are slidably received by gag guides 432. Gags 434 slides into gag guides 432 when cylinders 476 and/or 482 actuate, while gag 435 slides in to gag guides 432 when cylinders 477 and/or 483 actuate as described below. Gag cylinders 476, 477, 482, and 483 are situated in a gag cylinder bank 469 in a stacked arrangement that is rigidly supported by a gag bank bracket 471. Gag bank bracket 471 is attached to both C-shaped body vertical portion 406 (FIGS. 16 and 17) and bottom die shoe 426 (shown in phantom in FIG. 19).

Bottom die 416, lower die spacer 430, and gag guides 432 support bottom die 416 and bottom die 416 slidably receives two rail anvils 436 that are aligned parallel to each other and to gags 434 and 435, and each rail anvil supports three plungers 438. Referring to FIG. 28C, plungers 438 are spring-loaded and biased upward within rail anvil 436. Rail anvils 436 define a vertical portion 436*a* and a horizontal flange 436*b*. During assembly of rail anvils 436, three through holes 436*c* are bored into vertical portion 436*a*. Through holes 436*c* define an upper counterbore 436*d* that receives plunger 438 and a spring 439, and a lower counterbore 436*e* that receives the head of a cap screw 437. It should be under stood that cap screw 437 may be replaced by a shoulder bolt or other appropriately shaped fastener.

Each upper counterbore 436*d* receives spring 439 and plunger 438, and the spring biases the plunger upward. Cap screw 437 is inserted into lower counterbore 436*e* so that the treaded portion of the cap screw extends into through hole 436*c* and into upper counterbore 436*d*. Each plunger is tapped to receive the threads of cap screw 437, and the threaded portion of cap screw 437 is tightened into the tapped portion of plunger 438. Rail anvil flange 436*b* is then attached to rail anvil vertical portion 436*a* sealing the head of cap screw 437 into lower counter bore 436*e*. Rail punch vertical portion 436*a* and rail punch flange 436*b* may be attached together by screws, weldments or by any other suitable assembly method. In this configuration, a downward force exerted on plunger 438 will compress spring 439 and allow plunger 436 to slide downward in counterbore 436*d* proximate to through hole 436*c*.

Referring again to FIGS. 18A and 18B, riveting press top die assembly 418 comprises a top die shoe 440 rigidly attached to a piston rod 413 (FIG. 18A) of cylinder 412. Top die shoe 440 rigidly supports anvil mount 444 (FIG. 18B) and top anvils 446, which are positioned so that each top anvil 446 aligns with one of rail anvils 436. Top die shoe 440 is equipped with two bushings 442 that ride along die posts 428 as cylinder 412 raises and lowers top die assembly 418.

In one embodiment, riveting cylinder 412 is a hydraulic cylinder that actuates to either push piston rod 413 vertically downward or pull piston rod 413 vertically upward. During riveting, hydraulic oil is forced into an upper chamber (not shown) of cylinder 412 forcing the piston rod downward until the piston rod is fully extended. When the piston rod fully extends, the rivets (not shown) previously inserted into holes punched into the sidewall assembly by top rail punching press 18 are compressed between rail anvil 436 and top die anvil 446, securely fastening top rail 6 to sidewall panel 2. Once the rivets are compressed, hydraulic oil is forced out of the upper chamber (not shown) and into a lower chamber (not shown) of cylinder 412, which forces piston rod 413 upward and raises top die shoe 440 vertically upward towards punching press upper portion 402. It should be understood that the riveting process used for both the bottom rail and top rail portions of an assembled sidewall are substantially identical with the exception that the top rail riveting press has smaller anvils and is equipped with a mechanism for varying the distance between the top rail riveting press and the machine frame centerline 26 (FIG. 1). Because of the minor differences between the top rail and bottom rail rivet presses, a detailed description of the bottom rail rivet press is not discussed herein.

In operation, the automated sidewall assembly machine attaches a bottom rail and a top rail to a sidewall panel. In general, the assembly machine punches holes in both the sidewall and the top and bottom rails. Once the holes have been punched, an operator inserts rivet blanks into the punched holes, and the automated assembly machine compresses the rivets, thereby securely fastening the bottom and top rails to the sidewall panel. The assembly machine indexes the sidewall and rails along the length of the machine so that the punching and riveting presses may remain stationary with respect to the translating sidewall assembly. The punching and riveting process is repeated until the rails have been securely attached to the sidewall panel along the entire length of the sidewall assembly.

Referring to FIGS. 1-3, prior to executing the automated assembly process, machine 10 powers up and executes a homing operation in which center cart mechanism 14 moves along center rail 40 to a position proximate to drive motor 44. Once center cart mechanism 14 reaches its home position, gripper jaws 76 (FIG. 20) open and the jaws are ready to receive a sidewall assembly. Operators place a sidewall panel 2 onto skates 32 at machine frame first end 28 and position bottom rail 4 and top rail 6 along the appropriate edges of sidewall panel 2.

Once the panel and rails are positioned on machine 10, an operator swings manual alignment rollers assemblies 60*a* (FIGS. 22A and 22B) into position by rotating roller arms 63*a* into a vertical attitude and inserts locking pin 67*a* into both roller arm 63*a* and support frame 64*a*. The operators then slide wall panel 2 and bottom rail 4 into contact with manual alignment rollers 62*a*. This properly aligns sidewall panel 2 and bottom rail 4 with respect to bottom rail punch press 16 and bottom rail riveting press 20*a*. After aligning the bottom rail with manual alignment rollers 62*a*, the operators actuate automated alignment roller assemblies 60*b* to properly secure the wall assembly in machine 10.

Referring to FIGS. 23A-23C, pneumatic rotating cylinder 66*b* retracts, rotating roller arm 63*b* from a horizontal attitude (FIG. 23A) into a vertical attitude (FIGS. 23B and 23C), and pneumatic linear cylinder 68*b* actuates pulling roller 62*b* and roller arm 63*b* towards top rail 6 (FIG. 23C) until rail sensor 69*b* makes contact with the edge of the top rail. Once rail sensor 69*b* makes contact with the top rail, cylinder 68*b* stops actuating, and a rolling connection between top rail 6 and roller 62*b* is maintained until the sidewall assembly is indexed beyond the automated alignment roller 60*b*.

Multiple manual and automatic alignment roller assemblies 60*a* and 60*b* (FIG. 1) are provided along the length of assembly machine 10, thus ensuring proper alignment of the sidewall assembly throughout the assembly process. When the sidewall assembly progresses past each automated alignment roller assembly 60*b*, sensor 69*b* recognizes that roller 62*b* is no longer in contact with the top rail (not shown) and actuates linear cylinder 68*b*, pulling roller 62*b* and roller arm 63*b* towards cylinder 68*b*. Rotation cylinder 66*b* then actuates, rotating roller 62*b* into a horizontal attitude, where it remains until a new sidewall assembly is loaded for assembly.

Figure 20:
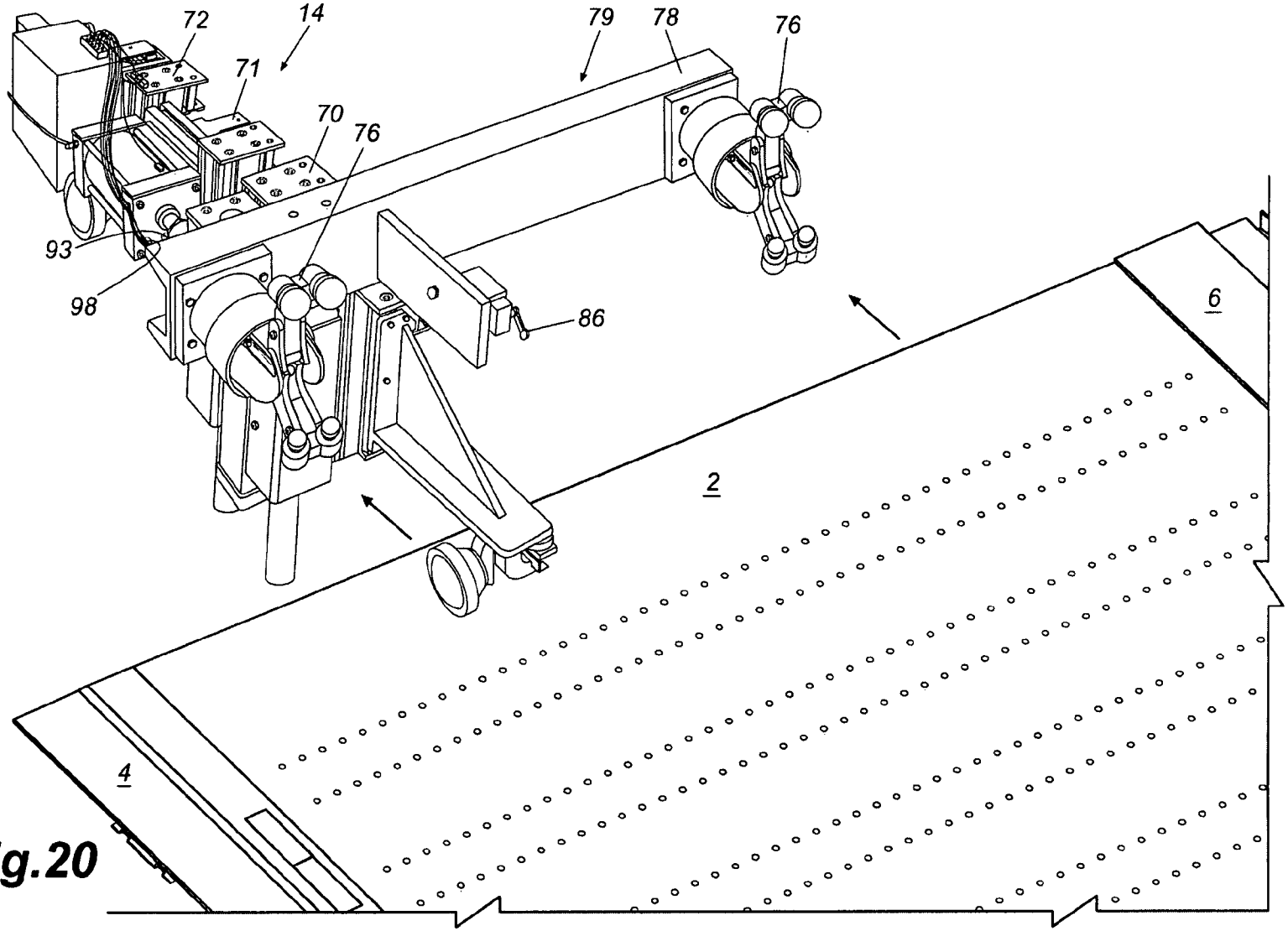
FIGS. 20 and 21 are perspective views of the cart of FIG. 4A operating on a sidewall assembly of one embodiment of the present invention.
Figure 21:
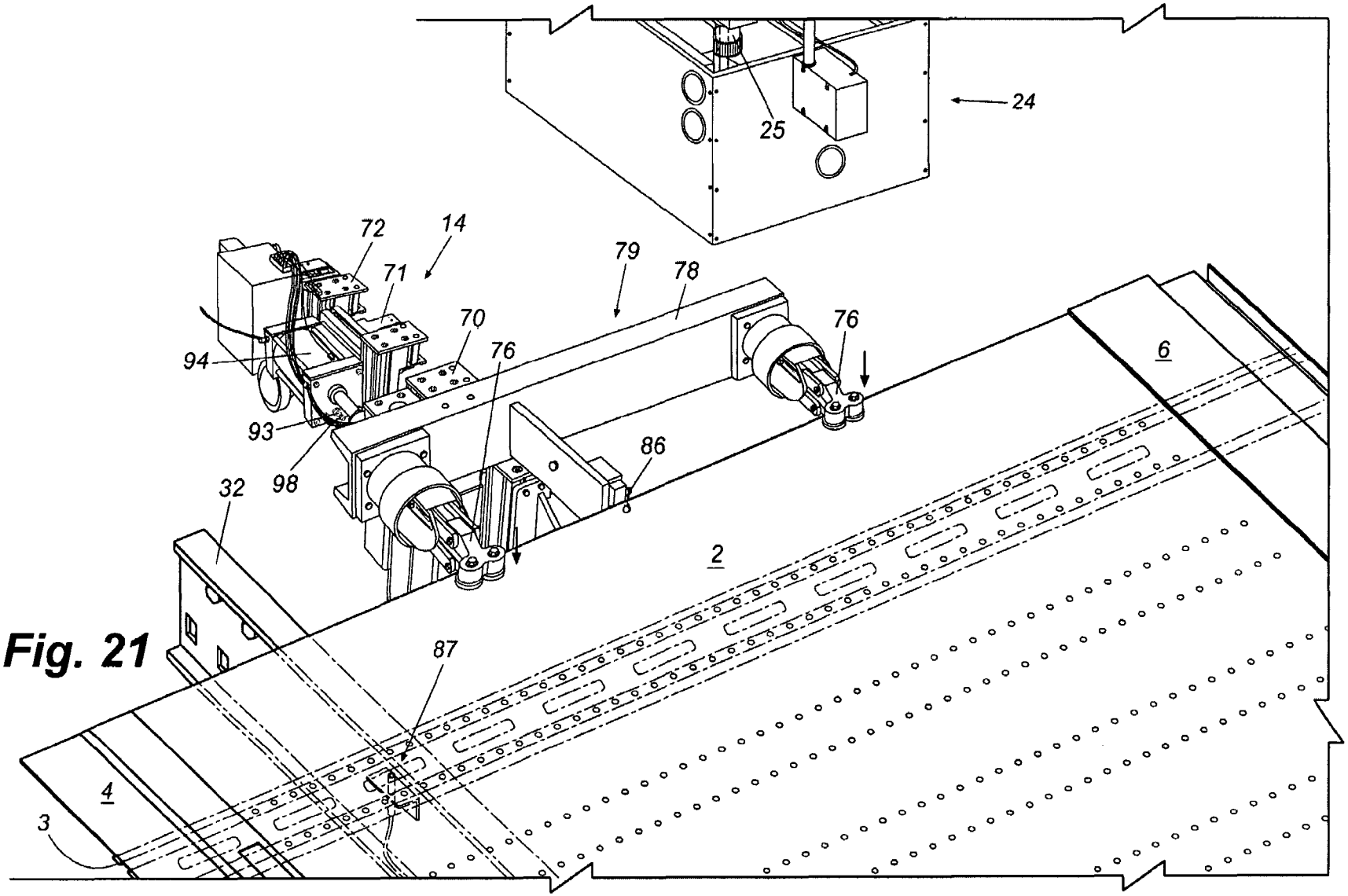

Referring to FIGS. 20 and 21, once the sidewall assembly is secured between the alignment rollers, the operators roll the assembly towards center cart mechanism 14, until the leading edge of sidewall 2 trips toggle switch 86. This causes the jaw cylinders (not shown) to actuate so that gripper jaws 76 close and tightly clamp down onto sidewall 2 (FIG. 21). Once the jaws grip the sidewall assembly, brake calipers 50 and 52 disengage from angle iron guide flange 48*a* (FIG. 5), and drive motor 44 (FIG. 3) slowly advances drive belt 42 moving cart 14 along rail 40 until a proximity sensor 87 (FIG. 21) attached to skate 32 detects the leading edge of the first support post 3 attached to the underside of sidewall panel 2. Once proximity sensor 87 senses the forward edge of first post 3, vision system 24 is positioned so that a camera 25 may take a picture of the forward edge of the sidewall assembly in order to determine which style of sidewall is being assembled and where the post is located.

Referring to FIG. 21, vision system 24 is fixedly attached to an overhead frame (not shown) located above assembly machine frame 12 and the sidewall assembly. When camera 25 takes a picture of the sidewall assembly, the image is relayed back to a CPU, which digitally processes the picture and looks for one of the following five items:

(1) a post;

(2) a post with rivets spaced 4" apart directly below the camera;

(3) a post with rivets spaced 4" apart and offset 2" from the center of the camera;

(4) a post with rivets spaced 6" apart; or (5) a post with rivets spaced 6" apart and offset 2" from the center of the camera.

Each of the five different images corresponds to an assembly program that is specific to the particular style of sidewall, and based on the image taken by camera 25, the CPU selects the proper program to both initially position and assemble the sidewall panel 2, bottom rail 4, and top rail 6.

Once the initial position of the sidewall assembly and the correct punching pattern is determined, the punching and riveting processes commence. The sidewall assembly travels along center rail 40 by the indexing movements of drive motor 44 (FIGS. 2 and 3) and center cart mechanism 14. Throughout the assembly process, vision system 24 continues to take photographs of the sidewall assembly after each indexing movement to ensure that center cart mechanism 14 moves the sidewall assembly the proper distance. If center cart mechanism 14 indexes the sidewall assembly an incorrect distance, vision system 24 will recognize the error and determine the difference between the actual position and the proper position, and the CPU will adjust the indexing distance by 0.020" increments towards the correct position. Additionally, based upon the data collected by each photograph, the vision system will determine the proper riveting and punching processes that must occur for each indexed position. In particular, vision system 24 records the data captured at a particular position, the CPU determines the proper punching and riveting patterns for that position and the information is stored in an array file. As the sidewall assembly enters the punching and riveting presses, the PLCs controlling the presses recalls the information from the array to determine the proper punching and riveting sequence for each position along the length of the sidewall assembly.

Figure 24A:
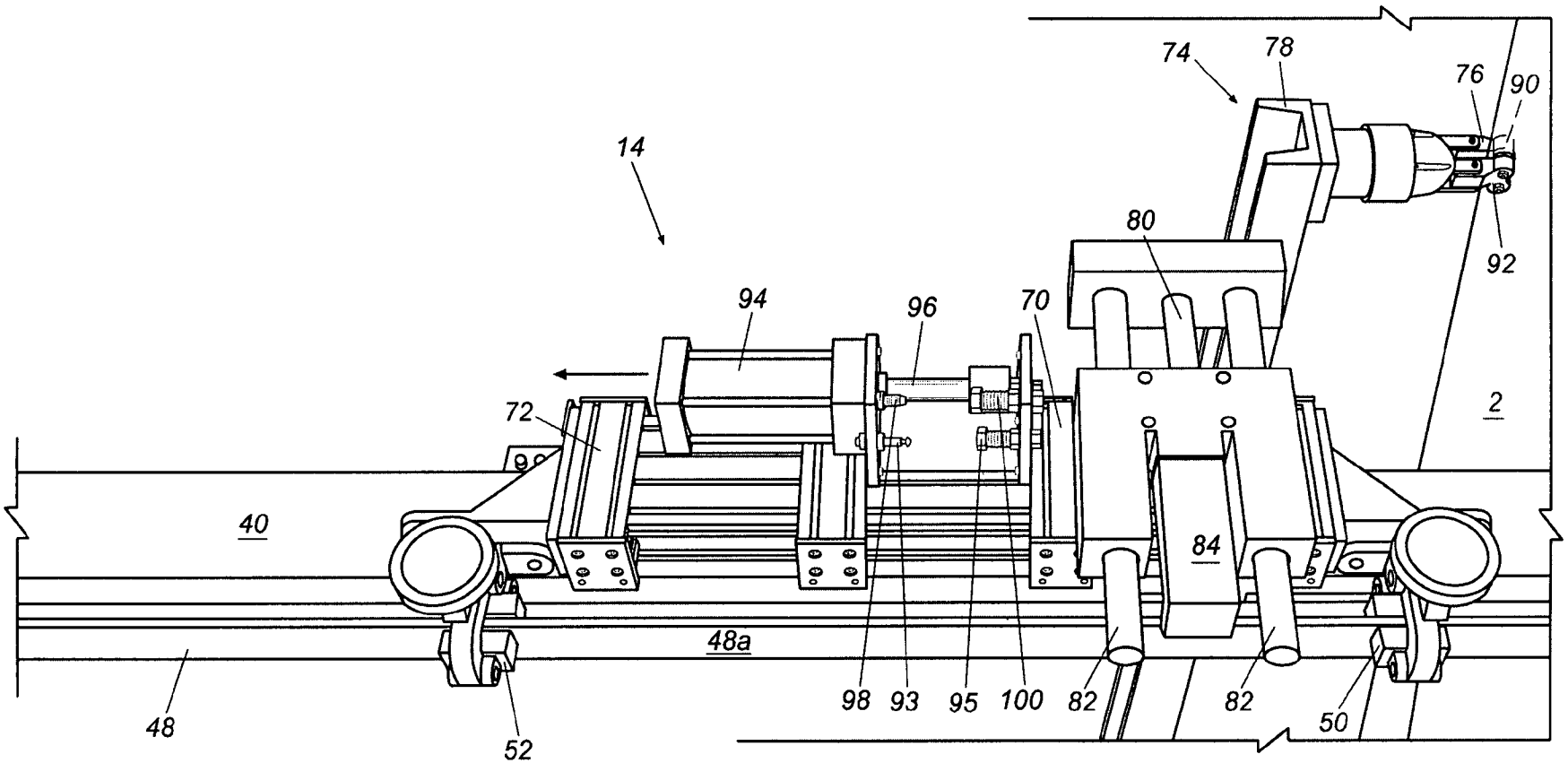
FIGS. 24A-24F are perspective views of the cart of FIG. 4A shown in operation on the rail of FIG. 3.

Referring to FIGS. 24A-24F, during each indexing move performed by center cart mechanism 14, first cart 70 and second cart 72 move separately and at different times. Prior to the first indexing move, both first cart brake 50 and second cart brake 52 are activated, locking both carts rigidly to guide flange 48*a*. Referring with particularity to FIG. 24A, once the carts are to index, second cart brake 52 disengages from center guide flange 48*a*, and drive motor 44 rotates drive pulley 46 (FIG. 3) causing the drive belt to pull second cart 72 towards machine second end 30. First cart brake 50 remains engaged on center guide 48 (FIG. 24A), and pneumatic cylinder 94 allows cylinder piston rod 96 to extend as second cart 72 is pulled away from first cart 70.

Figure 24B:
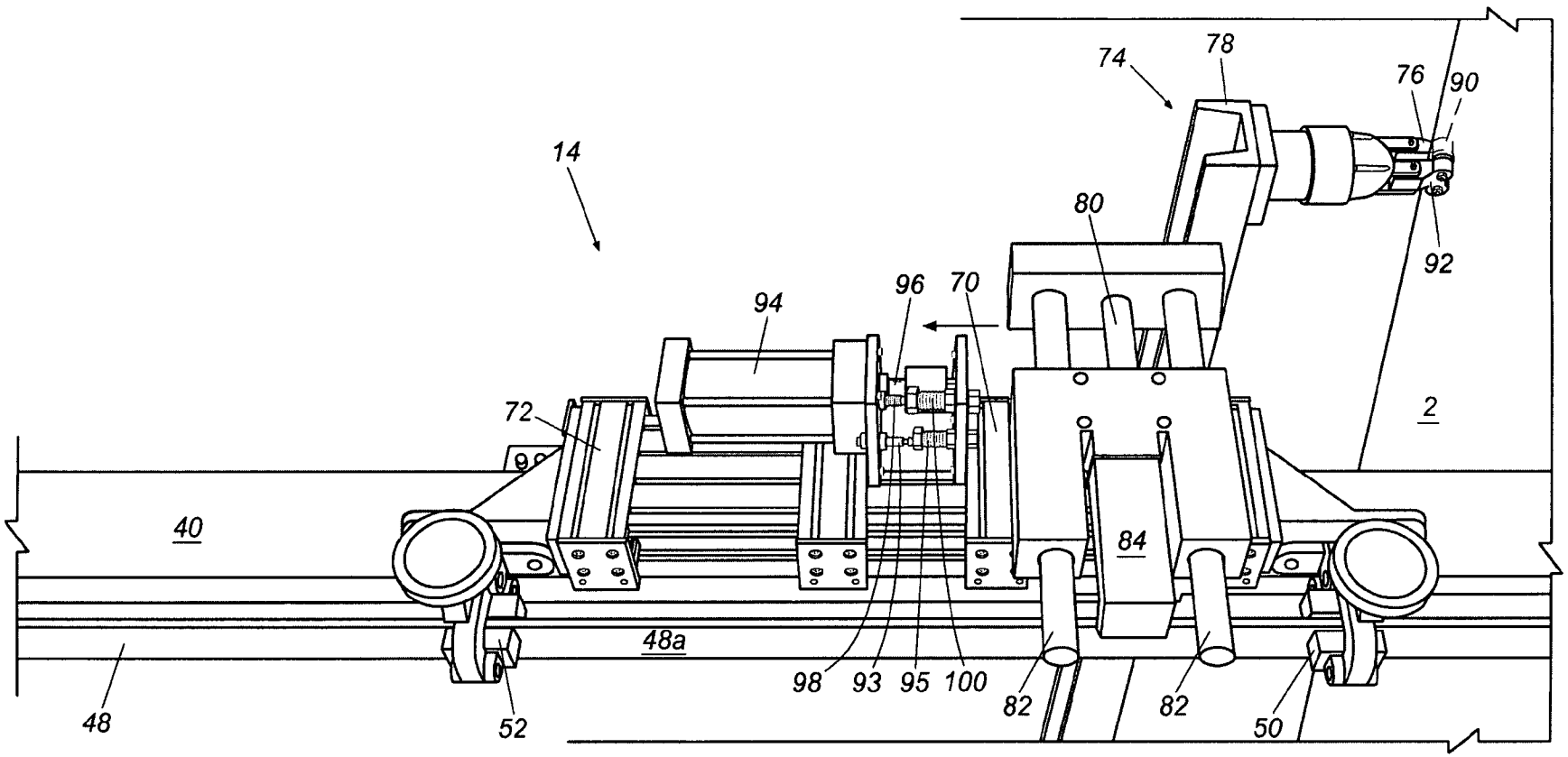
Figure 24C:
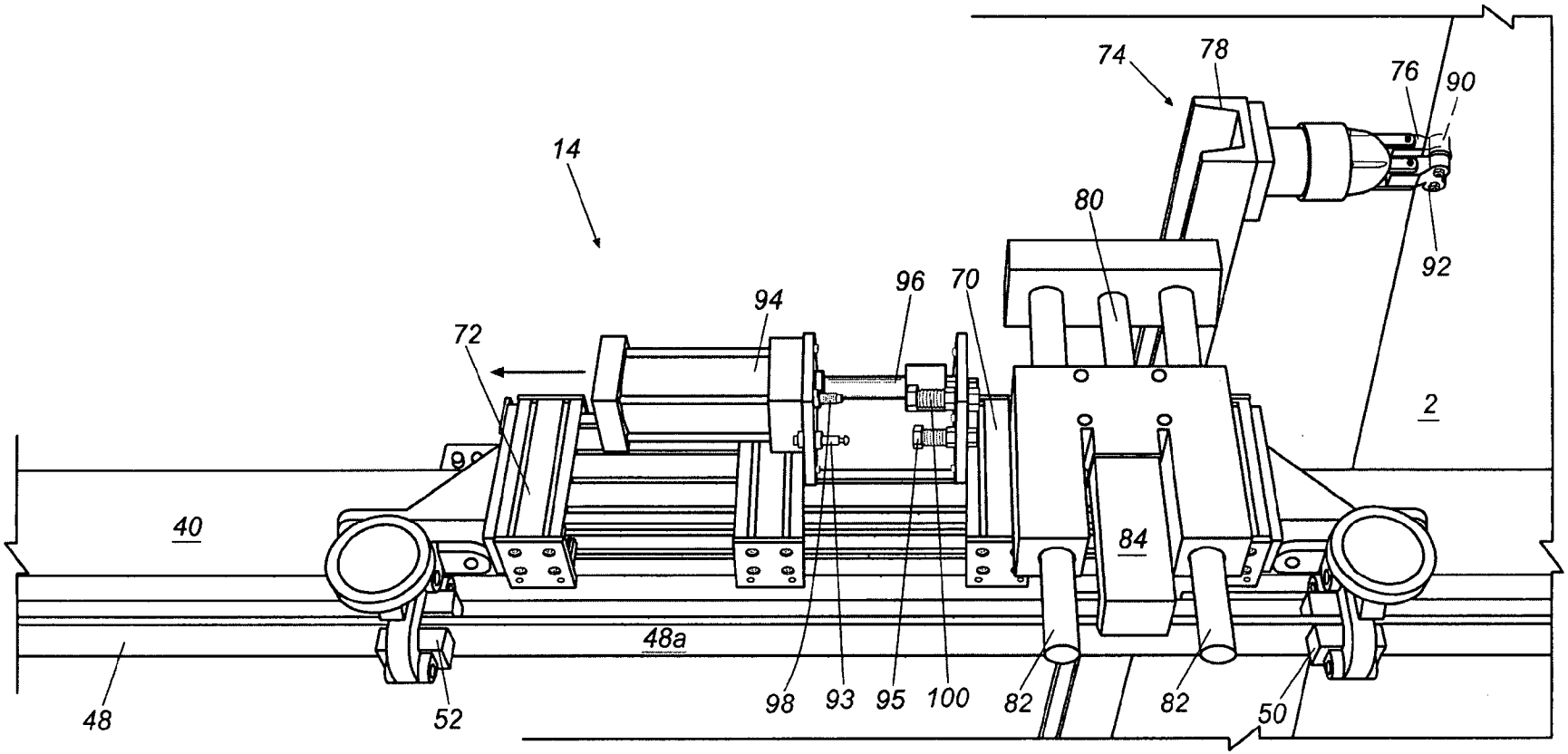

Referring to FIG. 24B, when the indexing of second cart 72 is completed, second cart brake 52 engages guide flange 48*a*, fixing second cart 72 rigidly in place. First cart brake 50 then disengages from guide flange 48*a* and pneumatic cylinder 94 actuates, pulling piston rod 96, first cart 70, and the sidewall assembly towards second cart 72. When cylinder 94 retracts piston rod 96 far enough for shoulder bolt 95 to contact with shock absorber 93, the shock absorber will retard the motion of first cart 70 towards second cart 72. At this point, proximity switch 98 senses flag 100 attached to first cart 70 signaling to the CPU to discontinue the actuation of cylinder 94. As previously mentioned, proximity switch 98 operates to ensure that the first cart does not over-travel and damage the second cart when pulled by cylinder 94. Once first cart 70 is indexed toward second cart 72, first cart brake 50 re-engages guide flange 48*a*, locking first cart 70 and the sidewall assembly securely in place. After each indexing step, the process repeats itself, advancing the center cart mechanism 14 and the sidewall assembly along the length of center rail 40 until the assembly process is complete.

Figure 24D:
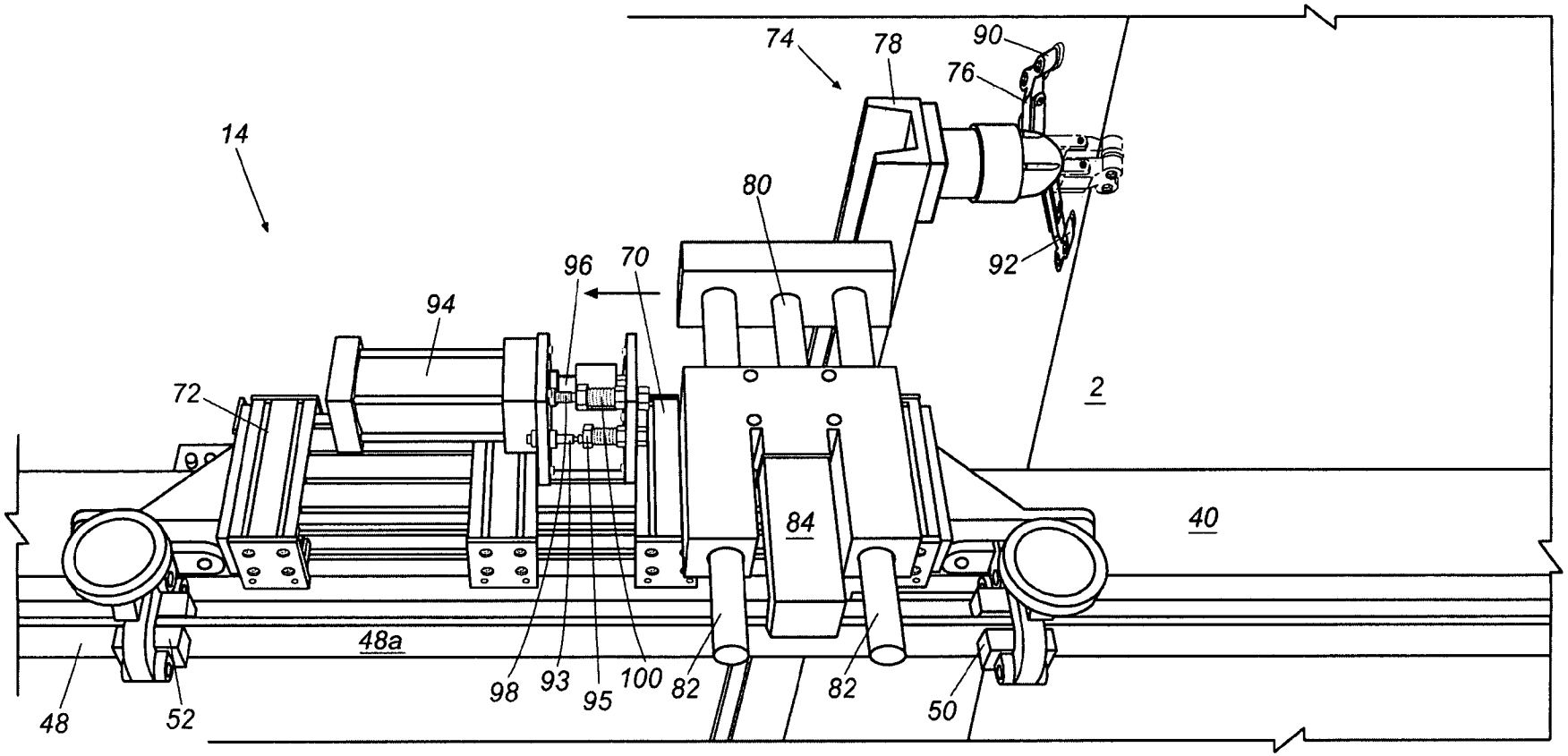

Referring to FIGS. 24C-24F, upon the completion of the assembly process, second cart brake 52 disengages guide flange 48*a*, and the drive motor indexes second cart 72 one final time, while first cart 70 is maintained in place by first cart brake caliper 50. After completion of the indexing move, second cart brake 52 re-engages guide flange 48*a*, locking second cart 72 firmly in place along center rail 40. Referring with particularity to FIG. 24D, jaws 76 open releasing the sidewall assembly, first cart brake 50 disengages guide flange 48*a*, and cylinder 94 actuates pulling first cart 70 towards second cart 72. In this way, jaw mechanism 74 is removed from engagement with the sidewall assembly.

Figure 24E:
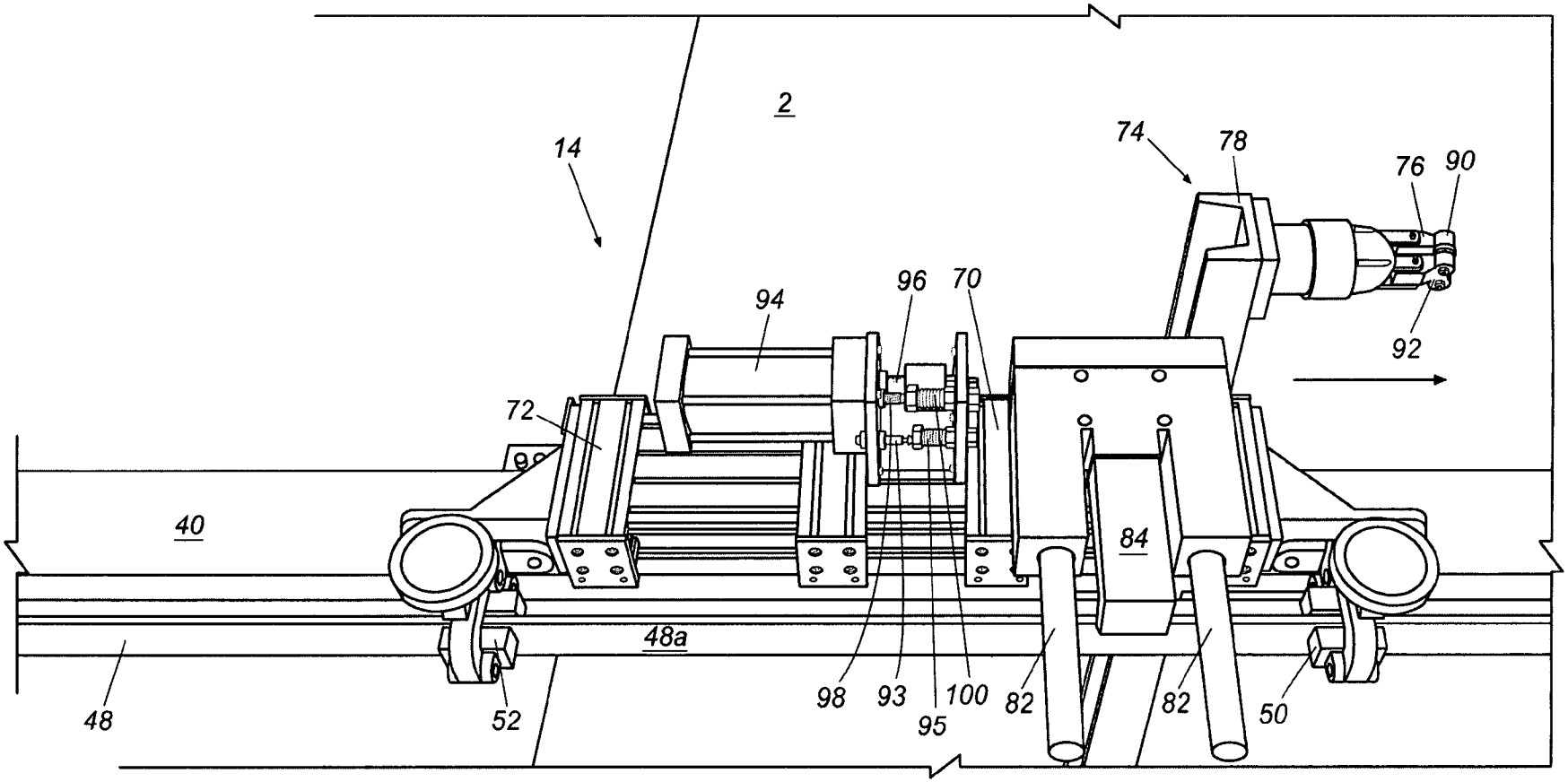
Figure 24F:
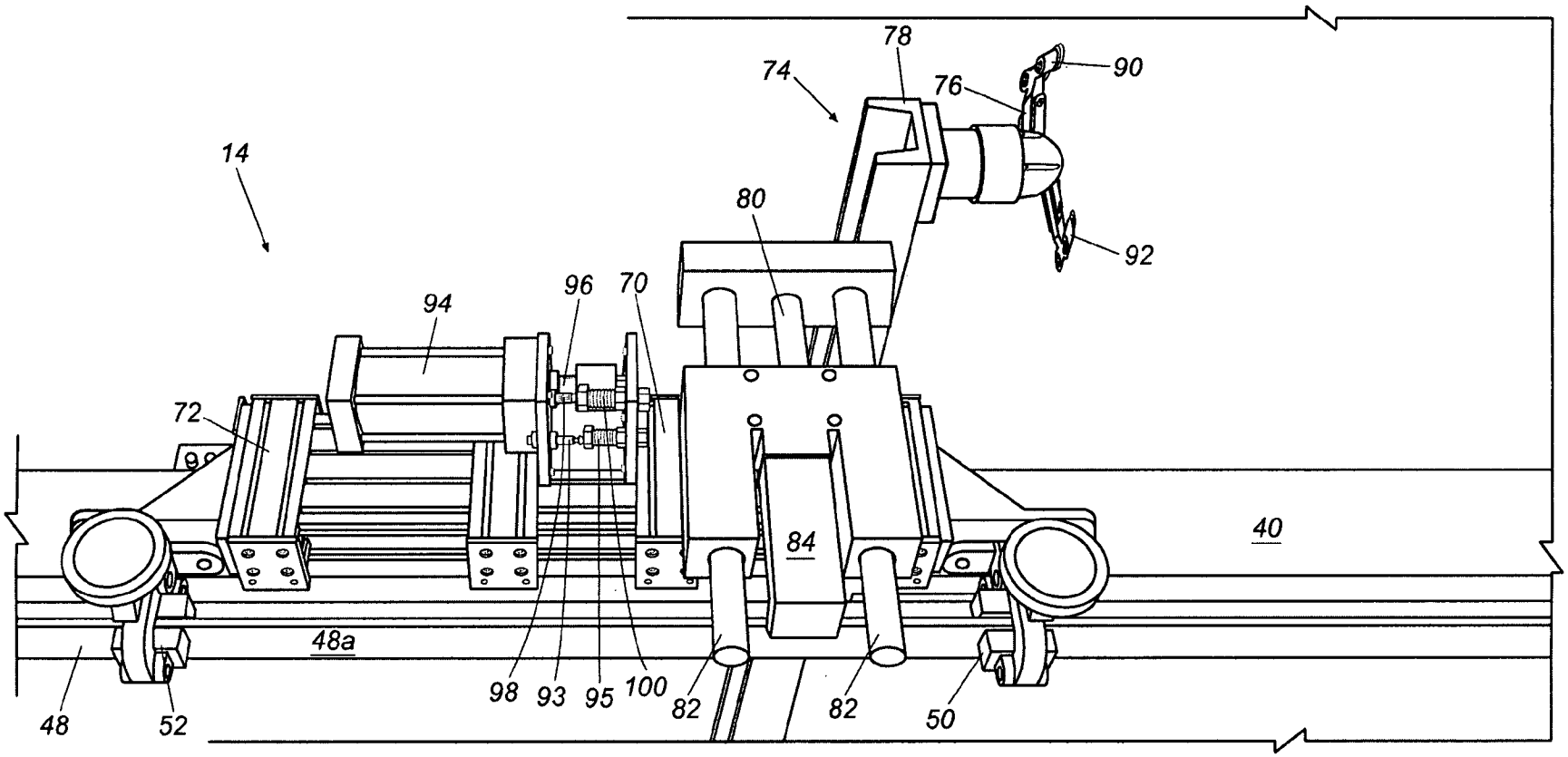

Referring to FIG. 24E, when proximity sensor 98 senses flag 100, cylinder 94 stops actuating, and pneumatic cylinder 84 actuates, pulling piston rod 80, which is connected to jaw assembly support member 78, down proximate to center rail 40 into a position where jaw assembly 74 is below the sidewall assembly. Jaws 76 close and second cart brake 52 disengages from guide flange 48*a* allowing drive motor 44 (FIG. 3) to jog belt 42 (FIG. 3) bringing center cart mechanism 14 to its home position proximate to drive motor 44. Referring now to FIG. 24F, when center cart mechanism 14 returns to its home position, cylinder 84 actuates raising piston rod 80, jaw assembly support member 78, and jaw assembly 74 up distal from center rail 40. Once jaw assembly 74 reaches its fully raised position, jaws 76 open, and center cart mechanism 14 is ready to receive the assembly of a new sidewall.

It should be understood that the punching process for both bottom rail punching press 16 and top rail punching press 18 is nearly identical. Accordingly, the description of the punching process provided herein is limited to the bottom rail. The only difference between the punching of the bottom rail and the punching of the top rail is the number of holes punched during the post hole punching steps.

Referring back to FIG. 1, during the assembly process, as center cart mechanism 14 advances the sidewall assembly along the length of assembly machine 10, the bottom rail portion of the sidewall approaches the bottom rail punching press 16. Punching press 16 is equipped to punch two varieties of holes: field holes and post holes. Field holes are equally spaced and are punched in a single row along the entire length of the bottom rail 4 parallel to machine central longitudinal axis 26. Post holes are holes punched through the sidewall assembly at a post and are punched in a column of two holes transverse to machine central longitudinal axis 26. Each column of post holes is aligned with a field hole, so that when the field and post holes are punched, the result is a single column of three holes with the field hole being closest to the machine central longitudinal axis 26 and the two post holes being further away from axis 26.

Referring now to FIG. 10, press 16 punches field holes when gag cylinders 262*a* and 262*b* force field gags 256*a* ad 256*b* into their respective gag slots 260 thereby restraining field punches 254*a* and 254*b* from any vertical motion. In order to accommodate the restrained field hole punches 254*a* and 254*b*, bottom shoe gag cylinder bank 269 (FIG. 9) actuates gag cylinders 282 and 283, which force gags 234 and 235, respectively, into gag guides 232. As gags 234 and 235 enter gag guides 232, gag leading edges 234*a* and 235*a* engage the lower portion of their respective rail punches 244 lifting the rail punch up and out of bottom die block 216. Cylinders 282 and 283 are sized appropriately so that when fully extended rail punches 244 rests on gag first stage surfaces 234*b* and 235*b*. As a result, the combined action of gag cylinders 262*a* and 262*b* (FIG. 10) and gag cylinders 282 and 283 (FIG. 9) punches field holes when punching cylinder 212 lowers top die assembly 218 (FIGS. 6 and 7) into its punching position.

Referring now to FIG. 10, punching press 16 punches post holes when gag cylinders 262*c* and 262*d* force post gags 258*a* and 258*b*, respectively, into their respective gag slots 260 thereby restraining post punches 254*c* and 254*d* from any vertical motion. In order to accommodate the restrained post hole punches 254*c* and 254*d*, bottom shoe gag cylinder bank 269 (FIG. 9) actuates gag cylinders 282 and 283, which force gags 234 and 235 into gag guides 232. As gags 234 and 235 enter gag guides 232, gag leading edges 234*a* and 235*a* engage the lower portion of their respective rail punches 244 lifting the rail punches up and out of bottom die block 216. The actuation of cylinders 282 and 283 forces gags 234 and 235 into gag guides 232 so that rail punches 244 rests on gag first stage surfaces 234*b* and 235*b*. On the other hand, when punching field holes, both cylinders 276 and 282 actuate to force gag 234 into gag guides 232 while both cylinders 277 and 283 actuate to force gag 235 into gag guides 232. In this way, rail punches 244 rest on second stage surfaces 234*c* and 235*c* when punching field holes.

Because gag cylinders 262*a*, 262*b* (FIG. 10), 276, 277, 282 and 283 (FIG. 9) function independently, it should be understood that punching press 16 may punch multiple arrangements of holes. The following arrangements are possible:

a. gag cylinder 262*a* (FIG. 10) actuates, restraining only field gag 256*a*, while gag cylinder 283 (FIG. 9) actuates, and only one field hole is punched,
b. gag cylinder 262*b* (FIG. 10) actuates, restraining only field gag 256*b*, while gag cylinder 282 (FIG. 9) actuates, and only one field hole is punched,
c. both gag cylinders 262*a* and 262*b* (FIG. 10) actuate, restraining field punches 256*a* and 256*b*, while gag cylinders 282 and 283 (FIG. 9) extend, forcing both gags 234 and 235 into gag guides, and two field holes are punched,
d. gag cylinders 262*a* and 262*c* (FIG. 10) actuate, and both gag cylinders 277 and 283 (FIG. 10) actuate, and one field hole and two post holes are punched,
e. gag cylinders 262*b* and 262*d* (FIG. 10) actuate, and both gag cylinders 276 and 282 (FIG. 9) actuate, and on field hole and two post holes are punched, or
f. any appropriate combination there of.

It should be understood that depending upon the spacing of posts within the sidewall assembly, it may be appropriate for the gag cylinders to actuate so that only a field hole is punched for each rail punch 244. It may also occur that the gag cylinders actuate so that a field hole is punched for one rail punch while both a field hole and two post holes are punched for the other rail punch. Finally, the gags may actuate so that a field hole and two post holes are punched for one rail punch while no holes are punched for the other rail punch. In this way, punching press 16 can accommodate for a number of different sidewall assembly designs that call for various field and post hole arrangements.

Referring back to FIG. 1, when punching a top rail, top rail punching press 18 punches field holes in a manner similar to bottom rail punching press 16: a single hole is punched for each rail punch 344 (FIG. 14), and each hole corresponds to die buttons 346*a* (FIG. 14) located at a field position that is distal from gag cylinder bank 369 (FIG. 14). On the other hand, when punching post holes, one rail punch may engage to punch one field hole and one post hole for a leading edge of the post while the other rail punch does not engage at all, or one rail punch may engage to punch one field hole and one post hole for a trailing edge of the post while the other rail punch engages to punch one field hole. For this reason, each gag is provided with a separate pair of cylinders in gag cylinder bank 369.

Figure 25A:
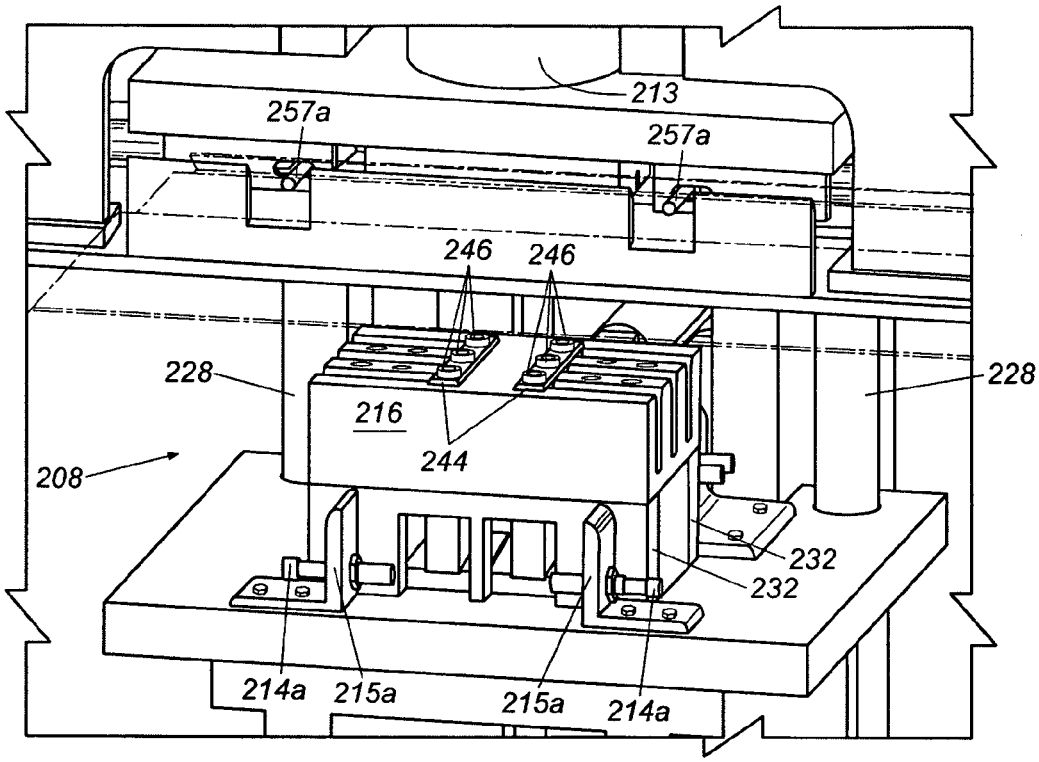
FIG. 25A is a perspective view of the top rail punch assembly of FIG. 11.
Figure 25B:
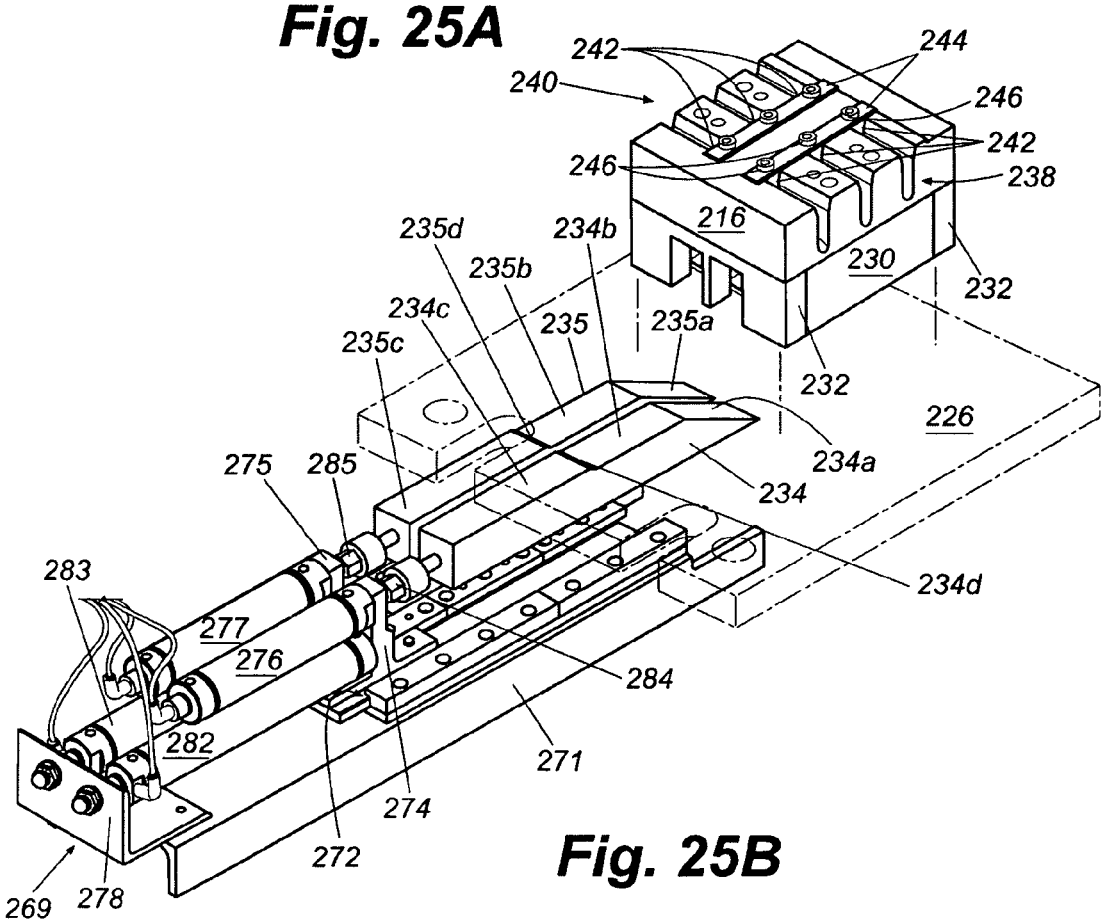
FIG. 25B is a perspective view of the gag assembly of FIG. 14 shown in a position corresponding to the top rail punch assembly of FIG. 25A.

Referring back to FIG. 7, prior to the punching process, two nozzles 207, attached to the side of bottom rail punching press 16 facing the advancing sidewall, spray a lubricating agent onto the bottom rail to reduce friction and binding between the punches and the rail and to minimize wear on the tips of the punches. Once the sidewall passes under the lubricating nozzles, the sidewall assembly is indexed into the bottom rail punching press 16. Referring now to FIG. 25A, as sidewall 2 and bottom rail 4 index into punching area 208, rail punches 244 remain in their normally lowered position, and die buttons 246 do not contact the underside of sidewall 2 or bottom rail 4. Referring to FIG. 25B, cylinder bank 269 remains in its normal arrangement where none of gag cylinders 276, 277, 282 or 283 actuate to force gags 234 into gag spacer 232.

Referring back to FIG. 4B, once sidewall 2 and bottom rail 4 complete the indexing move into punching area 208 (FIG. 25A), skate lifter 29 raises the sidewall assembly up, distal from machine frame 12. That is, lifting cylinder 31 actuates pushing outer skate 32 up while lifter guide posts 33 ensure that the skate remains properly aligned as it rises. Referring to FIGS. 26A and 26B, once the sidewall assembly has been raised, gag cylinders 282 and 283 bias gags 234 ad 235 into gag guides 232, and the respective angled leading edges 234*a* and 235*a* slide under the bottom portion of rail punches 244 lifting the rail punches onto first stage surface 234*b* and 235*b* (FIG. 25B). When resting on first stage surfaces 234*b* and 235*b*, rail punches 244 are positioned such that die buttons 246 are proximate to the underside of sidewall 2 and bottom rail 4 in a position appropriate for punching field and/or post holes.

Alternatively, if gag cylinders 276 and 277 also actuate, gags 234 and 235 will be biased further into gag guides 232 and gag intermediate surfaces 234*d* and 235*d* will push rail punches 244 upwardly until the rail punches come to rest on gag second stage surfaces 234*c* and 235*c*. In this position, rail punches 244 are positioned appropriately to only punch field holes. It should be understood that second stage surfaces 234*c* and 235*c* are raised 0.070 inches from its respective first stage surface 234*b* and 235*b*. This 0.070 inch step accommodates for variations in sidewall assembly thickness when punching through the sidewall panel and the rail only, as opposed to punching through the sidewall panel, the rail, and a post. Thus, first stage surfaces 234*b* and 235*b* are used for punching holes through a bottom rail, a wall panel and a sidewall post, whereas second stage surfaces 234*c* and 235*c* are used for punching through only a bottom rail and a wall panel in between sidewall posts.

Referring to FIG. 26B, gag cylinder bank 269 controls the sliding of gags 234 and 235 into gag guide 232. Actuation of the lower gag cylinders 282 and 283 extends gags 234 and 235 into gag guides 232 so that rail punches 244 are in the post punching position. Upper gag cylinders 276 and 277 may then actuate and piston rods 284 and 285, which are connected respectively to gags 234 and 235, extend forcing gags 234 and 235 even further into gag guides 232 positioning rail punches 244 to punch the wall assembly between posts.

Referring again to FIGS. 25A and 26A, gag proximity switches 214*a*, 214*b* and 214*c* sense the location of gags 234 and 235 to ensure that the gags are properly positioned during the punching process. In a preferred embodiment, front proximity switch brackets 215*a* each support front proximity switch 214*a* such that it will sense the gag leading edges 234*a* and 235*a* when the gags are inserted into gag guides 232. Rear proximity switch brackets 215*b* each support intermediate proximity switch 214*b* and rear proximity switch 214*c*. Intermediate proximity switch 214*b* senses raised gag portions 234*c* and 235*c*, and rear proximity switch 214*c* sense a rear edge 234*e* and 235*e* (FIG. 26B) of the respective gags.

When the gags are not inserted into gag guides 232, only rear proximity switch 214*c* will sense the rear end of gag 234. When the gags are inserted into gag guides 232 such that rail punches 244 are resting on first stage surfaces 234*b* and 235*b*, front proximity switches 214*a* will sense the leading edge 234*a* and 235*a* of the gags, rear proximity switches 214*c* will sense the rear end of the gags 234 and 235, and intermediate proximity switches 214*b* will not sense anything at all and. When the gags are fully inserted into gag guides 232 such that rail punches 244 are resting on second stage surfaces 234*c* and 235*c*, front proximity switches 214*a* will sense gag leading edges 234*a* and 235*a*, intermediate proximity switch 214*b* will sense gag portions 234*c* and 235*c*, but rear proximity switches 214*c* will not sense the gags because the gags will be pushed to a position that is past the location of the rear proximity switches.

The CPU receives signals sent by the proximity switches, and based upon which proximity sensors are relaying information, the CPU can determine whether the gags are in the proper position to perform the punching process. For example, if the CPU only receives information from the rear proximity switches, the CPU will recognize that the gags are in a fully retracted position. Likewise, if the CPU receives information from the front and back proximity switches, the CPU will recognize that the gags are extended only half-way into the gag slots. Finally, if the CPU receives information from only the front and intermediate proximity sensors, the CPU will recognize that the gags are fully extended into the gag slots.

Once gags 234 and 235 slide into gag guides 232 and rail punches 246 rise into a punching position, skate lifter 29 (FIG. 4B) lowers sidewall 2 and bottom rail 4 so that they rest on die buttons 246. Referring back to FIG. 4B, skates 32 are lowered by skate lifters 29, which pull skates 32 downward and distal from the underside of sidewall panel 2, until sidewall panel 2 rests entirely upon die buttons 246 (FIG. 26A).

Referring to FIG. 26A, once the sidewall assembly (not shown in FIG. 26A) rests on die buttons 246, top die gag cylinders 262 (FIG. 10) actuate, driving the appropriate gags into their respective top die gag slots 260. That is, when punching field holes, only the gag cylinders connected to field gags 256 actuate, and only the field gags slide fully into their slots 262. This ensures that when the top die is lowered toward the sidewall during punching, only the field punches 254*a* (FIG. 10) will punch through the bottom rail 4 and sidewall panel 2 between posts. Post gags 258 are not driven into their slots, and, accordingly, post punches 254*b* (FIG. 10) simply slide up through the counterbored through-holes 264 during punching, ensuring that only field holes are punched. When punching at a post, gag cylinders 262 engage both a field gag 256 and a post gag 258 on the same side of punch retainer 252 and drive them into their respective gag slots 260. In this position, field gag proximity switches 257*a* and post gag proximity switches 257*b* (FIGS. 8 and 10) no longer sense the gags and relay a signal to the CPU indicating that the gags have been properly biased into the slots 260 for punching.

Figure 27A:
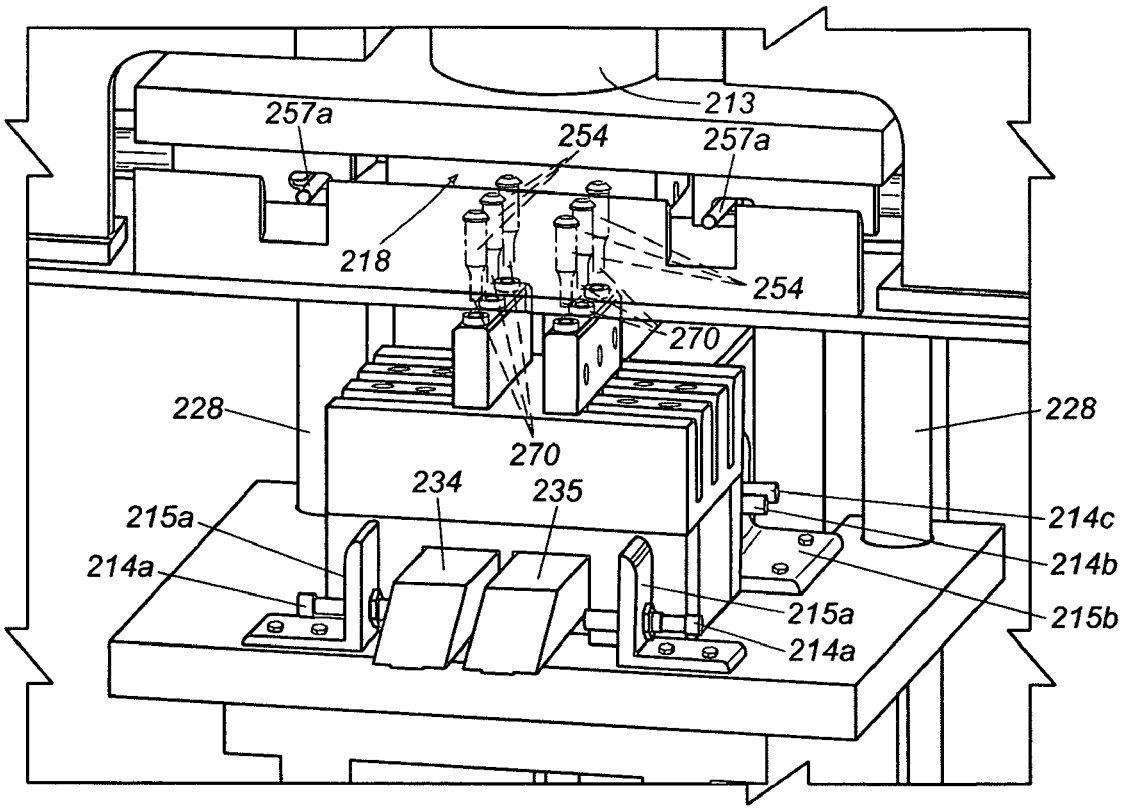
FIG. 27A is a perspective view of the top rail punch assembly of FIG. 11.
Figure 27B:
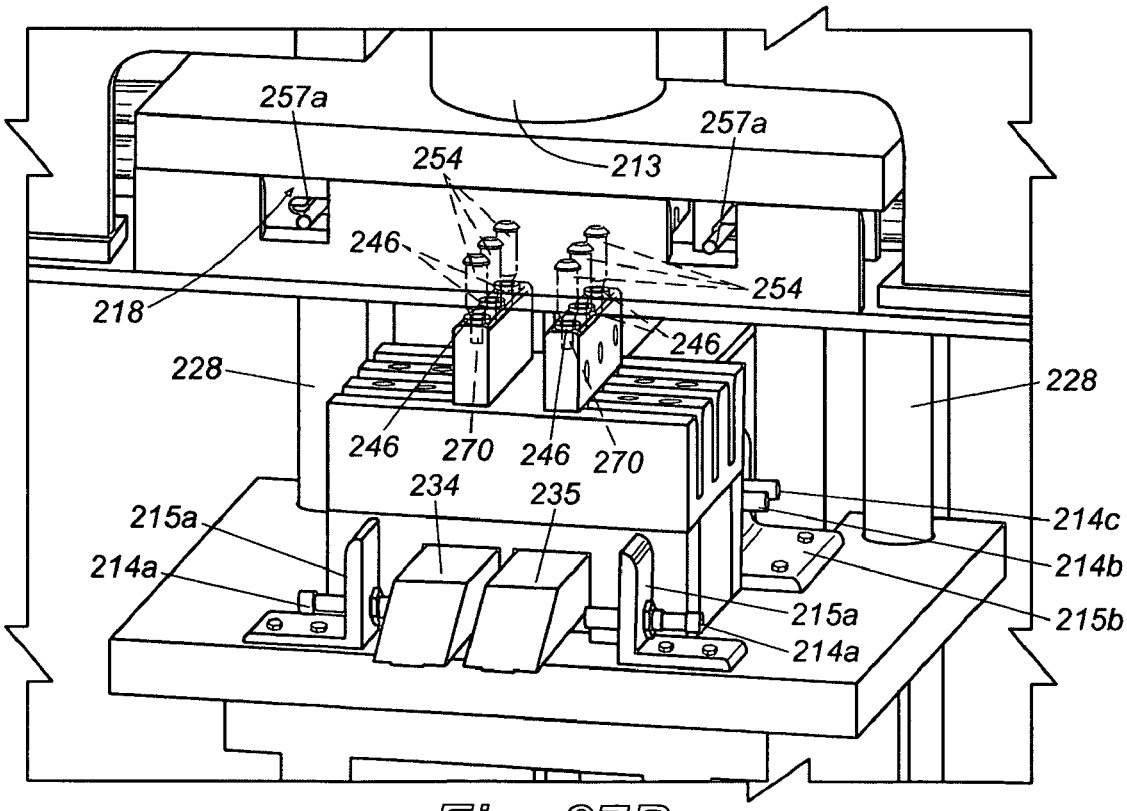
FIG. 27B is a perspective view of the gag assembly of FIG. 14 shown in a position corresponding to the top rail punch assembly of FIG. 27A.

As previously discussed, punch cylinder 212 (FIGS. 6 and 7) may be a push type cylinder actuated to push top die assembly 218 upward distal from bottom punching die 216 or downward into a punch stroke. Referring to FIGS. 10 and 27A-27B, once the gag cylinders drive the appropriate punch gags into their respective slots 260, the CPU sends a signal to the PLC to actuate cylinder 212 (FIG. 8) into a punching stroke. Thus, piston rod 213 and top die assembly 218 is biased downward until lower punching proximity switch 223 (FIG. 8) senses top die shoe 248. Top shoe bushings 250 slide along guide posts 228 ensuring that top shoe 248 remains parallel to the sidewall during the punching process. In a preferred embodiment, punching cylinder 212 is selected so that the stroke of piston rod 213 reaches its fully extended position to punch through both bottom rail 4, sidewall panel 2 and a post. As a result, when piston rod 213 is fully extended, die button center bores 245 (FIG. 9) slidably receive punch tips 270, as shown in FIG. 27B.

Once punching has occurred, lower punching proximity switch 223, which is positioned to sense when top die shoe 248 is lowered far enough to fully punch through the sidewall assembly, sends a signal to the CPU that the holes have been punched. The CPU then sends a signal to the PLC, and the PLC actuates punching cylinder 212 so as to push piston rod 213 and top die assembly 218 upwards to its home position. When top die assembly 218 reaches its home position, upper punching proximity switch 222 senses top die shoe 248 and relays a signal back to the CPU that the top die assembly 218 has reached its home position, and the sidewall assembly may be indexed to the next punching position. Often punches 254 will bind in the punched holes pulling the sidewall assembly up and off of the lower die. To prevent the sidewall from binding with the punches, a separating mat 220 is provided at the bottom rail punch press upper portion 202 to separate the sidewall assembly from the punches as top die shoe 248 is lifted upwards away from rail punches 244.

After the holes have been punched in the sidewall assembly and punching cylinder piston rod 213 has raised top die shoe 248 and top die assembly 218, skate lifter cylinder 31 raises skate 32 (FIG. 4B) lifting the sidewall assembly off of rail punches 244. Gag cylinder bank 269 pulls the gags 234 and 235 out of their gag guides 232 lowering rail punches 244 to their lowered position (FIG. 25B). After rail punches 244 return to their lowered positions, skate lifter cylinder 31 pulls skate 32 down proximate to machine frame 12 (FIG. 4B) returning sidewall assembly to a position where it may be indexed by center cart mechanism 14 (FIG. 2). The center cart mechanism indexes the sidewall once again, the vision system takes another picture to confirm the position of the side wall assembly relative to the punching presses, and the punching process repeats itself until holes have been punched along the entire length of the bottom rail. As previously mentioned, the same process is simultaneously followed for the top rail.

Figure 27C:
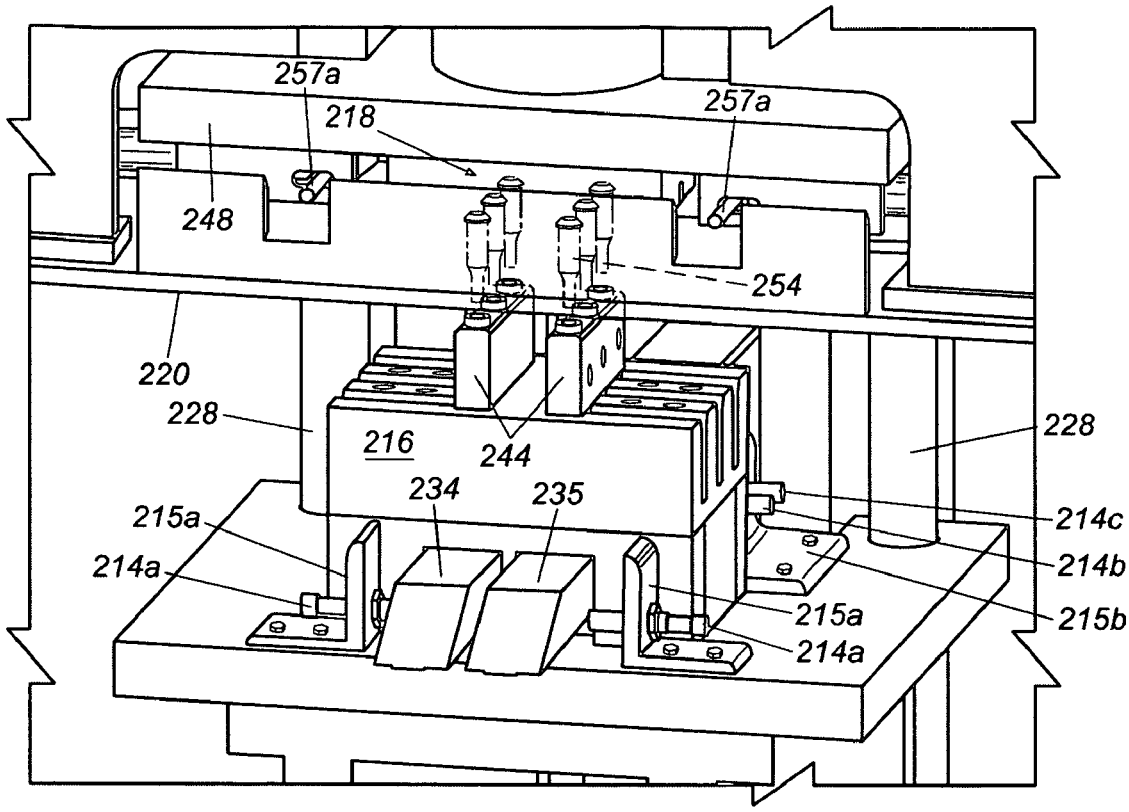
FIG. 27C is a perspective view of the top rail punch assembly of FIG. 11.
Figure 27D:
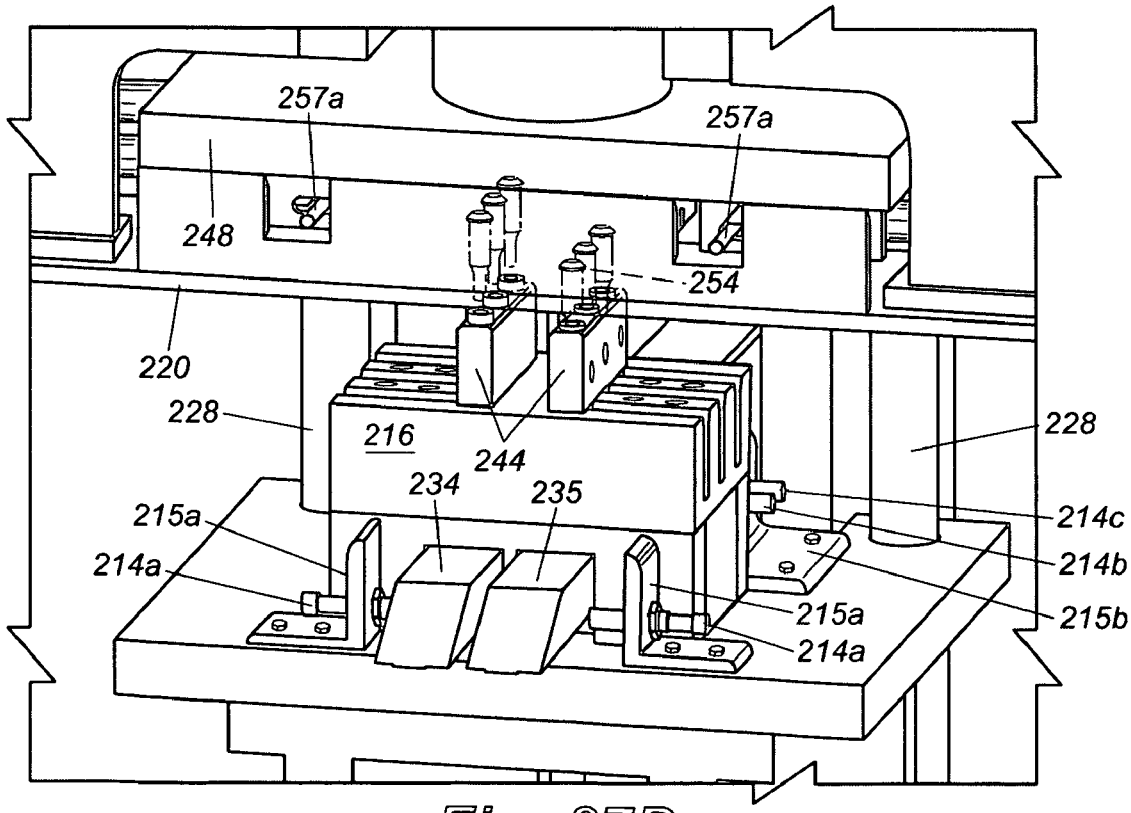
FIG. 27D is a perspective view of the gag assembly of FIG. 14 shown in a position corresponding to the top rail punch assembly of FIG. 27C.

FIGS. 27C & 27D show the gag assembly of FIG. 27B in another position.

Once the newly punched holes in both the bottom and top rails pass through their respective punching presses, operators wipe bottom and top rails 4 and 6 with a rag to remove excess lubricant from the rails, and rivet blanks are inserted into the punched holes. The eight-foot spacing between the punching presses and the riveting presses gives the operators ample time and work space to clean the rails and insert the rivets before the riveting presses engage the rivet blanks.

Figure 28A:
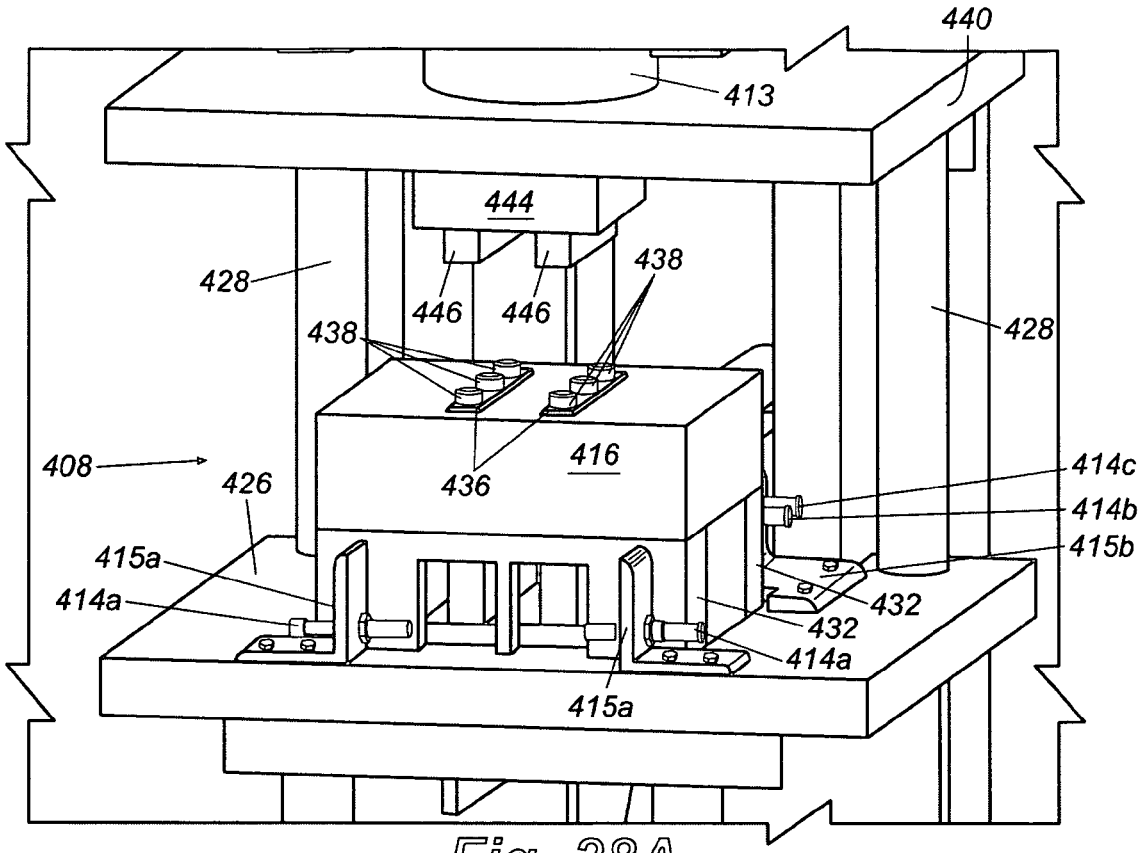
FIG. 28A is a perspective view of the rivet compressing area of the riveting press of FIG. 16.
Figure 28B:
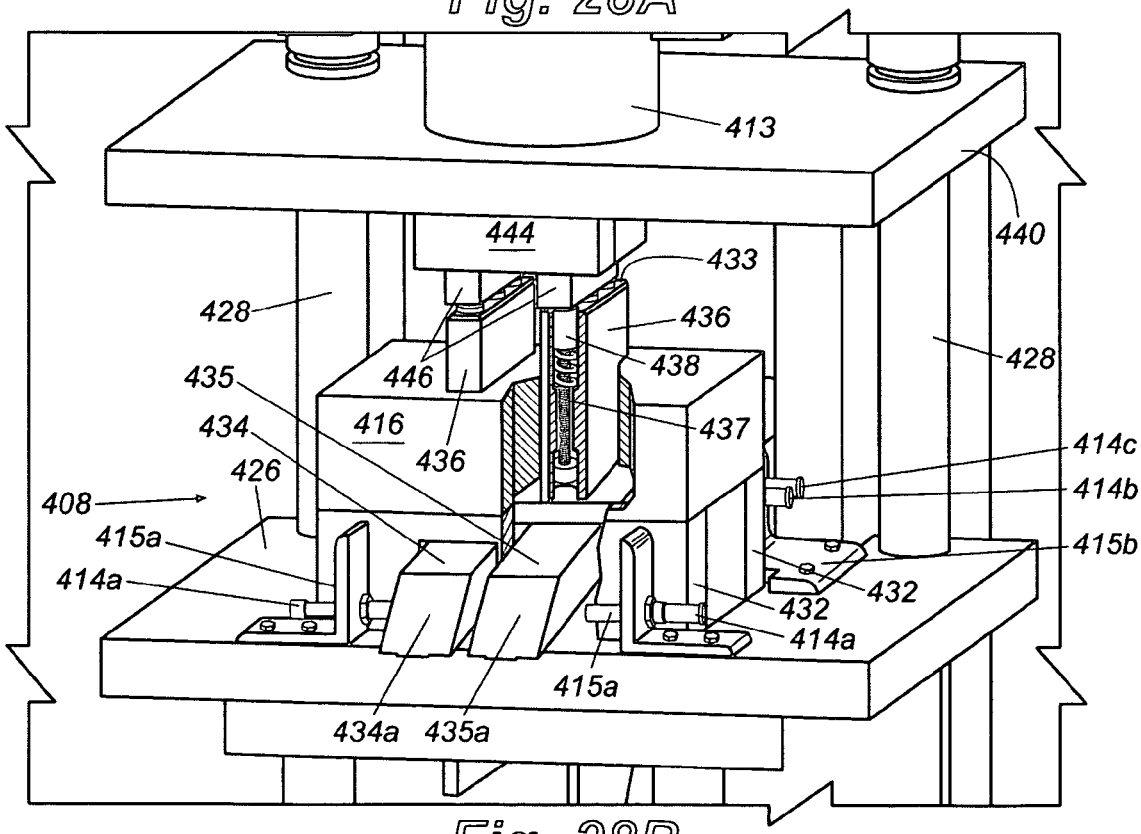
FIG. 28B is a perspective view of the rivet crushing area of FIG. 16 shown in a rivet crushing position.
Figure 28C:
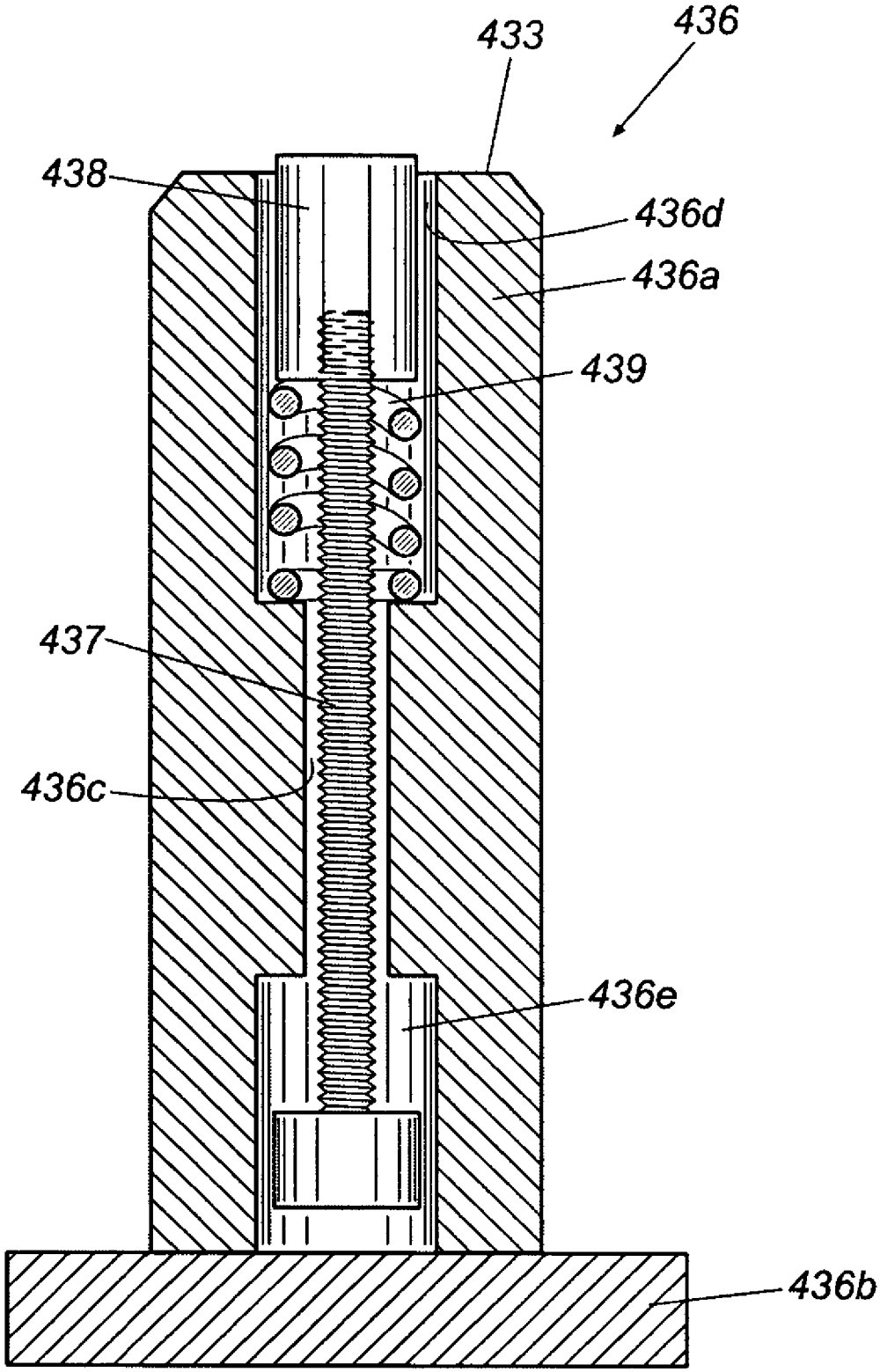
FIG. 28C is a section view of a rail anvil for use in the riveting press of FIG. 16.

Referring to FIGS. 19, 28A and 28B, as the sidewall assembly enters the riveting area 408 of riveting press 20*b*, gag cylinder bank 469 (FIGS. 16, 17, and 20) actuates in exactly the same manner as described above in connection with bottom rail punching press 16. Once the sidewall assembly completes the indexing move into riveting area 408 (FIGS. 28A and 28B), skate lifter 29 raises the sidewall assembly up distal from machine frame 12. Lifting cylinder 31 actuates, pushing outer skate 32 up while lifter guide posts 33 ensure that the skate remains properly aligned as it rises (FIG. 4B).

Referring with particularity to FIG. 19, once the sidewall assembly has been raised, gag cylinders 476 and 477 and/or 482 and 483 bias gags 434 and 435 into gag guides 432. If both post and field rivets are to be mashed, then only gag cylinders 476 and 477 actuate causing the respective angled leading edges 434*a* and 435*a* to slide under the bottom portion of rail anvils 436 lifting the rail anvils onto gag first stage surfaces 434*b* and 435*b*. IF on the other hand only field rivets are to be mashed, then all four gag cylinders 476, 477, 482 and 483 actuate causing the respective transition portions 434*d* and 435*d* to slide under the bottom portion of rail anvils 436 lifting the anvils onto gag second stage surfaces 434*c* and 434*d*. When resting on either the gag first or second stage surfaces, rail anvils 436 are positioned such that plungers 438 are proximate to the underside of sidewall 2 and bottom rail 4. It should be understood that the gag second stage surfaces are raised 0.070 inches from the gag first stage surface to accommodate for the variances in the wall thickness between a post position and a field position. That is, when mashing rivets at sidewall posts, the sidewall assembly is thicker than when only mashing field rivets in between posts.

Referring now to FIG. 28A, gag proximity switches 414*a*, 414*b* and 414*c* sense the location of gags 434 and 435 to ensure that the gags are properly positioned during the riveting process. In one embodiment, front proximity switch brackets 415*a* each support front proximity switch 414*a* such that it will sense the sloped leading edges 434*a* and 435*a* of the gags when the gags are inserted into gag guides 432. Rear proximity switch brackets 415*b* each support intermediate proximity switch 414*b* and rear proximity switch 414*c* (FIG. 28A). Intermediate proximity switch 414*b* senses the raised gag portions 434*c* and 435*c* (FIG. 19), and rear proximity switch 414*c* sense the gag rear ends 434*e* and 435*e* (FIG. 19).

When the gags are not inserted into gag guides 432, only rear proximity switch 414*c* will sense the body of gags 434 and 435. When the gags are inserted into gag guides 432 such that rail punch 444 is resting on the first stage surfaces, front proximity switch 414*a* will sense the respective leading edges 434*a* and 435*a* of the gags, proximity switches 414*c* will sense the rear end of gags 434 and 435, and intermediate proximity switches 414*b* will not sense anything at all. When the gags are fully inserted into gag guides 432 such that rail punch 444 are resting on second stage surfaces 434*c* and 435*c*, the front proximity switches will sense the leading edge of the gags, intermediate proximity switches 414*b* will sense the raised gag portions 434*c* and 435*c*, but rear proximity switches 414*c* will not sense the gags at all because gag rear end portions 434*e* and 435*e* will be pushed to a position that is past the location of the rear proximity switch. The CPU receives the signals sent by the proximity switches, and based upon which proximity sensors are relaying information the CPU can determine whether the gags are in the proper position to perform the mashing process. For example, if the CPU only receives information from the rear proximity switches, the CPU will recognize that the gags are in a fully retracted position. Likewise, if the CPU receives information from the front and back proximity switches, the CPU will recognize that the gags are extended only half-way into the gag slots. Finally, if the CPU receives information from only the front and intermediate proximity sensors, the CPU will recognize that the gags are fully extended into the gag slots.

Referring back to FIG. 4B, as with the punching presses, skates 32 that support the sidewall assembly in the vicinity of riveting press 20*b*, are lowered by skate lifter cylinder 31 until the sidewall assembly rests entirely on plungers 438 (FIG.

28A). Referring to FIG. 28C, plungers 438 extend far enough beyond the rail anvil top surface 433 that the shank end of the rivets blanks (not shown), which extend below the bottom surface of sidewall 2 and rails 4 or 6, do not make contact with the top surface of rail anvils 436. Springs 439 (FIG. 28C) are stiff enough to maintain plungers 438 in the upward position so that when the sidewall assembly rests atop the plungers, springs 439 do not compress and allow the rail anvils to push the rivets (not shown) out through the top of their respective holes.

Referring now to FIGS. 16-18A, once sidewall 2 rests exclusively on plungers 438, the CPU sends a signal to the PLC, which then actuates cylinder 412 (FIGS. 16 and 17), driving piston rod 413 (FIG. 18A) and top die assembly 418 down until lower punching proximity switch 423 (FIGS. 16 and 17) senses top die shoe 440. Top shoe bushings 442 slide along guide posts 428 ensuring that top die shoe 440 remains parallel to the sidewall as it is lowered during the riveting process. Lower riveting proximity switch 423 is positioned such that it senses the location of top die shoe 440 only when the top die shoe has been lowered far enough for anvils 446 to engage and compress the rivet blanks (not shown).

As the top die shoe lowers to its rivet compressing position, anvils 446 push the flanges of the rivet blanks (not shown) and urge them downward. Plungers 438, as previously described, are spring loaded and engage the sidewall assembly between rivet blanks. As the top die shoe lowers, plungers 438 engage the underside of the sidewall assembly and press the assembly parts together to ensure that the parts are properly aligned and no gaps exist between the parts when the rivet blanks are compressed. The downward pressure exerted on the rivets by anvils 446 eventually overcomes the resilient spring-force of springs 438 (FIG. 28C) and forces plungers 438 down until the shank end of the rivets (not shown) contacts rail anvil top surface 433 (FIG. 28C). The downward force on riveting anvils 446, anvil spacer 444, and top die shoe 440 compresses the rivet shanks against rail anvils 436 causing the rivet shanks to spread along the bottom of sidewall 2 and rails 4 or 6 securely fastening the three components together. As previously mentioned, lower riveting proximity switch 423 senses top die shoe 440 when riveting cylinder piston rod 413 has fully extended allowing riveting anvils and rail anvils to properly compress the rivets. When lower proximity switch 423 senses top die shoe 440, a signal is sent to the CPU that actuates riveting cylinder 412 lifting top die shoe 440 until it reaches its home position.

After top die shoe 440 returns to its home position, skate riser cylinder 31 actuates lifting skate 32 (FIG. 4B), thereby lifting the sidewall assembly off of rail anvil plungers 438. Gag cylinder bank 469 (FIGS. 16, 17 and 20) retracts bottom die gags 434 and 435 from gag guides 432 lowering rail anvils 436. Once rail anvils 436 are lowered, skate riser cylinder actuates lowering the skate and sidewall assembly back onto frame 12 so that the wall can be indexed once again. After the sidewall assembly has been riveted together along the entire length of the sidewall assembly, operators remove the fully assembled sidewall, and a new, unassembled sidewall may be loaded on the machine 10 for assembly.

While one or more preferred embodiments of the invention have been described above, it should be understood that any and all equivalent realizations of the present invention are included within the scope and spirit thereof. The embodiments depicted are presented by way of example and are not intended as limitations upon the present invention. Thus, those of ordinary skill in this art should understand that the present invention is not limited to the embodiments disclosed herein since modifications can be made.

What is claimed is:

1. A method for automatically fastening a sidewall to an upper or lower rail, comprising:

a. providing the sidewall with a first post, said first post attached to an underside of the sidewall, said first post having a first reference point and a second reference point spaced apart from the first reference point, the first reference point and the second reference point being detectable from the topside of the sidewall, providing a carriage movable relative to the longitudinal axis of the sidewall for moving the sidewall, and providing a machine including a hole puncher, a rivet masher, a first sensor, a second sensor, and a processor;

b. automatically detecting said first post using signals from said first sensor that are sent to said processor, c. automatically obtaining style information about said sidewall adjacent to said second sensor, via image data obtained from said second sensor, d. providing information to the processor from said first sensor and then to an assembly program;

e. automatically punching at least one hole through the sidewall and the upper or lower rail in response to said style information obtained by said second sensor;

f. inserting a rivet in said at least one hole; and g. automatically mashing said rivet in response to said information obtained by said second sensor to secure the sidewall to the upper or lower rail.

2. The method for automatically fastening a sidewall to an upper or lower rail of claim 1, further comprising after step (e), the step of automatically moving said carriage along said longitudinal axis a fixed distance.

3. The method for automatically fastening a sidewall to an upper or lower rail of claim 2, further comprising the step of automatically obtaining new information about the sidewall adjacent said second sensor after said carriage is moved a fixed distance.

4. A method for automatically fastening a sidewall to at least one of an upper rail or a lower rail, the sidewall including at least one post, comprising:

a. moving the sidewall and the at least one rail along the longitudinal axis of the sidewall, b. sensing the location of the at least one post and sensing the type of the at least one post, the type being selected from a plurality of different types of posts, wherein the type sensing includes using image data obtained from a vision sensor;

c. based upon the location of the at least one post and the sensed type, automatically punching at least one hole through the sidewall and the at least one rail;

d. inserting a fastener in the at least one hole; and e. automatically securing the fastener to secure the sidewall to the at least one rail.

5. The method of claim 4, further comprising before step (a), the step of placing the sidewall and the at least one rail in adjacent position.

6. The method of claim 4, further comprising before step (a), the step of aligning the sidewall and the at least one rail.

7. The method of claim 4, wherein the sidewall is gripped and moved a predetermined distance.

8. The method of claim 7, wherein the sidewall and the at least one rail are gripped and moved by a cart mechanism.

9. The method of claim 4, wherein step (b) includes automatically sensing the at least one post using a proximity sensor.

10. The method of claim 4, wherein in step (b), the step of determining the location of the at least one post of the sidewall is performed by taking a picture.

11. The method of claim 10 further comprising before or after step (c), automatically aligning the sidewall and the at least one rail along the longitudinal axis of the sidewall based on input from the vision sensor.

12. The method of claim 4, wherein in step (b), the step of determining the type of sidewall using image data is performed by taking a picture.

13. A method for automatically fastening a sidewall to at least one of an upper rail or a lower rail, the sidewall including at least one post, comprising:

a. sensing a style of the sidewall, wherein sensing the style of the sidewall includes taking a picture using a vision sensor;

b. based upon the sensed style, automatically selecting an assembly program for automatically fastening the sidewall to the at least one rail;

c. moving the sidewall by indexed movements of a cart mechanism;

d. sensing either a correct position or an incorrect position of the sidewall; and e. when the incorrect position is sensed in step (d), adjusting the indexed movements by a first distance to move the sidewall to the correct position.

14. The method of claim 13, wherein sensing the style of the sidewall includes imaging a fastening pattern, the fastening pattern showing the sidewall fastened to the at least one post.

15. The method of claim 13, wherein sensing the style of the sidewall includes digitally processing the picture.

16. The method of claim 13, further comprising before step (a), the step of positioning a forward edge of the sidewall.

17. The method of claim 13, wherein the step of sensing the style includes locating the at least one post.

18. The method of claim 13, further comprising after step (b), the step of moving the sidewall and the at least one rail along the longitudinal axis of the sidewall.

19. The method of claim 13, further comprising after step (b), the steps of automatically punching at least one hole through the sidewall and the at least one rail, inserting a fastener in the at least one hole, and automatically securing the fastener to secure the sidewall to the at least one rail.

20. The method of claim 19, further comprising the step of determining a punching pattern for automatically punching the at least one hole using the style.

21. The method of claim 19, further comprising the step of determining a securing pattern for automatically securing the fastener using the style.

22. The method of claim 13, further comprising after step (b), the step of gripping the sidewall and the at least one rails, and wherein in the step (c), the indexed movement includes moving the sidewall and the at least one rail a predetermined distance based on the assembly program.

23. The method of claim 22, further comprising the step of a further sensing of the sidewall after moving the predetermined distance.

24. The method of claim 23, further comprising the step of indexing the predetermined distance against a reference distance of the assembly program using a processor.

25. The method of claim 24, further comprising the step of recognizing an incorrect distance as a difference between the predetermined distance the sidewall has been moved and the reference distance.

26. The method of claim 25, further comprising the step of adjusting a second predetermined distance based on the incorrect distance.

27. A method for automatically fastening a sidewall to at least one of an upper rail or a lower rail, the sidewall including at least one post, comprising:

a. moving the sidewall and the at least one rail along the longitudinal axis of the sidewall, b. sensing the location of the sidewall, c. sensing the style of the sidewall including taking a picture of the sidewall using a vision sensor, d. determining a fastening pattern based at least in part on the style of the sidewall.

28. The method of claim 27, wherein the fastening pattern is executed, and the execution comprises automatically punching at least one hole through the sidewall and the at least one rail, inserting a fastener in the at least one hole, and automatically securing the fastener to secure the sidewall to the at least one rail.

29. The method of claim 27, wherein the style is also determined in part by the location.

30. The method of claim 29, wherein step (b) includes sensing the location of the at least one post.

31. The method of claim 27, wherein in step (c), the step of taking a picture includes imaging the sidewall, and wherein, based upon the imaging, the style of the sidewall is automatically determined.

32. The method of claim 27, wherein step (c) includes digitally processing the picture using a processor.

33. The method of claim 27, wherein step (d) includes determining a fastening pattern based at least in part on the sensed location of the sidewall.

34. The method of claim 27, wherein the sidewall and the at least one rail are moved a predetermined distance based on the fastening pattern.

* * * * *